US006109737A

United States Patent [19]

Kishima

[11] Patent Number: 6,109,737

[45] Date of Patent: Aug. 29, 2000

[54] PRINTER DEVICE AND THE MANUFACTURING METHOD

[75] Inventor: Koichiro Kishima, Kanagawa, Japan

[73] Assignee: Sony Corporation, Tokyo, Japan

[21] Appl. No.: 08/973,352

[22] PCT Filed: Apr. 4, 1997

[86] PCT No.: PCT/JP97/01177

§ 371 Date: Dec. 4, 1997

§ 102(e) Date: Dec. 4, 1997

[87] PCT Pub. No.: WO97/37851

PCT Pub. Date: Oct. 16, 1997

[30] Foreign Application Priority Data

Apr. 4, 1996 [JP] Japan ..... 8-110449
Aug. 20, 1996 [JP] Japan ..... 8-218950

[51] Int. Cl.[7] ..... B41J 2/045
[52] U.S. Cl. ..... 347/70
[58] Field of Search ..... 347/68–71, 10; 524/493

[56] References Cited

U.S. PATENT DOCUMENTS

| | | | |
|---|---|---|---|
| 5,521,619 | 5/1996 | Suzuki et al. | 347/10 |
| 5,710,584 | 1/1998 | Suzuki et al. | 347/70 |
| 5,793,394 | 8/1998 | Kato | 347/70 |
| 5,886,717 | 3/1999 | Satake et al. | 347/70 |
| 5,900,450 | 5/1999 | Tanaka et al. | 524/493 |

FOREIGN PATENT DOCUMENTS

| | | |
|---|---|---|
| 0 572 231 A2 | 5/1993 | European Pat. Off. . |
| 0 640 481 A2 | 7/1994 | European Pat. Off. . |

OTHER PUBLICATIONS

Patent Abstracts of Japan Application No. 63127561 dated May 25, 1988.
Patent Abstracts of Japan Application No. 05183625 dated Jul. 26, 1993.

*Primary Examiner*—John Barlow
*Assistant Examiner*—Charles W. Stewart, Jr.
*Attorney, Agent, or Firm*—Hill & Simpson

[57] ABSTRACT

In a printer according to the present invention, a diaphragm provided with a thermoplastic layer and a pattern layer is set on the main surface of a pressure chamber forming part in which a liquid supply passage is formed, when the thermoplastic layer of the diaphragm is pressed, heated and bonded onto the pressure chamber forming part, pressure is applied only to the pattern layer of the diaphragm, no unnecessary pressure is applied to a part opposite to the liquid supply passage in which the pattern layer is not formed, the liquid supply passage is prevented from being blocked by the thermoplastic layer, and operation for bonding the diaphragm to the pressure chamber forming part in which the pressure chamber is formed is facilitated.

Further, in the printer according to the present invention, an adhesive layer consisting of thermoplastic resin is formed between the pressure chamber forming part and the diaphragm and the bonding strength of the diaphragm to the pressure chamber forming part is sufficiently secured. Also, in the printer, each nozzle is formed in a nozzle forming member, if an adhesive layer consisting of thermosetting resin is formed between the pressure chamber forming part and the nozzle forming member, the pressure chamber forming part and the nozzle forming member are bonded under room temperature after the diaphragm and the pressure chamber forming part are bonded, at this time the adhesive layer consisting of thermoplastic resin is not influenced, no heat is also applied to a liquid repelling film if the liquid repelling film is formed on the nozzle forming member, and a range in which the liquid repelling film is selected is widened.

32 Claims, 63 Drawing Sheets

FIRST PIEZOELECTRIC ELEMENT 323a

SECOND PIEZOELECTRIC ELEMENT 323b

PRINTER DEVICE AND THE MANUFACTURING METHOD

TECHNICAL FIELD

The present invention relates to a printer and the manufacturing method and can be suitably applied to a printer and the manufacturing method wherein an ink droplet is emitted from a nozzle according to a recording signal and is recorded on a recording medium such as paper or film.

BACKGROUND ART

Recently, a so-called ink jet printer for recording by emitting an ink droplet and directly fitting it on a recording medium such as paper and a film is rapidly being popularized.

A so-called on-demand printer wherein an ink droplet is emitted according to a recording signal is particularly popularized of these ink jet printers because miniaturization and the reduction of the cost can be realized.

For a method of emitting an ink droplet in the above on-demand printer, various methods are proposed, however, a method of using a piezoelectric element or a method of using an exothermic element is popular. The former is a method of applying pressure to a pressure chamber filled with ink by the deformation of a piezoelectric element and emitting ink. The latter is a method of heating and boiling ink by an exothermic element and emitting ink by the pressure of generated foam.

For the above method of using a piezoelectric element, there are a method of bonding a laminated piezoelectric element formed by laminating three or more piezoelectric elements to a pressure chamber filled with ink via a diaphragm and pressurizing the pressure chamber via the diaphragm by linearly displacing the above laminated piezoelectric element and a method of bonding a piezoelectric element consisting of a single plate or a piezoelectric element in which two or more piezoelectric elements are laminated to a pressure chamber filled with ink via a diaphragm, curving the diaphragm by bimorph effect between the diaphragm and the piezoelectric element by applying voltage to the piezoelectric element and pressurizing the pressure chamber.

Such a printer is provided with a print head with the following structure for example. That is, as shown in FIG. 78, the print head is constituted by a pressure chamber forming part 1101, a diaphragm 1102, a piezoelectric element 1103 and a nozzle forming member 1104.

In the above pressure chamber forming part 1101, a first groove part 1105 forming a liquid supply passage, a second groove part 1106 forming a pressure chamber and a third groove part 1107 forming a liquid supply passage are formed so that they communicate and are open opposite to one main surface 101*a*. The first groove part 1105 and the third groove part 1107 are formed as grooves with approximately equal depth and the second groove part 1106 is formed as a deeper groove. In the above pressure chamber forming part 1101, a nozzle leading hole 1108 which is pierced from the bottom surface 1107*a* of the third groove part 1107 to a main surface 110*b* opposite to one main surface 101*a* of the pressure chamber forming part 1101 in the direction of thickness is formed.

A diaphragm 1102 is bonded to the side of one main surface 1101*a* of the above pressure chamber forming part 1101 by an adhesive not shown so that the diaphragm closes the first groove part 1105, the second groove part 1106 and the third groove part 1107, space surrounded by the first groove part 1105 and the diaphragm 1102 functions as a liquid supply passage 1109, space surrounded by the second groove part 1106 and the diaphragm 1102 functions as a pressure chamber 1110 and space surrounded by the third groove part 1107 and the diaphragm 1102 functions as a liquid passage 1111. Therefore, the liquid supply passage 1109, the pressure chamber 1110, the liquid passage 1111 and the nozzle leading hole 1108 are formed so that they communicate.

As an ink supply pipe not shown and connected to an ink tank not shown is attached to the above diaphragm 1102, a through hole not shown and corresponding to the ink supply pipe is made in the diaphragm 1102.

Further, a piezoelectric element 1103 consisting of a single plate is fixed by an adhesive not shown in a position corresponding to the pressure chamber 1110 of a main surface 1102*a* reverse to the surface opposite to the pressure chamber forming part 1101 of the above diaphragm 1102.

Furthermore, a nozzle forming member 1104 (hereinafter called an orifice plate 1104) in which an emission nozzle 1112 communicating with the nozzle leading hole 1108 for emitting ink is formed is arranged on one main surface 1101*b* reverse to one main surface 1101*a* which is the groove part open face of the pressure chamber forming part 1101.

That is, in the above print head, ink is supplied first from the liquid supply passage 1109 to the emission nozzle 1112 via the pressure chamber 1110, the liquid passage 1111 and the nozzle leading hole 1108 and a meniscus is formed at the end of the emission nozzle 1112. In the print head, as the piezoelectric element 1103 is contracted in an in-plane direction by bimorph effect when predetermined voltage is applied to the piezoelectric element and is curved in the direction of thickness shown by an arrow $m_1$ in FIG. 78, the diaphragm 1102 is also curved in the direction shown by the arrow $m_1$ in FIG. 78 according to the above curvature. As a result, the volume of the pressure chamber 1110 is decreased, pressure in the pressure chamber 1110 rises, ink is emitted from the emission nozzle 1112, the ink is fixed on a recording medium and printing is made.

Generally, such a printer is provided with such plural print heads. That is, as schematically shown in FIG. 79, such print heads are arranged so that they are parallel each other in the longitudinal direction of a tubular ink buffer tank 1114 provided with an ink supply port 1113 connected to an ink tank not shown and the liquid supply passage 1109 of each print head is connected to the ink buffer tank 1114 so that the liquid supply passage is perpendicular to the side 1114*a* of the ink buffer tank 1114. Therefore, the emission nozzle 1112 of each print head is open on one main surface. Ink is supplied from an ink tank not shown to the ink buffer tank 1114 and is supplied from there to the liquid supply passage 1109 of each print head.

Recently, documentation using a computer called desk top publishing is often performed particularly in an office and others and lately, a request for outputting not only a character and a graphic form but a color natural image such as a photograph together with a character and a graphic form is also increased. Accordingly, it is required to print high quality of a natural image and the reproduction of a halftone is important.

For a method of reproducing the above halftone in the above on-demand printer for emitting an ink droplet, various methods are proposed. That is, for a first method, a method of controlling the size of an emitted ink droplet by varying the voltage and the pulse length of a voltage pulse to be applied to a piezoelectric element or an exothermic element and representing a scale by varying the diameter of a print dot can be given.

However, according to this method, as ink cannot be emitted when voltage and pulse length applied to a piezoelectric element or an exothermic element are lowered/decreased too much, the minimum diameter of an ink droplet is limited, the number of representable scales is small, particularly the representation of a low-density image is difficult and the method is not enough to print a natural image.

For a second method, a method of constituting one picture element by a matrix consisting of (4×4) dots for example without varying a dot diameter and representing a scale in units of matrix using a so-called dither method can be given. In this case, representation in 17 scales is allowed.

However, if for example, printing is made in the same dot density as in the first method by this method, resolution is one fourth of that in the first method and as roughness is remarkable, the method is not enough to print a natural image.

The inventors of the present invention have proposed a printer wherein the density of an emitted ink droplet can be varied and the density of a printed dot can be controlled by mixing ink and a diluent solvent when ink is emitted and a natural image is printed out without deteriorating resolution.

Briefly describing the print head of such a printer mixing two solutions, the print head is constituted so that it is provided with an emission nozzle into which an emitted medium is led and a quantity determining nozzle into which a quantity determined medium is led so that they are adjacent, and the quantity determined medium and the emitted medium are mixed and emitted in the in-plane direction of the emission nozzle and the quantity determining nozzle by percolating a predetermined quantity of quantity determined medium into the emission nozzle from the quantity determining nozzle, mixing the quantity determined medium with the emitted medium in the vicinity of the opening of the emission nozzle and pushing out the emitted medium together with the emitted medium mixed with the quantity determined medium from the emission nozzle. In such a printer, a natural image is printed out by changing the quantity of a quantity determined medium which is either ink or a diluent solvent and changing the density of a dot by changing the mixing ratio of the ink or the diluent solvent. Either of the above quantity determined medium or the above emitted medium may be ink and the other may be a diluent solvent.

In such a two solution mixed type printer, a function for emitting ink or a diluent solvent is also required as in the above on-demand ink jet printer and for such a function for emission, the above method of using a piezoelectric element as in the above ink jet printer or the above method of using an exothermic element is popularly used.

Therefore, the above two solution mixed type printer is provided with approximately the same constitution as the above ink jet printer. An example in which a diluent solvent is an emitted medium and ink is used as a quantity determined medium will be described below. That is, a first liquid supply passage for leading an emitted medium into the above pressure chamber forming part, a first pressure chamber, a first liquid passage and a first nozzle leading hole are provided in order, a second liquid supply passage for leading a quantity determined medium, a second pressure chamber, a second liquid passage and a second nozzle leading hole are provided in order at a predetermined interval from these so that they are adjacent, a diaphragm is bonded to the pressure chamber forming part and a piezoelectric element is provided in a position corresponding to each pressure chamber.

Further, an orifice plate provided with an emission nozzle and a quantity determining nozzle respectively communicating with the first and second nozzle leading holes in a position corresponding to the first and second nozzle leading holes of the pressure chamber forming part is bonded to the main surface on the side on which a diaphragm is not arranged of the pressure chamber forming part. It is desirable that the orifice plate is formed so that the respective openings of the emission nozzle and the quantity determining nozzle are adjacent to facilitate the mixture of ink and a diluent solvent.

Generally, the above two solution mixed type printer is also provided with plural print heads and a first liquid supply passage and a second liquid supply passage of each print head are respectively connected to a diluent solvent buffer tank and an ink buffer tank. In the above printer, each print head is also arranged in parallel at a predetermined interval and each nozzle is arranged so that it forms a plane.

At this time, the diluent solvent buffer tank and the ink buffer tank are respectively connected to a diluent solvent tank and an ink tank, a diluent solvent or ink is supplied from the diluent solvent buffer tank or the ink tank to the first liquid supply passage or the second liquid supply passage, supplied to the first pressure chamber or the second pressure chamber and supplied to the emission nozzle or the quantity determining nozzle via the first liquid passage and the first nozzle leading hole or the second liquid passage and the second nozzle leading hole.

Also in the two solution mixed type printer, for example ink is percolated from the quantity determining nozzle to the emission nozzle as a quantity determined medium by applying predetermined voltage to a piezoelectric element, for example a diluent solvent is emitted from the emission nozzle as an emitted medium and ink and a diluent solvent is mixed and emitted, a mixed droplet is fixed on a recording medium and printing is made. Of these two solution mixed type printers, a printer using a diluent solvent for an emitted medium and using ink for a quantity determined medium is called a "carrier jet" printer.

In the above ink jet printer and the above "carrier jet" printer, liquid such as ink and a diluent solvent is required to be filled without foam in the corresponding pressure chamber and therefore, in a process in which a diaphragm is bonded to a pressure chamber forming part, high precision adhesion technique is requested.

For example, describing an ink jet printer shown in FIG. 78 as an example, for a method of bonding a diaphragm 1102 to a pressure chamber forming part 1101, a method of forming the diaphragm 1102 using material provided with photosensitivity and adhesive property such as dry film resist and bonding the above diaphragm 1102 on the side of one main surface 1101*a* of the pressure chamber forming part 1101 by heating and pressing the diaphragm after a first groove part 1105 forming a liquid supply passage 1109 and a third groove part 1107 forming a liquid passage 1111 are formed in the pressure chamber forming part 1101 can be given and is heretofore often used.

However, when this method is adopted and the diaphragm 1102 is bonded to the pressure chamber forming part 1101, there are problems that a high-priced exposer is required and further, thermosetting processing is required so as to provide durability to ink, a diluent solvent and others to dry film resist forming the diaphragm 1102.

For a method of bonding the diaphragm 1102 to the pressure chamber forming part 1101, a method of forming the pressure chamber forming part 1101 and the diaphragm 1102 by glass material and executing anodic bonding of the diaphragm 1102 to the pressure chamber forming part 1101 can be also given. However, as glass material is weak in an impulse and a flaw, it is difficult in this method to thin the thickness of the diaphragm 1102 so that it is 10 $\mu$m or less.

If pressure required to emit ink from an emission nozzle 1112 is generated in a pressure chamber 1110, a load according to the thickness of the diaphragm 1102 is generated in a piezoelectric element 1103. Therefore, the diaphragm 1102 is required to be thinned so as to reduce voltage for driving the piezoelectric element 1103, however, as it is difficult in the above method to thin the diaphragm 1102 in a printer wherein the diaphragm 1102 is bonded to the pressure chamber forming part 1101, driving voltage cannot be reduced. In such a printer, the width of the pressure chamber 1110 is required to be widened so as to decrease the load of the piezoelectric element 1103, it is difficult to miniaturize the pressure chamber 1110, that is, to decrease pitch between emission nozzles 1112 and it is also difficult to miniaturize such a printer.

Further, for a method of bonding the diaphragm 1102 to the pressure chamber forming part 1101, a method of bonding the pressure chamber forming part 1101 and the diaphragm 1102 using an adhesive can be also given and is heretofore used. However, as it is difficult in this method to apply an adhesive so that it is 2 $\mu$m or less, there are problems that the first and third groove parts 1105 and 1107 may be blocked by an adhesive if the depth of the first groove part 1105 forming the liquid supply passage 1109 and the third groove part 1107 forming the liquid passage 1111 respectively formed in the pressure chamber forming part 1101 is shallow and the passage characteristics of the liquid supply passage 1109 and the liquid passage 1111 are changed.

For a method of solving such problems, a method of using a silicon substrate and others for the material of the pressure chamber forming part 1101 and enhancing the aspect ratio (the ratio of depth to width) of the first groove part 1105 forming the liquid supply passage 1109 and the third groove part 1107 forming the liquid passage 1111 by etching the pressure chamber forming part 1101 by anisotropic etching can be given.

However, as in this method, the material of the other members is required to be selected according to the thermal expansion coefficient of silicon if silicon is used for the material of the pressure chamber forming part 1101, there is a problem that the allowable range of selecting material is extremely limited.

For a method of bonding the diaphragm 1102 to the pressure chamber forming part 1101, as disclosed in Japanese published unexamined patent application No. H5-183625, a method of using a thermoplastic bonding sheet for an adhesive for bonding the diaphragm 1102 to the pressure chamber forming part 1101 can be also given. However, in this method, a through hole for correcting the overflow of an adhesive is required to be formed through the bonding sheet before a bonding process so as to prevent the overflow of the adhesive from blocking an ink supply port and high precision is required for the alignment and dimensional precision. Further, there are problems that the strength of one bonding sheet is not high and high precision temperature control is required to maintain the precision.

That is, the target of a two solution mixed type printer such as such an ink jet printer and such a "carrier jet" printer is the facilitation of operation for bonding a diaphragm to a pressure chamber forming part in which a pressure chamber is formed without blocking a liquid supply passage formed on the side of one main surface of the pressure chamber forming part.

Furthermore, in these printers, as a diaphragm is displaced every emission of liquid, a mechanical load is applied to a part in which the diaphragm is bonded every emission of liquid, peeling and others may be caused in the part in which the diaphragm is bonded and greatly deteriorates a function as a printer.

To solve such problems, the inventors have proposed a printer wherein a diaphragm is formed by thermoplastic material and thermocompression bonding is applied between the diaphragm and a pressure chamber forming part to enhance an adhesive property between them. However, when the above printer is manufactured, a process in which the diaphragm is bonded to the pressure chamber forming part to which an orifice plate after an emission nozzle and a quantity determining nozzle are formed is bonded is executed, and temperature and pressure for enabling the thermocompression bonding of thermoplastic material are also applied to the orifice plate in which the nozzles are already formed.

In such a printer, it is desirable that a liquid repelling film is formed in the periphery of the opening of a nozzle in an orifice plate to stabilize the emitted direction of a droplet. As the liquid repelling film may block a nozzle when the liquid repelling film is formed after a nozzle is formed, it is desirable that the liquid repelling film is formed before a nozzle is formed. That is, in such a printer, temperature and pressure for enabling the thermocompression bonding of thermoplastic material are also applied to the liquid repelling film.

Therefore, if a diaphragm formed by thermoplastic material is bonded to a pressure chamber forming part by thermocompression bonding after a liquid repelling film is formed, heat resistance is requested for the liquid repelling film to prevent the shape of the periphery of the opening of a nozzle from being changed, resistance to peeling is requested to prevent the liquid repelling film from adhering to a jig and severer performance is required, compared with an actual service condition.

A method of executing liquid repelling processing in the periphery of the opening of a nozzle on the surface on which nozzles are open of an orifice plate after a diaphragm formed by thermoplastic material is bonded to a pressure chamber forming part to which the orifice plate in which nozzles are formed is bonded can be also considered, however, as the opening of a nozzle may be blocked, the realization is difficult.

The present invention makes it the object to secure the bonding strength of a diaphragm, to enable using a liquid repelling film provided with liquid repelling performance according to an actual service condition and also to enable widening a range in which the liquid repelling film is selected in a two solution mixed type printer such as the above ink jet printer and the above "carrier jet" printer.

SUMMARY OF THE INVENTION

As a result of examination by the inventors to solve the above problems, the inventors found that if a diaphragm provided with a thermoplastic layer covering a pressure chamber and also provided with an adhesive property and a pattern layer at least laminated on the above thermoplastic layer in a position except a part opposite to the pressure chamber and a part opposite to a liquid supply passage was used, the diaphragm was set on the principal surface on which the liquid supply passage was formed of a pressure chamber forming part, pressure was applied to only the pattern layer of the diaphragm when the diaphragm was pressed, heated and bonded on the pressure chamber forming part, no unnecessary pressure was applied to the part opposite to the liquid supply passage in which a pattern layer was not formed and operation for bonding the diaphragm to the pressure chamber forming part in which the pressure chamber was formed can be facilitated.

That is, a printer equivalent to a first invention of the present invention is characterized in that in a printer comprising a pressure chamber forming part provided with a pressure chamber and a liquid supply passage for supplying liquid to the pressure chamber, an emission nozzle communicating with the pressure chamber, a diaphragm for covering the pressure chamber and a piezoelectric element arranged corresponding to the pressure chamber via the diaphragm, the above diaphragm is provided with a thermoplastic layer covering the pressure chamber and provided with an adhesive property and a pattern layer at least laminated on the thermoplastic layer in a position except a part opposite to the pressure chamber and a part opposite to the liquid supply passage.

A printer equivalent to a second invention of the present invention is characterized in that in a printer comprising a pressure chamber forming part provided with a first pressure chamber to which an emitted medium is led, a first liquid supply passage for supplying liquid to the first pressure chamber, a second pressure chamber to which a quantity determined medium is led and a second liquid supply passage for supplying liquid to the second pressure chamber, an emission nozzle communicating with the first pressure chamber, a quantity determining nozzle communicating with the second pressure chamber, a diaphragm covering the first and second pressure chambers and a piezoelectric element arranged respectively corresponding to the first and second pressure chambers via the diaphragm wherein after a quantity determined medium is percolated from the quantity determining nozzle toward the emission nozzle, an emitted medium is emitted from the emission nozzle, and a quantity determined medium and an emission medium are mixed and emitted, the above diaphragm is provided with a thermoplastic layer covering the first and second pressure chambers and provided with an adhesive property and a pattern layer at least laminated on the thermoplastic layer in a position except a part opposite to the first and second pressure chambers and a part opposite to the first and second liquid supply passages.

In the printers equivalent to these first and second inventions, it is desirable that a pattern layer is formed by a metal. In the printers equivalent to these first and second inventions, it is desirable that the pattern layer is 15 $\mu$m or more thick. When the pattern layer is thinner than 15 $\mu$m, it may be probably embedded inside a diaphragm in case the diaphragm is heated and pressed and it is not desirable. In the meantime, when the pattern layer is too thick, the pattern layer cannot be precisely formed and it is not desirable. Further, in the printers equivalent to these first and second inventions, it is desirable that a thermoplastic layer is formed by a polyimide material. Furthermore, in the printers equivalent to these first and second inventions, it is desirable that the thermoplastic layer is formed by material the glass transition point of which is 180 to 250° C. and in this case, a thin film may be also provided between the thermoplastic layer and the pattern layer.

Further, as a result of examination by the inventors to solve the above problems, the inventors found that if a diaphragm and a pressure chamber forming part were bonded by a thermoplastic resin to secure bonding strength and the other part was bonded by thermosetting resin, the bonding strength of the diaphragm was secured, a liquid repelling film provided with heat resistance and resistance to peeling was not necessarily required to be used and a range in which the liquid repelling film was selected could be widened.

That is, a printer equivalent to a third invention of the present invention is characterized in that in a printer comprising a pressure chamber forming part provided with a pressure chamber and a liquid supply passage for supplying liquid to the pressure chamber, an emission nozzle communicating with the pressure chamber, a diaphragm covering the pressure chamber and a piezoelectric element arranged corresponding to the pressure chamber via the diaphragm, an adhesive layer consisting of thermoplastic resin and an adhesive layer consisting of thermosetting resin are provided and the adhesive layer consisting of thermoplastic resin is formed between the pressure chamber forming part and the diaphragm.

Further, a printer equivalent to a fourth invention of the present invention is characterized in that in a printer comprising a pressure chamber forming part provided with a first pressure chamber to which an emitted medium is led, a first liquid supply passage for supplying liquid to the first pressure chamber, a second pressure chamber to which a quantity determined medium is led and a second liquid supply passage for supplying liquid to the second pressure chamber, an emission nozzle communicating with the first pressure chamber, a quantity determining nozzle communicating with the second pressure chamber, a diaphragm covering the first and second pressure chambers and a piezoelectric element arranged respectively corresponding to the first and second pressure chambers via the diaphragm wherein after a quantity determined medium is percolated from the quantity determining nozzle toward the emission nozzle, an emitted medium is emitted from the emission nozzle, and a quantity determined medium and an emitted medium are mixed and emitted, an adhesive layer consisting of thermoplastic resin and an adhesive layer consisting of thermosetting resin are provided and the adhesive layer consisting of thermoplastic resin is formed between the pressure chamber forming part and the diaphragm.

In the printers equivalent to these third and fourth inventions, it is desirable that the emission nozzle or the emission nozzle and the quantity determining nozzle are formed by a nozzle forming member and an adhesive layer consisting of thermosetting resin is formed between the pressure chamber forming part and the nozzle forming member.

Also, in the printers equivalent to the third and fourth inventions, it is desirable that the pressure chamber forming part is formed by two or more members and an adhesive layer consisting of thermosetting resin is formed between these members.

Further, in the printers equivalent to these third and fourth inventions, it is desirable that a liquid repelling film is formed at least around the opening of the emission nozzle or the emission nozzle and the quantity determining nozzle.

Furthermore, in the printers equivalent to these third and fourth inventions, it is desirable that the glass transition point of thermoplastic resin is 180 to 250° C.

Further, in the printers equivalent to these third and fourth inventions, it is desirable that thermoplastic resin is polyimide resin.

In the printers equivalent to these third and fourth inventions, it is desirable that a pattern layer is at least laminated on an adhesive layer consisting of thermoplastic resin in a position except a part opposite to the pressure chamber and a part opposite to the liquid supply passage, or a pattern layer is at least laminated on an adhesive layer consisting of thermoplastic resin in a position except parts opposite to the first and second pressure chambers and parts opposite to the first and second liquid supply passages.

For a method of manufacturing the printers equivalent to these third and fourth inventions, the following methods can be given:

That is, a method of manufacturing the printer equivalent to the third invention is characterized in that in a method of manufacturing a printer providing a pressure chamber forming part provided with a pressure chamber and a liquid supply passage for supplying liquid to the pressure chamber, forming an emission nozzle so that it communicates with the pressure chamber, arranging a diaphragm so that it covers the pressure chamber and arranging a piezoelectric element so that it corresponds to the pressure chamber via the diaphragm, the pressure chamber forming part and the diaphragm are bonded by thermoplastic resin.

Further, a method of manufacturing the printer equivalent to the fourth invention is characterized in that in a method of manufacturing a printer providing a pressure chamber forming part provided with a first pressure to which an emitted medium is led, a first liquid supply passage for supplying liquid to the first pressure chamber, a second pressure chamber to which a quantity determined medium is led and a second liquid supply passage for supplying liquid to the second pressure chamber, forming an emission nozzle so that it communicates with the first pressure chamber, forming a quantity determining nozzle so that it communicates with the second pressure chamber, arranging a diaphragm so that it covers the first and second pressure chambers and arranging a piezoelectric element so that it respectively corresponds to the first and second pressure chambers via the diaphragm, the pressure chamber forming part and the diaphragm are bonded by thermoplastic resin.

In these manufacturing methods, it is desirable that the emission nozzle or the emission nozzle and the quantity determining nozzle are formed by a nozzle forming member, and the pressure chamber forming part and the nozzle forming member are bonded by thermosetting resin.

Further, in these manufacturing methods, it is desirable that the pressure chamber forming part is constituted by two or more members and these members are bonded by thermosetting resin, and in this case, the emission nozzle or the emission nozzle and the quantity determining nozzle may be also formed by as nozzle forming member and the nozzle forming member may be also bonded to one of members constituting the pressure chamber forming part beforehand.

Furthermore, in these manufacturing methods, it is desirable that liquid repelling processing is applied to at least the periphery of the opening of the emission nozzle or the emission nozzle and the quantity determining nozzle.

In the printer equivalent to the above first invention, for a diaphragm, the diaphragm covering the pressure chamber and provided with a thermoplastic layer also provided with an adhesive property and a pattern layer at least laminated on the thermoplastic layer in a position except the part opposite to the pressure chamber and the part opposite to the liquid supply passage is used, in the printer equivalent to the second invention, for a diaphragm, the diaphragm covering the first and second pressure chambers and provided with the thermoplastic layer also provided with an adhesive property and the pattern layer at least laminated on the thermoplastic layer in a position except the parts opposite to the first and second pressure chambers and the parts opposite to the first and second liquid supply passages is used, and in both printers, when the diaphragm is set on the main surface on which the liquid supply passage is formed of the pressure chamber forming part, the thermoplastic layer of the diaphragm is pressed, heated and bonded on the pressure chamber forming part, pressure is applied to only the pattern layer of the diaphragm, no unnecessary pressure is applied to a part opposite to the liquid supply passage in which the pattern layer is not formed, the liquid supply passage is not blocked by the thermoplastic layer and operation for bonding the diaphragm to the pressure chamber forming part in which the pressure chamber is formed is readily executed.

Further, in the printers equivalent to the above third and fourth inventions, an adhesive layer consisting of thermoplastic resin and an adhesive layer consisting of thermosetting resin are provided, the adhesive layer consisting of thermoplastic resin is formed between the pressure chamber forming part and the diaphragm and the bonding strength of the diaphragm to the pressure chamber forming part is sufficiently secured.

Also, in the printers equivalent to the above third and fourth inventions, if the emission nozzle or the emission nozzle and the quantity determining nozzle are formed by a nozzle forming member and an adhesive layer consisting of thermosetting resin is formed between the pressure chamber forming part and the nozzle forming member, the pressure chamber forming part and the nozzle forming member are bonded under ordinary temperature after the diaphragm and the pressure chamber forming part are bonded when the nozzle is manufactured, at this time the adhesive layer consisting of thermoplastic resin is not influenced and even if a liquid repelling film is formed in the nozzle forming member, no heat is applied to this.

Further, in the printers equivalent to the above third and fourth inventions, if the pressure chamber forming part is constituted by two or more members and an adhesive layer consisting of thermosetting resin is formed between these members, the diaphragm is bonded to one member of the pressure chamber forming part by thermoplastic resin, a nozzle forming member is bonded to the other member and each member constituting the pressure chamber forming part has only to be bonded by thermosetting resin when the pressure chamber forming part is manufactured, at this time an adhesive layer consisting of thermoplastic resin is not influenced and even if a liquid repelling film is formed in the nozzle forming member, no heat is applied to this.

DETAILED DESCRIPTION OF THE PRESENTLY PREFERRED EMBODIMENT

Figure 1:
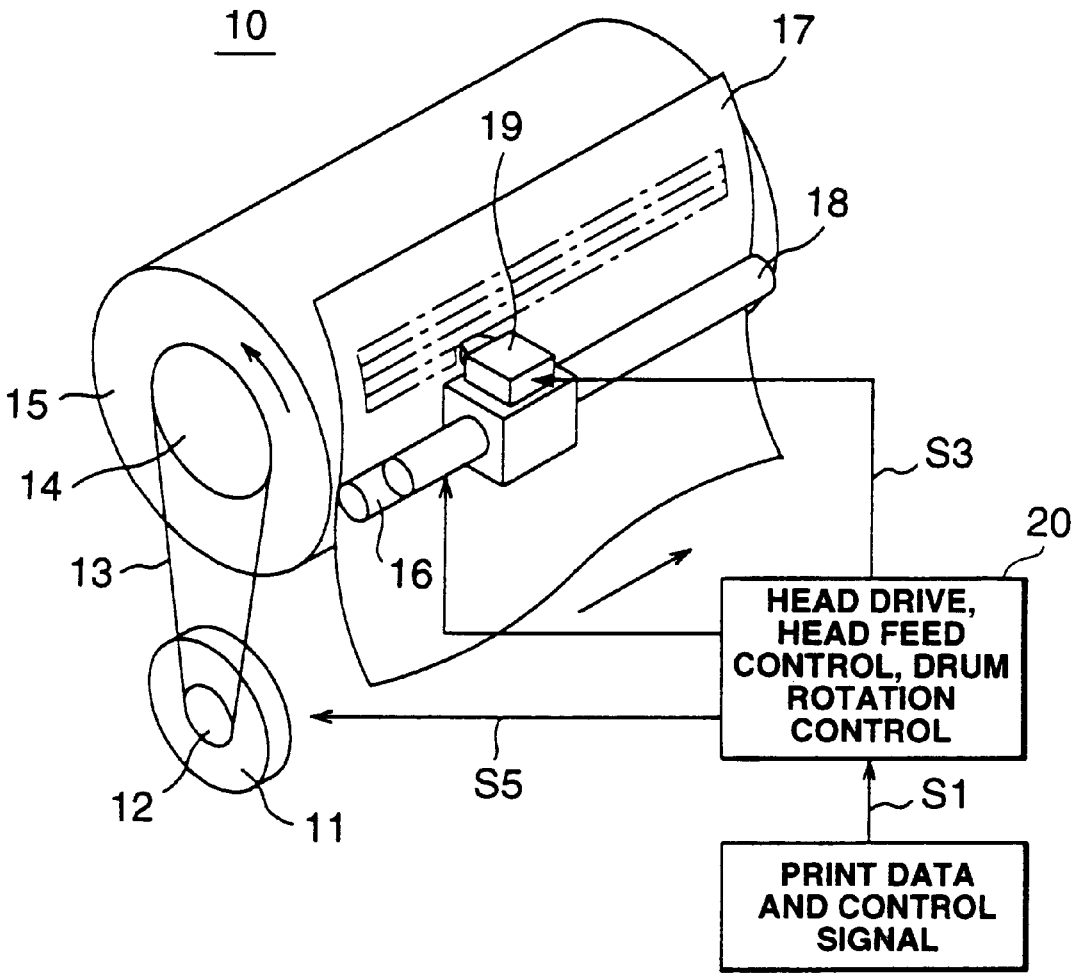
FIG. 1 is a schematic perspective view of the main part showing an example of a printer.

Referring to the drawings, embodiments of the present invention will be described in detail below.

1. Embodiments Corresponding to the First and Second Inventions

(1) First Embodiment

In this embodiment, an example in which the present invention is applied to an ink jet printer emitting only ink, that is, an example corresponding to the first invention will be described.

(1-1) Constitution of an Ink Jet Printer

First, the overall constitution of an ink jet printer will be described. A serial ink jet printer 10 to which the present invention is applied is constituted as shown in FIG. 1. That is, the printer is constituted so that a drum 15 can be rotated according to rotational output given to the drum 15 from a motor 11 via a pulley 12, a belt 13 and a pulley 14 in order.

In the periphery of the drum 15, a bail 16 is arranged in parallel with the axial direction of the drum 15 to press printing paper 17 as a printed matter set round the drum 15 on the drum 15 by the bail 16.

Also, in the periphery of the drum 15, a feed screw 18 is arranged in parallel with the axial direction of the drum 15, a print head 19 which is an ink jet print head is fitted to the feed screw 18 and the print head 19 can be moved in the axial direction of the drum 15 by rotating the feed screw 18.

In the case of the ink jet printer 10, the driving of the motor 11, a motor not shown for driving the feed screw 18 and the print head 19 is controlled by a controlling section 20 according to an input signal S1 consisting of print data and a control signal supplied to a head drive, a head feed control and a drum rotation control 20 (hereinafter called a controlling section 20).

Figure 2:
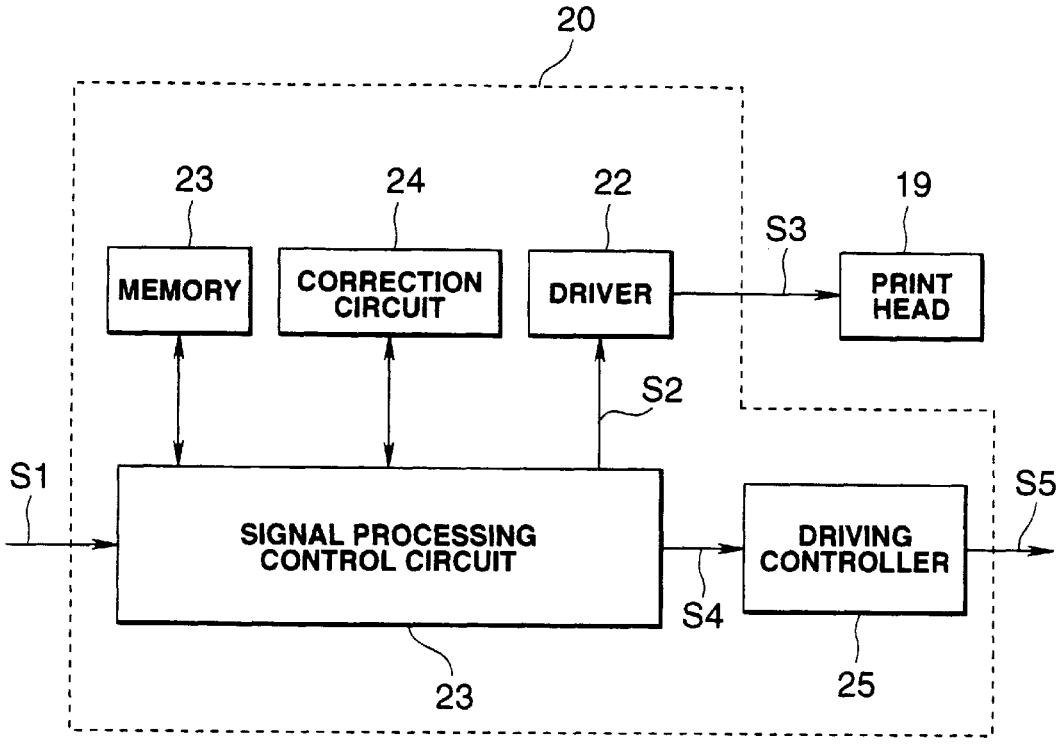
FIG. 2 is a block diagram showing the constitution of a controlling section in the example of the printer.

Actually, the controlling section 20 is provided with a signal processing control circuit 21 constituted by a microcomputer including a central processing unit (CPU) or a digital signal processor (DSP) as shown in FIG. 2, the signal processing control circuit 21 generates a pulse waveform driving signal S2 based upon a supplied input signal S1, the print head 19 is driven according to a driving signal S3 by sending the generated driving signal to the print head 19 via a driver 22 as a driving signal S3 and as a result, a character, a graphic form and others based upon the input signal S1 are recorded on printing paper 17.

At this time, the signal processing control circuit 21 records print data obtained based upon the input signal S1 in line buffer memory or memory 23 constituted by frame memory if necessary, afterward rearranges print data in the order of print by reading the print data, reads correction data stored in a correction circuit 24 in a ROM (read only memory) mapped format if necessary, corrects the gamma (γ) of print data based upon the correction data and corrects a color in the case of color printing.

Also, the signal processing control circuit 21 generates a control signal S4 based upon an input signal S1, controls the driving of the motor 11 and the motor for driving the feed screw 18 by sending the generated control signal to the corresponding motor 11 or the motor for driving the feed screw 18 as a driving control signal S5 via a driving controller 25 and controls the rotational operation of the drum 15 and the feed screw 18.

In the ink jet printer 10, in a state in which the print head 19 is located in a home position when the printer is operated, the print head 19 is moved at fixed speed in the axial direction of the drum 15 by driving the motor for driving the feed screw 18 according to a driving control signal S5 supplied from the controlling section 20 and rotating the feed screw 18 at a predetermined angular velocity, and when the print head 19 is driven according to a driving control signal S3 supplied from the controlling section 20 at this time, a character, a graphic form and others based upon an input signal S1 are printed by one line on printing paper 17.

Next, when printing for the line is finished, the printing paper 17 is fed by one line because the motor 11 is driven according to a driving control signal S5 supplied from the controlling section 20 and the drum 15 is rotated by a predetermined angle, the print head 19 is returned to the home position because at this time, the motor for driving the feed screw 18 is driven according to a driving control signal S5 supplied from the controlling section 20 and the feed screw 18 is rotated, and afterward, the same operation is repeated.

As described above, the ink jet printer 10 is constituted so that printing for one line based upon an input signal S1 supplied to the controlling section 20 on printing paper 17 is sequentially executed and as a result, a character, a graphic form and others based upon an input signal S1 can be printed on printing paper 17.

(1-2) Constitution of an Ink Jet Print Head

Figure 3:
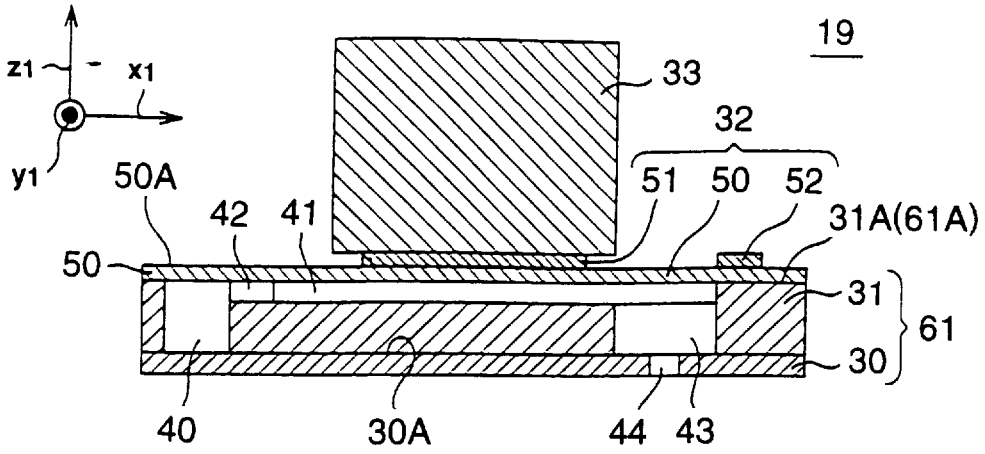
FIG. 3 is a schematic sectional view of the main part showing an example of a print head.
Figure 4:
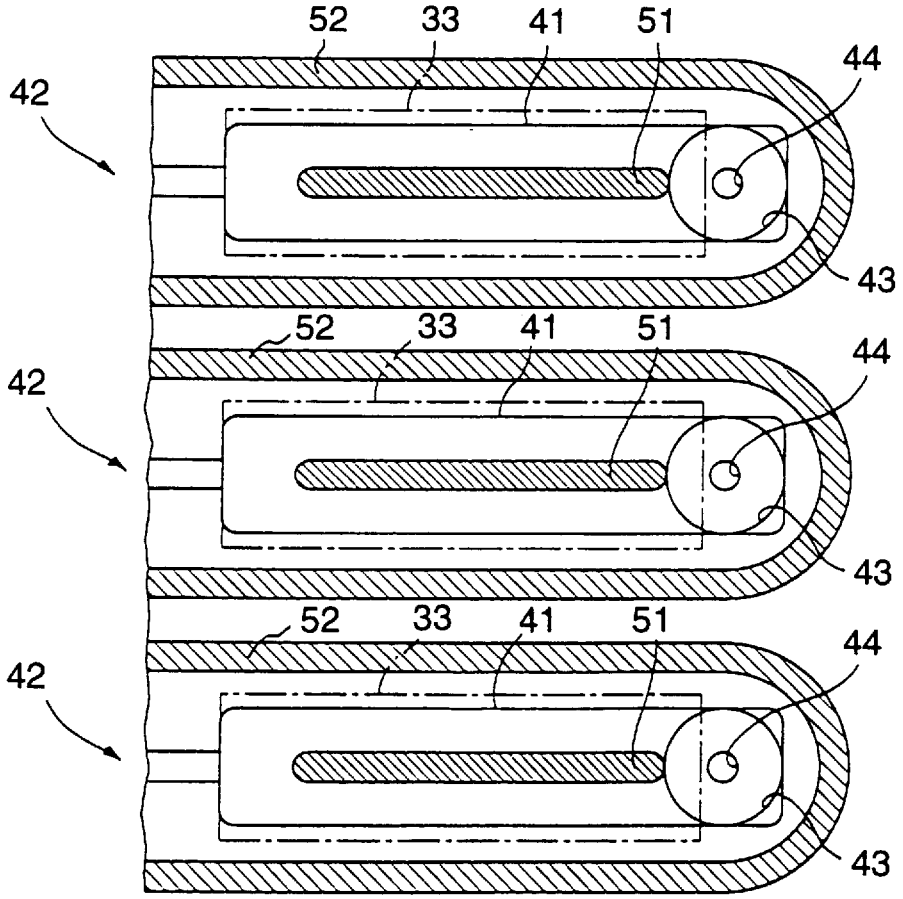
FIG. 4 is a schematic plan of the main part showing the example of the print head.

FIGS. 3 and 4 show the constitution of an ink jet print head 19.

In the above print head 19, as shown in FIGS. 3 and 4, a pressure chamber forming part 31 and a diaphragm 32 are laminated in order on one main surface 30A of an orifice plate 30 which is a nozzle forming member and plural piezoelectric elements 33 are formed on the diaphragm 32 by being bonded.

In the print head 19 in this embodiment, the pressure chamber forming part 31 is formed using stainless steel for example and an ink buffer tank 40 which is an opening formed in Y direction (in a direction shown by an arrow $y_1$ in FIG. 3), plural concave pressure chambers 41 sequentially formed at predetermined first pitch along the ink buffer tank 40 (in Y direction) and plural groove-shaped liquid supply passages 42 individually connecting each pressure chamber 41 to the ink buffer tank 40 are provided on one main surface 31A. A nozzle leading hole 43 which is a through hole is provided at the end of each pressure chamber 41.

Further, the ink buffer tank 40 is connected to an ink tank not shown via an ink supply pipe not shown and ink supplied from the ink tank to the ink buffer tank 40 via the ink supply pipe is led into each pressure chamber 41 via the corresponding liquid supply passage 42.

In the meantime, the orifice plate 30 is formed using an organic film in this embodiment and plural emission nozzles 44 are made at the same first pitch as each pressure chamber 41 in Y direction in the orifice plate 30 so that each emission nozzle corresponds to each nozzle leading hole 43 and communicates with each nozzle leading hole 43. Hereby, in the print head 19, ink supplied to each pressure chamber 41 can be emitted outside from the corresponding emission nozzle 44 via the corresponding nozzle leading hole 43.

In the diaphragm 32, plural protruding portions 51 are laminated on one main surface 50A of a thermoplastic layer 50 formed by thermoplastic material and provided with an adhesive property and the above thermoplastic layer 50 is bonded onto one main surface 31A so that the thermoplastic layer 50 covers one main surface 31A of the pressure chamber forming part 31.

The above each protruding portion 51 is formed on the thermoplastic layer 50 so that each protruding portion corresponds to each pressure chamber 41, each protruding portion is opposite to the center of the corresponding pressure chamber 41 in the direction of the width (in Y direction) via the thermoplastic layer 50 and the length of each protruding portion is shorter than that of each pressure chamber 41 as clear in FIG. 4. Hereby, in the print head 19, even if the piezoelectric element 33 is wider than the pressure chamber 41 and/or the piezoelectric element 33 is longer than the pressure chamber 41, pressure applied by each piezoelectric element 33 can be effectively transmitted to the thermoplastic layer 50.

Further, the piezoelectric element 33 is formed by alternately laminating piezoelectric material and conductive material and fixed on the thermoplastic layer 50 via the corresponding protruding portion 51 of the diaphragm 32 so that the piezoelectric element corresponds to each pressure chamber 41 and is opposite to the corresponding pressure chamber 41 via the diaphragm 32.

In this case, in each piezoelectric element 33, a first electrode not shown which receives a driving signal from a controlling section is formed on the upper surface which is on the upper side in FIG. 3, a grounded second electrode not shown is formed on the lower surface which is on the lower side in FIG. 3, and each piezoelectric element is constituted so that when driving voltage is applied to the first electrode according to a driving signal S3 from the controlling section 20 shown in FIGS. 1 and 2, each piezoelectric element is deformed in Y direction (in a direction shown by an arrow $z_1$ in FIG. 3) which is a direction in which the diaphragm 32 is pulled up from the corresponding pressure chamber 41.

In the print head 19, when driving voltage S3 is applied to the first electrode of the corresponding piezoelectric element 33 according to a driving signal S3 supplied from the controlling section 20 shown in FIGS. 1 and 2 while a printer is operated, the corresponding piezoelectric element 33 is deformed in the direction in which the diaphragm 32 is pulled up, that is, in Z direction (in the direction shown by the arrow $z_1$ in FIG. 3), the diaphragm 32 is displaced, the volume of the corresponding pressure chamber 41 is increased, and in the meantime, when driving voltage falls afterward, the piezoelectric element 33 is restored from a deformed state, when the diaphragm 32 is restored to an original position, pressure in the corresponding pressure chamber 41 is increased, and ink in the corresponding pressure chamber 41 can be emitted outside via the corresponding nozzle leading hole 43 and the corresponding emission nozzle 44 by the pressure.

In addition to the above constitution, in the case of the print head 19, a pattern layer 52 consisting of a U-shaped protruding portion is laminated on one main surface of the thermoplastic layer 50 of the diaphragm 32, corresponding to each pressure chamber 41 so that each pattern layer surrounds each pressure chamber 41 and each liquid supply passage 42 as shown in FIG. 4.

That is, in the print head 19 of the ink jet printer 10 in this embodiment, for a diaphragm, the diaphragm 32 provided with the thermoplastic layer 50 covering the pressure chamber 41 and also provided with an adhesive property and the pattern layer 52 at least laminated on the thermoplastic layer 50 in a position except a part opposite to the pressure chamber 41 and a part opposite to the liquid supply passage 42 is used.

Hereby, in the print head 19, when the diaphragm 32 is bonded onto one main surface 31A of the pressure chamber forming part 31 by pressing and heating the diaphragm 32 (the thermoplastic layer 50) after the diaphragm 32 is positioned and set on one main surface 31A of the pressure chamber forming part 31, pressure is applied only to the pattern layer 52 of the diaphragm 32, no unnecessary pressure is applied to the part in which no pattern layer 52 is formed opposite to the liquid supply passage 42, the liquid supply passage 42 is not blocked by the thermoplastic layer 50 and operation for bonding the diaphragm 32 onto the pressure chamber forming part 31 in which the pressure chamber 41 is formed is facilitated.

In this embodiment, each pattern layer 52 of the diaphragm 32 is formed so that each pattern layer is 15 $\mu$m or more thick. Hereby, in the print head 19, even if the thermoplastic layer 50 of the diaphragm 32 is deformed when the diaphragm 32 is pressed, heated and bonded on one main surface 31A of the pressure chamber forming part 31, unnecessary pressure can be more securely prevented from being applied to the part opposite to each pressure chamber 41 and each liquid supply passage 42 of the thermoplastic layer 50 and the occurrence of failure in a process can be reduced.

(1-3) Method of Manufacturing the Ink Jet Print Head

Figure 5A:
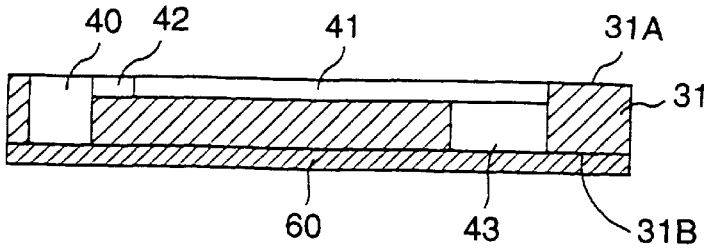
FIG. 5 shows an example of a method of manufacturing the print head and is a sectional view showing a process for forming a pressure chamber forming part.
Figure 5B:
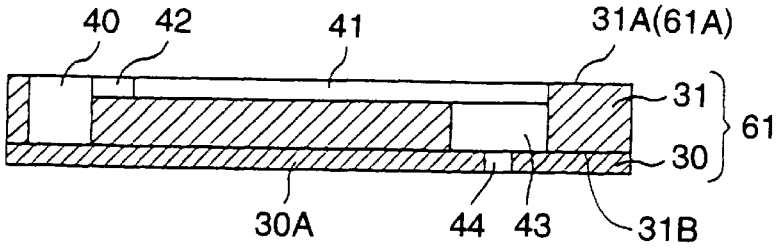
Figure 6A:
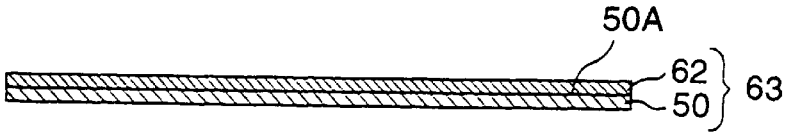
FIG. 6 shows the example of the method of manufacturing the print head and is a sectional view showing a process for forming a diaphragm.
Figure 6B:
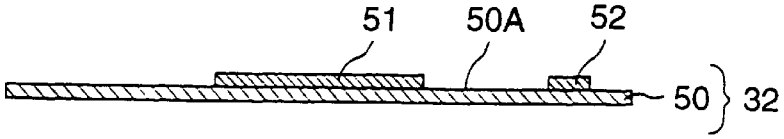
Figure 7A:
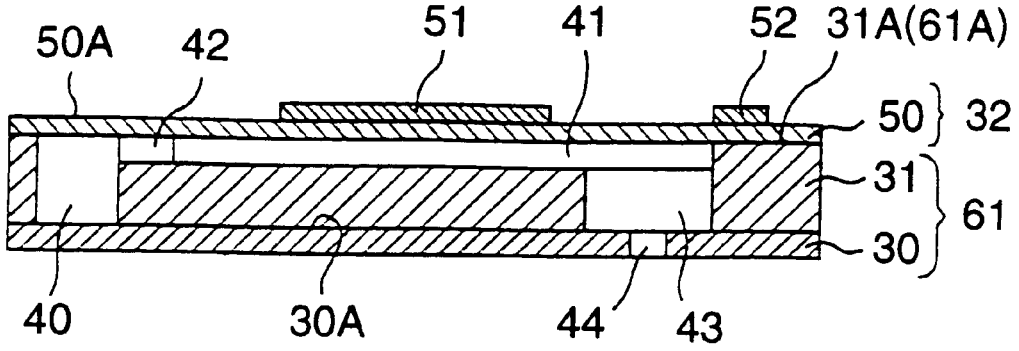
FIG. 7 shows the example of the method of manufacturing the print head and is a sectional view showing a process for completing the print head.
Figure 7B:
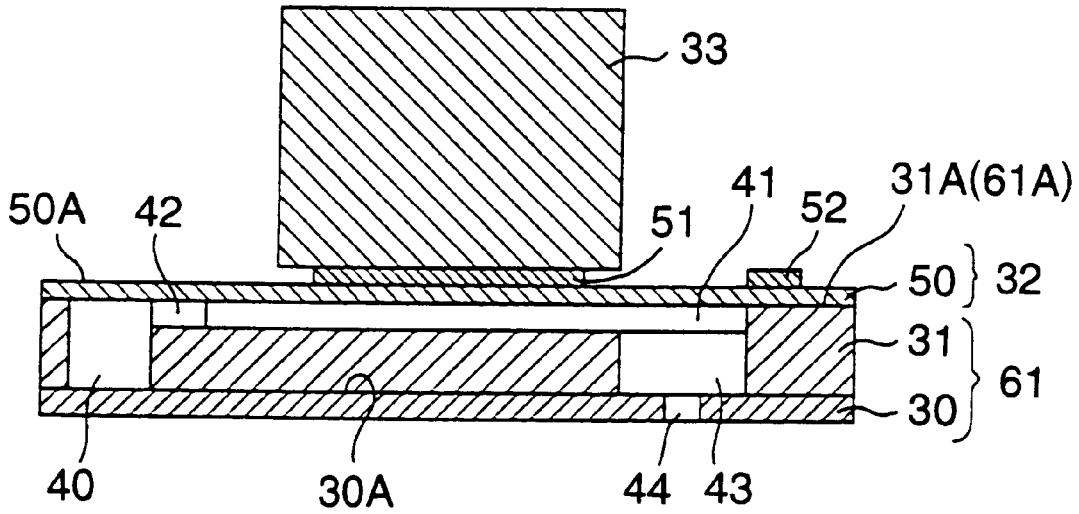

Referring to FIGS. 5 to 7, a method of manufacturing the print head 19 will be described below.

That is, first, as shown in FIG. 5 (A), the ink buffer tank 40, the liquid supply passage 42, the pressure chamber 41 and the nozzle leading hole 43 are formed by etching a stainless steel plate in a predetermined size so as to form the pressure chamber forming part 31.

Next, as shown in FIG. 5 (A), a filmy member 60 which is a base of an orifice plate 30 such as an organic film is fixed on the other surface 31B of the pressure chamber forming part 31 and as shown in FIG. 5 (B), a pressure chamber member 61 formed by bonding the orifice plate 30 on the other surface 31B of the pressure chamber forming part 31 is formed by forming the emission nozzle 44 which is a through hole in a predetermined position of the filmy member 60 by an excimer laser beam.

In the meantime, differently from the pressure chamber member, a laminated plate 63 formed by forming a metallic layer 62 consisting of Cu or Ni and others on one main surface 50A of the thermoplastic layer 50 consisting of thermoplastic material shown in FIG. 6 (A) is prepared, only a protruding portion 51 and the pattern layer 52 are left as shown in FIG. 6 (B) by etching the metallic layer 62 of the laminated plate 63, and the diaphragm 32 wherein the above protruding portion 51 and pattern layer 52 are respectively laminated on one main surface 50A of the thermoplastic layer 50 is formed.

The above laminated plate 63 can be produced by forming the metallic layer 62 by bonding a plate consisting of Cu or Ni and others onto the thermoplastic layer 50 using an adhesive or by laminating the metallic layer 62 on the thermoplastic layer 50 by plating, or by forming the thermoplastic layer 50 by applying thermoplastic material on the metallic layer 62 consisting of a plate of Cu or Ni and others.

For the material of the thermoplastic layer 50 of the laminated plate 63, it is desirable that polyimide which is chemically stable for ink is used and an advantage that the diaphragm 32 can be produced at a low cost can be produced because technique for manufacturing a general flexible printed board can be used as it is by using polyimide. For such material, thermoplastic polyimide film, "Neoflex (trade mark)" manufactured by Mitsui Toatsu Chemicals, Inc. which is excellent in resistance to a chemical and heat resistance can be used.

For the material of the thermoplastic layer 50, material the glass transition point of which is 180 to 250° C. can be also used and hereby, in a later process for pressing, heating and bonding, pressurization temperature can be lowered.

Figure 8:
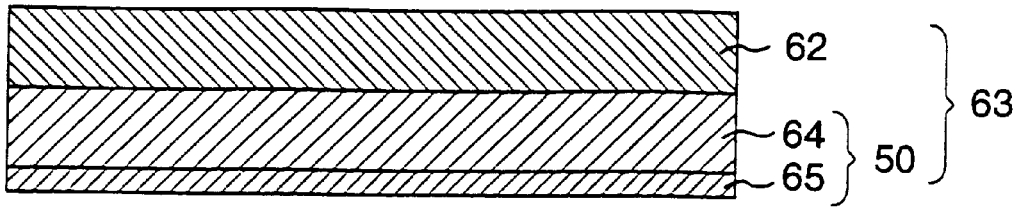
FIG. 8 is a sectional view showing an example of a thermoplastic layer.

Further, the thermoplastic layer 50 of the laminated plate 63 is laminated by an organic film 65 which is a thermoplastic layer consisting of material the glass transition point of which is 180 to 250° C. and a thin film 64 as shown in FIG. 8, the laminated plate 63 may be also formed by fixing the above thermoplastic layer on a plate constituting the metallic layer 62 via the thin film 64 and hereby, the precision of the protruding portion 51 and the pattern layer 52 respectively formed on the thermoplastic layer 50 can be readily enhanced.

In the meantime, for a method of patterning the metallic layer 62 of the laminated plate 63, after sensitive material such as a dry film and liquid resist is laminated or applied on/to the metallic layer 62, the dry film is exposed using a mask corresponding to a pattern and after developing, the metallic layer can be patterned by etching using residual sensitive material as a mask. In the concrete, if the metallic layer 62 is formed by copper, the above protruding portion 51 and pattern layer 52 can be formed using dry film resist for the wiring of a printed board for the material of resist, using the aqueous solution of ferric chloride of approximately 10 to 50% for etchant and further, using the aqueous solution of sodium hydroxide of approximately 2 to 5% for a release agent of resist material.

Next, as shown in FIG. 7 (A), after the diaphragm 32 produced in the process described in relation to FIGS. 6 (A) and (B) is positioned and set on one main surface 61A of the pressure chamber member 61 (on one main surface 31A of the pressure chamber forming part 31) produced in the process described in relation to FIGS. 5 (A) and (B), the diaphragm is bonded on one main surface 31A of the pressure chamber forming part 31 by heating and pressing the thermoplastic layer 50 of the diaphragm 32. In this case, the function of bonding can be enhanced by executing cleaning for degreasing the diaphragm 32 and processing for drying the diaphragm 32 at approximately 90 to 120° C. when the diaphragm 32 is bonded to the pressure chamber forming part 31.

Figure 9:
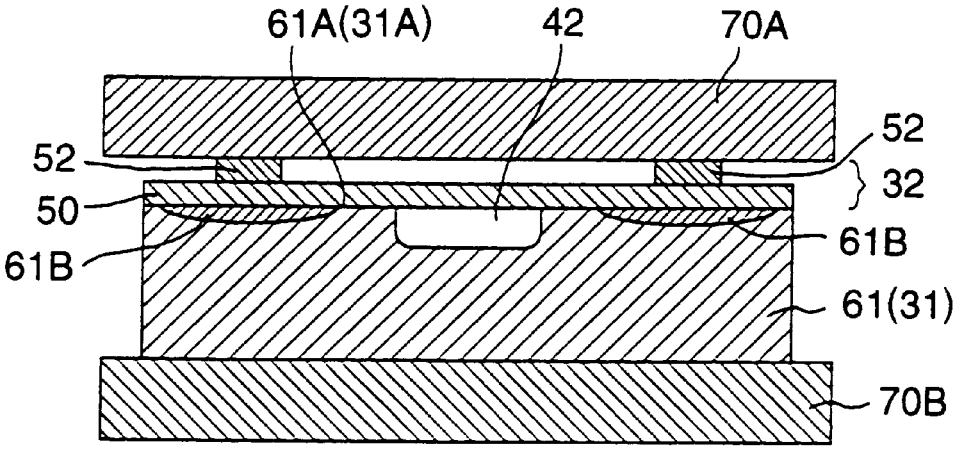
FIG. 9 is an enlarged sectional view of the main part showing a process for bonding a diaphragm to a pressure chamber member.

Actually, operation for bonding the diaphragm 32 to the pressure chamber forming part 61 is executed by putting the diaphragm 32 positioned and set on one main surface 61A of the pressure chamber member 61 (on one main surface 31A of the pressure chamber forming part 31) between heated first and second plates 70A and 70B of a press as shown in FIG. 9. In the concrete, if the thermoplastic layer 50 of the diaphragm 32 is formed using Neoflex described above for example, the temperature of the first and second plates 70A and 70B of the press is set to approximately 230° C. and pressure is adjusted so that the pressure of approximately 20 to 30 $Kg/cm^2$ is applied to the bonded area of the diaphragm 32 and the pressure chamber member 61.

That is, for a diaphragm, as the diaphragm 32 provided with the thermoplastic layer 50 covering the pressure chamber 41 and also provided with an adhesive property and the pattern layer 52 at least laminated on the thermoplastic layer 50 in a position except the part opposite to the pressure chamber 41 and the part opposite to the liquid supply passage 42 is used in the print head of the printer in this embodiment, pressure is applied only to the pattern layer 52 of the diaphragm 32 when the diaphragm 32 is set on one main surface 61A (on one main surface 31A) on which the liquid supply passage 42 of the pressure chamber member 61 (the pressure chamber forming part 31) is formed as described above and the thermoplastic layer 50 of the diaphragm 32 is pressed, heated and bonded on the pressure chamber member 61 (the pressure chamber forming part 31), no unnecessary pressure is applied to the part opposite to the liquid supply passage 42 in which the pattern layer 52 is not formed, the liquid supply passage 42 is not blocked by the thermoplastic layer 50 and operation for bonding the diaphragm 32 to the pressure chamber member 61 (the pressure chamber forming part 31) in which the pressure chamber 41 is formed is facilitated.

Next, as shown in FIG. 7 (B), each piezoelectric element 33 is fixed on each protruding portion 51 of the diaphragm 32 of a head constituting part consisting of the diaphragm 32 and the pressure chamber member 61 respectively formed as described above. Hereby, the print head 19 shown in FIG. 3 can be obtained.

(1-4) Operation and Effect in the First Embodiment

In the above constitution, in the ink jet printer 10 shown in FIG. 1, the controlling section 20 generates a driving signal S3 based upon a supplied input signal S1 as shown in FIG. 2 and when the generated driving signal is sent to the print head 19, driving voltage in a pulse shape is applied to the first electrode of the corresponding piezoelectric element 33 of the print head 19 shown in FIG. 3.

Figure 10A:
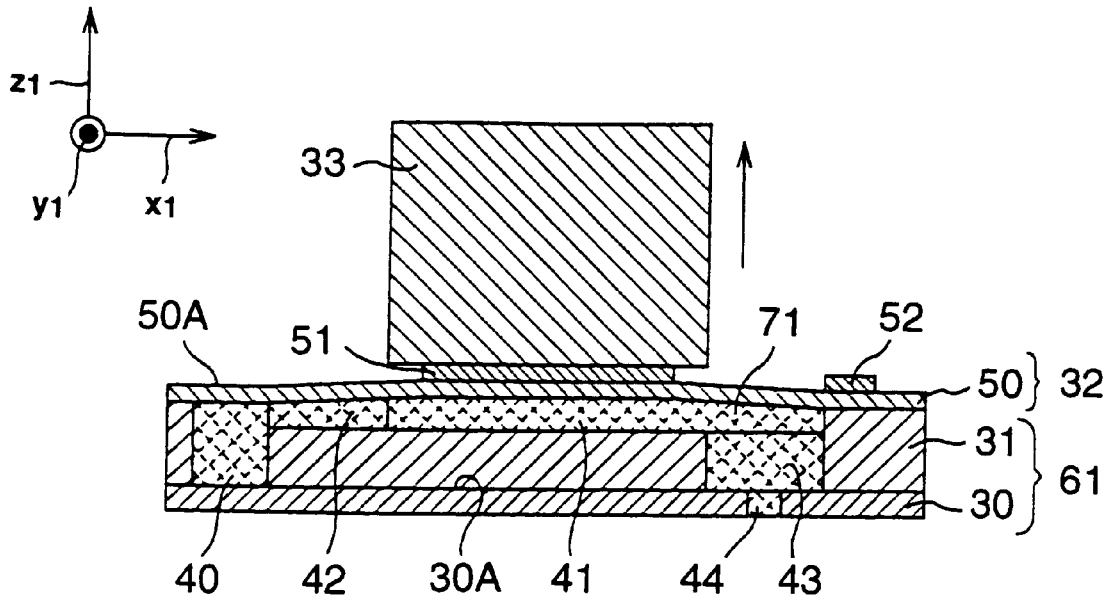
FIG. 10 is a schematic sectional view of the main part showing the operation of an example of a print head.
Figure 10B:
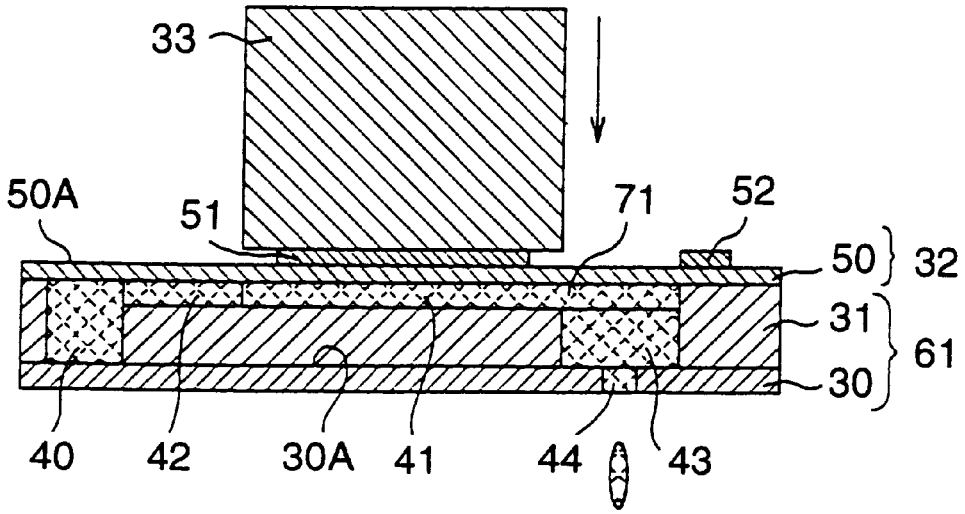

In this case, in the corresponding piezoelectric element 33, when driving voltage in a pulse shape is applied to the first electrode, a positive electric field is generated in a polarized direction based upon the driving voltage and as a result, the corresponding piezoelectric element is displaced in a direction shown by an arrow $A_1$ in FIG. 10 (A), that is, in a direction in which the diaphragm 32 is pulled up in a direction reverse to the pressure chamber 41 (in Z direction), in other words in a direction in which the pressure chamber 41 is swollen. At this time, as a meniscus is formed in a position in which the surface tension of ink 71 is balanced in the vicinity of the end of the emission nozzle 44, the position of the meniscus is stable in a position shown in FIG. 10 (A), that is, in a position at the end of the emission nozzle 44 even after the piezoelectric element 33 pulls up the diaphragm 32.

Further afterward, as driving voltage applied to the first electrode falls in the piezoelectric element 33, the piezoelectric element is displaced in a direction shown by an arrow $A_2$ in FIG. 10 (B), that is, restored from a deformed state and when the diaphragm 32 is restored to an original position, pressure in the corresponding pressure chamber 41 is increased and ink 71 in the pressure chamber 41 is emitted outside via the nozzle leading hole 43 and the emission nozzle 44 in order by the above pressure.

In the print head 19, the diaphragm 32 is formed using the thermoplastic layer 50 consisting of thermoplastic material and provided with an adhesive property as described above and therefore, when the diaphragm 32 is bonded on one main surface 31A of the pressure chamber forming part 31, no adhesive for only bonding of liquid and others and no adhesive provided with photosensitivity and an adhesive property such as a dry film are required.

Therefore, in the print head 19, a bonding process for boning the diaphragm 32 onto one main surface 31A of the pressure chamber forming part 31 can be facilitated and as in this process a high-priced apparatus such as an exposer is not required, the manufacturing cost can be reduced.

Also, in the print head 19, as the U-shaped pattern layer 52 is formed on the thermoplastic layer 50 of the diaphragm 32 at least in a position except the part opposite to the pressure chamber 41 and the part opposite to the liquid supply passage 42, pressure to be applied to the pressure chamber member 61 via the diaphragm 32 can be applied only to an area 61B under each pattern layer 52 as shown in FIG. 9 in a process for bonding the diaphragm 32 onto one main surface 31A of the pressure chamber forming part 31. Therefore, in the print head 19, in a process for bonding the diaphragm 32 to the pressure chamber forming part 31, unnecessary pressure can be prevented from being applied to the part opposite to the liquid supply passage 42 in the pressure chamber forming part 31 of the diaphragm 32 (the thermoplastic layer 50) and each liquid supply passage 42 can be securely prevented from being blocked by the thermoplastic layer 50 of the diaphragm 32 by the quantity.

Also, in the print head 19, as pressure to be applied to the thermoplastic layer 50 of the diaphragm 32 can be applied only to a part in which the pattern layer 52 is formed in the process for bonding the diaphragm 32 onto one main surface 31A of the pressure chamber forming part 31 as described above, the pressure generating force of a press can be reduced.

According to the above constitution, a printer wherein as the diaphragm 32 is formed using the thermoplastic layer 50 and the U-shaped pattern layer 52 is formed on one main surface 50A of the thermoplastic layer 50 at least in a position except the part opposite to the pressure chamber 41 and the part opposite to the liquid supply passage 42, operation for bonding the diaphragm 32 onto one main surface 31A of the pressure chamber forming part 31 can be facilitated, the blockade of the liquid supply passage 42 in the pressure chamber forming part 31 in the bonding process can be remarkably reduced and operation for bonding the diaphragm 32 onto one main surface 31A of the pressure chamber forming part 31 can be facilitated without blocking the liquid supply passage 42 in the pressure chamber forming part 31 can be realized.

(2) Second Embodiment

In this embodiment, an example in which the present invention is applied to a "carrier jet" printer in which fixed quantity of ink is mixed with a diluent solvent and these are emitted, that is, an example corresponding to the second invention will be described.

(2-1) Constitution of a "Carrier Jet" Printer

Figure 11:
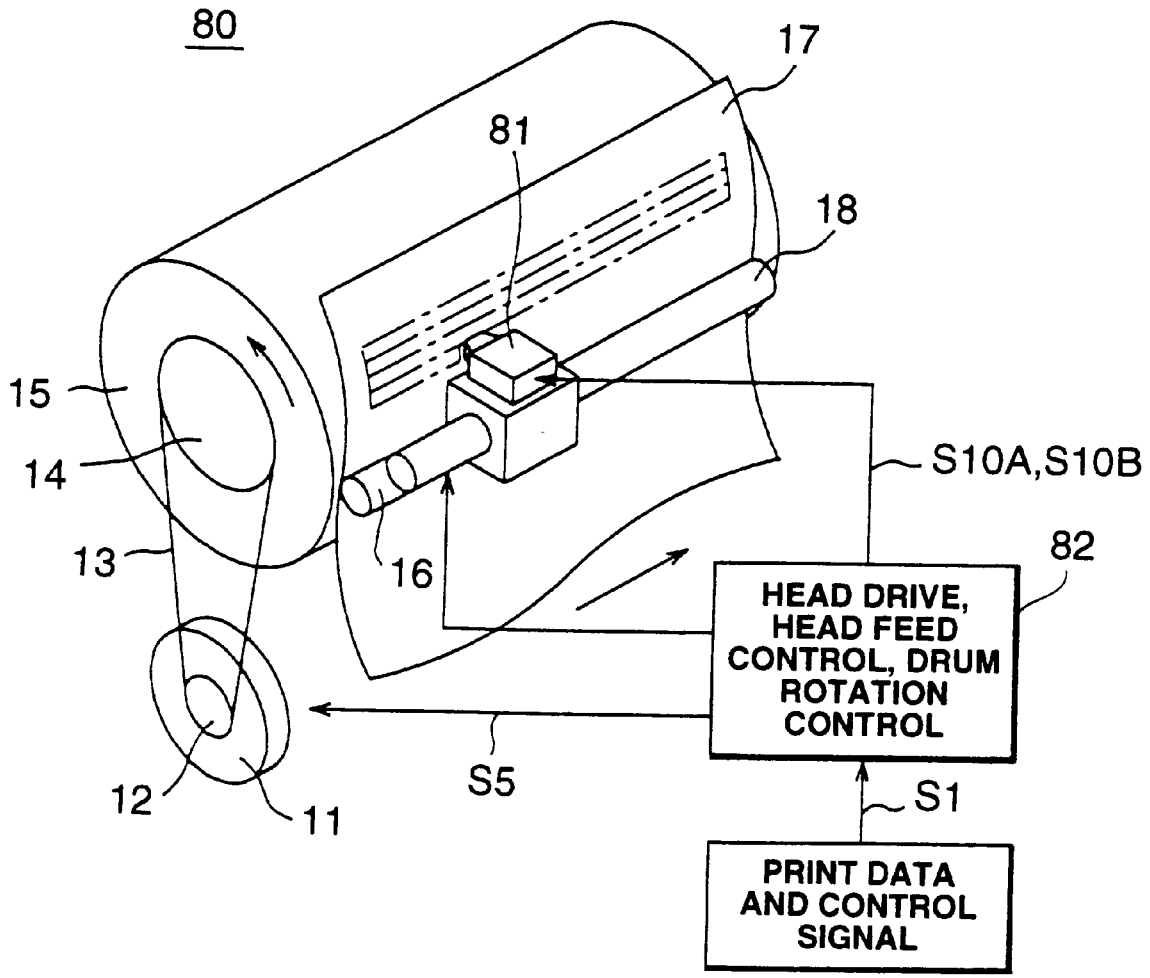
FIG. 11 is a schematic perspective view of the main part showing another example of a printer.

FIG. 11 in which the same reference number is allocated to the same part as in FIG. 1 shows a "carrier jet" printer 80 to which the present invention is applied and the "carrier jet" printer is constituted as the ink jet printer 10 in the first embodiment except in that a print head 81 which is a "carrier jet" print head is provided in place of the print head 19 shown in FIG. 1 and in that accordingly, a controlling section 81 is provided in place of the controlling section 20.

In this case, the print head 81 is constituted so that ink mixed with a diluent solvent is emitted every dot to provide a scale corresponding to the dot to each dot as described above, and a first piezoelectric element for emitting ink and a second piezoelectric element for emitting a diluent solvent are provided.

Figure 12:
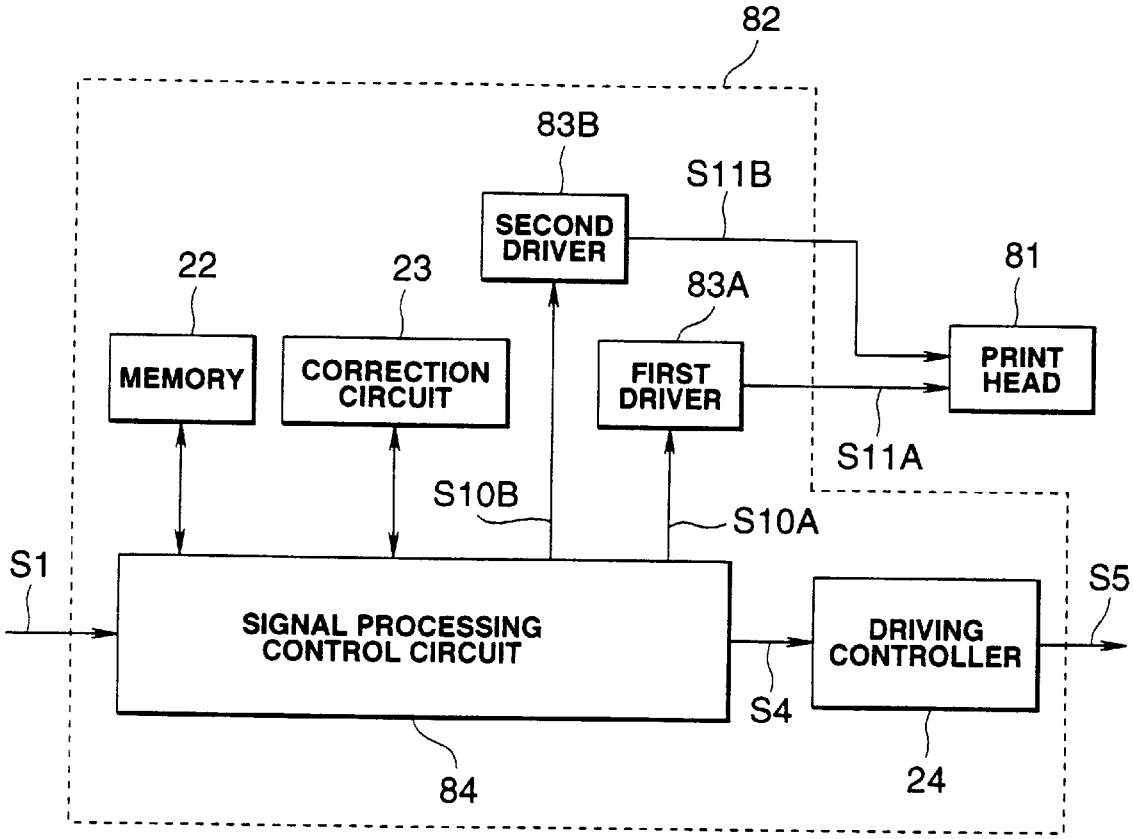
FIG. 12 is a block diagram showing the constitution of a controlling section in another example of the printer.

Therefore, in the controlling section 82, as shown in FIG. 12 in which the same reference number is allocated to the same part as in FIG. 2, plural first drivers 83A for driving each first piezoelectric element and plural second drivers 83B for driving each second piezoelectric element are provided, and the controlling section 82 is constituted so that a signal processing control circuit 84 drives and controls each first and second piezoelectric elements of the print head 81 via each first or second driver 83A or 83B.

Actually, the signal processing control circuit 84 is constituted by a microcomputer including CPU or DSP, the driving voltage value of each first piezoelectric element for obtaining a specified scale every dot is calculated, a first driving signal S10A in a pulse shape provided with the calculated driving voltage value is generated every first piezoelectric element and applied to the corresponding first piezoelectric element of the print head 81 via the corresponding first driver 83A as a first driving signal S11A.

Also, at this time, the signal processing control circuit 84 generates plural second driving signals S10B in a pulse shape provided with predetermined voltage every dot based upon a supplied input signal S1 and applies their signals to the corresponding second piezoelectric element of the print head 81 via the corresponding second driver 83B as a second driving signal S11B.

As described above, the controlling section 82 is constituted so that ink and a diluent solvent of quantity according to a scale specified every dot are emitted from the print head 81 and the print head 81 executes printing in a scale based upon an input signal S1 every dot.

(2-2) Constitution of the "Carrier Jet" Print Head

Figure 13:
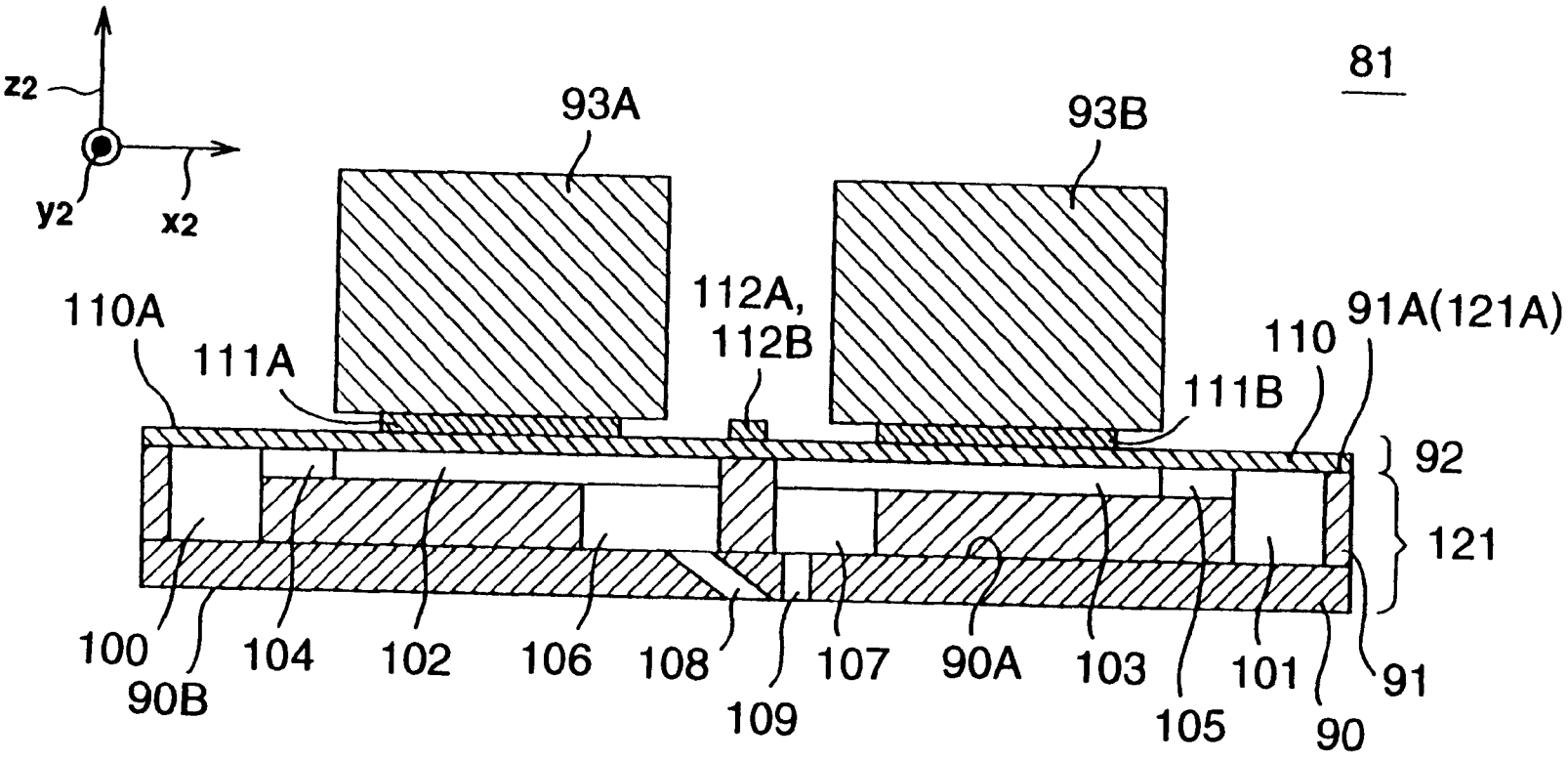
FIG. 13 is a schematic sectional view of the main part showing another example of a print head.
Figure 14:
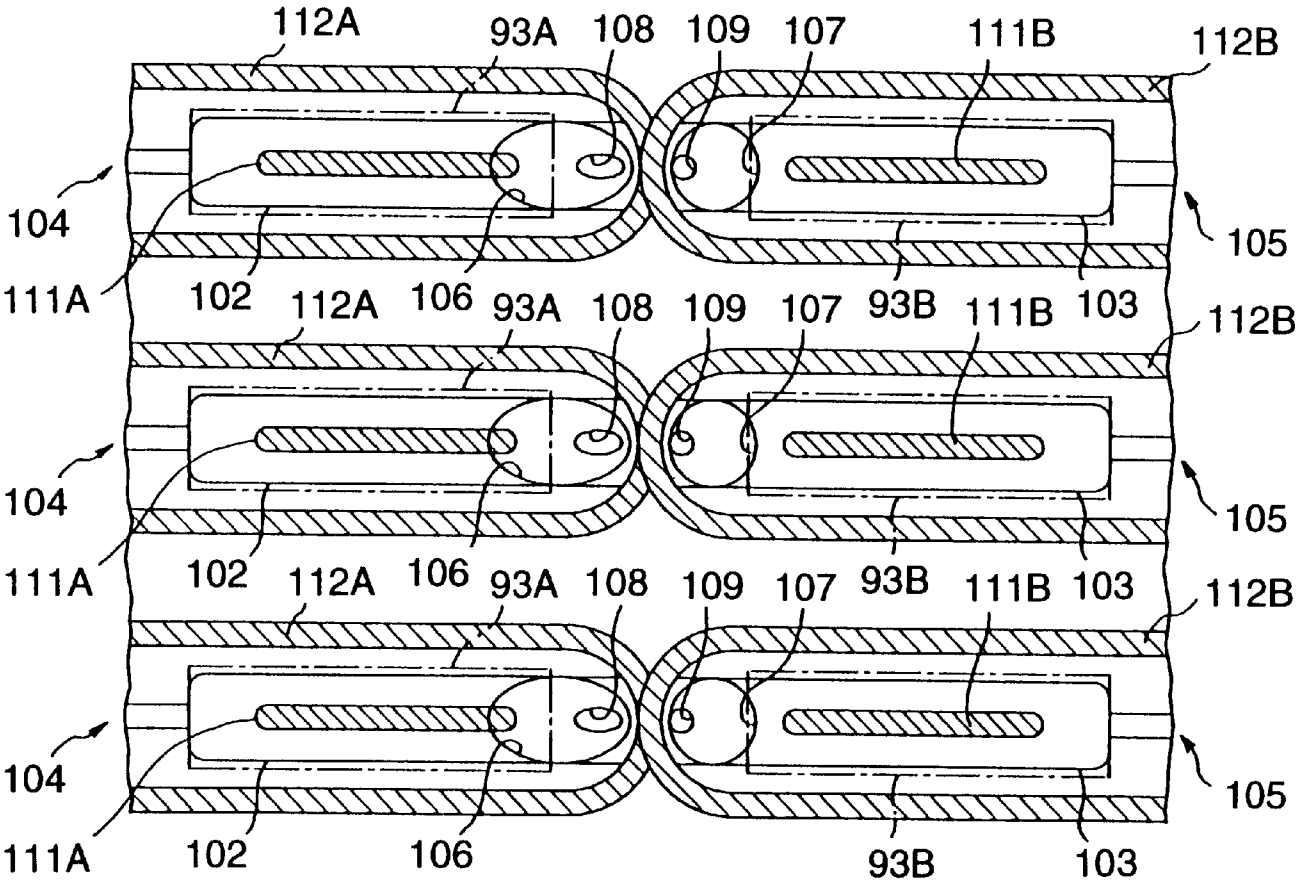
FIG. 14 is a schematic plan of the main part showing another example of the print head.

FIGS. 13 and 14 show the constitution of the print head 81 (the "carrier jet" print head).

In the above print head 81, as shown in FIGS. 13 and 14, a pressure chamber forming part 91 and a diaphragm 92 are laminated in order on one main surface 90A of an orifice plate 90 and plural first and second piezoelectric elements 93A and 93B are fixed on the diaphragm 92.

In the print head 81 in this embodiment, the pressure chamber forming part 91 is formed using stainless steel material for example, and a diluent solvent buffer tank 101 and an ink buffer tank 100 which are first and second openings respectively formed at both ends on one main surface 91A in Y direction (in a direction shown by an arrow $y_z$ in FIG. 13), plural concave first and second pressure chambers 103 and 102 sequentially formed at predetermined first pitch along the corresponding diluent solvent buffer tank 101 or the corresponding ink buffer tank 100 (in Y direction) and plural groove-shaped first and second liquid supply passages 105 and 104 individually corresponding to the first and second pressure chambers 103 and 102 and communicating with the diluent solvent buffer tank 101 or the ink buffer tank 100 are provided. At the end of each of the first and second pressure chambers 105 and 104, a first nozzle leading hole 107 and a second nozzle leading hole 106 which are respectively a through hole are respectively provided.

Further, the diluent solvent buffer tank 101 is connected to a diluent solvent tank not shown via a diluent solvent supply pipe not shown, the ink buffer tank 100 is connected to an ink tank not shown via an ink supply pipe not shown, as a result, a diluent solvent supplied from the diluent solvent tank to the diluent solvent buffer tank 101 via the diluent solvent supply pipe can be led into each first pressure chamber 103 via the corresponding first liquid supply passage 105, and in the meantime, ink supplied from the ink tank to the ink buffer tank 100 via the ink supply pipe can be led into each second pressure chamber 102 via the corresponding second liquid supply passage 104.

In the meantime, the orifice plate 90 is formed using an organic film and plural quantity determining nozzles 108 are made at the same pitch as the second pressure chamber 102 in Y direction so that the nozzles correspond to each second nozzle leading hole 106 in the pressure chamber forming part 91 and respectively communicate with the corresponding second nozzle leading hole 106. Also, in the orifice plate 90, plural emission nozzles 109 are made at the same pitch as the second pressure chamber 105 in Y direction so that the nozzles correspond to each first nozzle leading hole 107 in the pressure chamber forming part 91, respectively communicate with the corresponding first nozzle leading hole 107 and are close to the corresponding quantity determining nozzle 108 and arranged in X direction.

Hereby, in the print head 81, ink supplied to each second pressure chamber 102 can be emitted outside from the corresponding quantity determining nozzle 108 via the corresponding second nozzle leading hole 106 and in the meantime, a diluent solvent supplied to each first pressure chamber 103 can be emitted outside from the corresponding emission nozzle 109 via the corresponding first nozzle leading hole 107.

In the print head 81, each quantity determining nozzle 108 is formed with a predetermined lean so that each quantity determining nozzle gradually approaches the corresponding emission nozzle 109 as each quantity determining nozzle approaches the other surface 90B of the orifice plate 90. Hereby, the print head 81 which is a "carrier jet" print head is constituted so that an ink droplet and a diluent solvent droplet respectively emitted from the quantity determining nozzle 108 and the emission nozzle 109 are mixed and can be emitted outside as one droplet and as a result, a droplet of ink density according to ratio in which ink emitted from the quantity determining nozzle 108 and a diluent solvent emitted from the emission nozzle 109 are mixed can be emitted.

In the meantime, in the diaphragm 92, plural first and second protruding portions 111B and 111A are laminated on one main surface 110A of a thermoplastic layer 110 consisting of thermoplastic material and provided with an adhesive property and bonded onto one main surface 91A of the pressure chamber forming part 91 so that the protruding portions integrally cover the ink buffer tank 100, the diluent solvent buffer tank 101, the second liquid supply passage 104, the first liquid supply passage 105 and the first and second pressure chambers 103 and 102 respectively in the pressure chamber forming part 91.

Each first protruding portion 111B corresponds to each first pressure chamber 103 and is provided on the thermoplastic layer 110 so that each first protruding portion is opposite to the center of the corresponding first pressure chamber 103 in the direction of the width via the thermoplastic layer 110 and is shorter than the corresponding first pressure chamber 103. Similarly, each second protruding portion 111A corresponds to each second pressure chamber 102 as clear in FIG. 14 and is provided on one main surface 110A of the thermoplastic layer 110 so that each second protruding portion is opposite to the center of the corresponding second pressure chamber 102 in the direction of the width via the thermoplastic layer 110 and is shorter than the corresponding second pressure chamber 102.

Hereby, in the print head 81, for example even if first and second piezoelectric elements 93B and 93A are wider than the corresponding first and second pressure chambers 103 and 102 and/or the first and second piezoelectric elements 93B and 93A are longer than the corresponding first and second pressure chambers 103 and 102, pressure respectively applied to the diaphragm 92 from the first and second piezoelectric elements 93B and 93A can be effectively transmitted to the thermoplastic layer 110.

Further, the first and second piezoelectric elements 93B and 93A are formed by respectively alternately laminating piezoelectric material and conductive material and fixed on one surface 110A of the thermoplastic layer 110 of the diaphragm 92 via the corresponding first and second protruding portions 111B and 111A of the diaphragm 92 so that the first and second piezoelectric elements respectively correspond to the first and second pressure chambers 103 and 102 and are opposite to the corresponding first and second pressure chambers 103 and 102 via the diaphragm 92.

In this case, in each first and second piezoelectric element 93B and 93A, a first electrode for receiving the corresponding first or second driving signal S11A or S11B from the controlling section 82 shown in FIGS. 11 and 12 is formed on the upper surface which is the upper side in FIG. 13, and a grounded second electrode not shown is formed on the lower surface which is the lower side in FIG. 13. When driving voltage according to the corresponding first or second driving signal S11A or S11B is applied to the first electrode, the diaphragm 92 is deformed in Z direction (in a direction shown by an arrow $z_2$ in FIG. 13) in which the corresponding first or second pressure chamber 103 or 102 is pulled.

As a result, in the print head 81, when driving voltage in a pulse shape is applied to the first or second piezoelectric element 93B or 93A according to the first and second driving signals S11A and S11B supplied from the controlling section 82 shown in FIGS. 11 and 12 while the printer is operated, the first or second piezoelectric element 93B or 93A deforms the diaphragm 92 in a direction in which the diaphragm is pulled apart from the corresponding first or second pressure chamber 103 or 102, that is, in Z direction (in a direction shown by the arrow $z_2$ in FIG. 13), the volume of the corresponding first and second pressure chambers 103 and 102 are swollen, in the meantime, when driving voltage falls afterward, the first or second piezoelectric element 93B or 93A is restored from a deformed state, when the diaphragm 92 is restored to an original position, pressure in the first or second pressure chamber 103 or 102 is increased and hereby, a diluent solvent and ink in the corresponding first and second pressure chambers 103 and 102 can be emitted outside via the corresponding first nozzle leading hole 107 and the second nozzle leading hole 106, the corresponding emission nozzle 109 and the quantity determining nozzle 108 by the above pressure.

In addition to such constitution, in the case of the "carrier jet" print head 81, a second pattern layer 112A which is an approximately U-shaped protruding portion with predetermined thickness is laminated on one main surface 110A of the thermoplastic layer 110 of the diaphragm 92 so that the second pattern layer corresponds to each second pressure chamber 102, surrounds the corresponding second pressure chamber 102 and the second liquid supply passage 104 communicating with the second pressure chamber and is not positioned on the second pressure chamber 102 and the second liquid supply passage 104. Similarly, a first pattern layer 112B which is an approximately U-shaped protruding portion with predetermined thickness is laminated on one main surface 110A of the thermoplastic layer 110 of the diaphragm 92 so that the first pattern layer corresponds to each first pressure chamber 103, surrounds the corresponding first pressure chamber 103 and each first liquid supply passage 105 communicating with the first pressure chamber and is not positioned on the first pressure chamber 103 and the first liquid supply passage 105.

That is, in the print head 81 of the "carrier jet" printer 80 in this embodiment, for a diaphragm, the diaphragm 92 provided with the thermoplastic layer 110 covering the first pressure chamber 103 and the second pressure chamber 102 and provided with an adhesive property and the pattern layer laminated on the thermoplastic layer at least in a position except parts opposite to the first pressure chamber 103 and the second pressure chamber 102 and parts opposite to the first liquid supply passage 105 and the second liquid supply passage 104 is used.

Hereby, in the print head 81, when the diaphragm 92 is bonded onto one main surface 91A of the pressure chamber forming part 91 by pressing and heating the diaphragm (the thermoplastic layer 110) after the diaphragm 92 is positioned and set on one main surface 91A of the pressure chamber forming part 91, pressure is applied only to the first and second pattern layers 112A and 112B of the diaphragm 92, no unnecessary pressure is applied to the parts opposite to the first and second liquid supply passages 105 and 104 in which the first and second pattern layers 112A and 112B are not formed, the first and second liquid supply passages 105 and 104 are not blocked by the thermoplastic layer 110 and operation for bonding the diaphragm 92 onto the pressure chamber forming part 91 in which the first and second pressure chambers 103 and 102 are formed is facilitated.

In this embodiment, each first and second pattern layers 112B and 112A of the diaphragm 92 are formed so that they are 15 $\mu$m or more thick. Hereby, in the print head 81, even if the thermoplastic layer 110 of the diaphragm 92 is deformed when the diaphragm 92 is pressed, heated and bonded onto one main surface 91A of the pressure chamber forming part 91, unnecessary pressure is securely prevented from being applied to the parts of the thermoplastic layer 110 respectively opposite to each first pressure chamber 103, each second pressure chamber 102, each second liquid supply passage 104 and each first liquid supply passage 105 and the occurrence of failure in a process can be reduced more.

(2-3) Procedure for Manufacturing the "Carrier Jet" Print Head

Figure 15A:
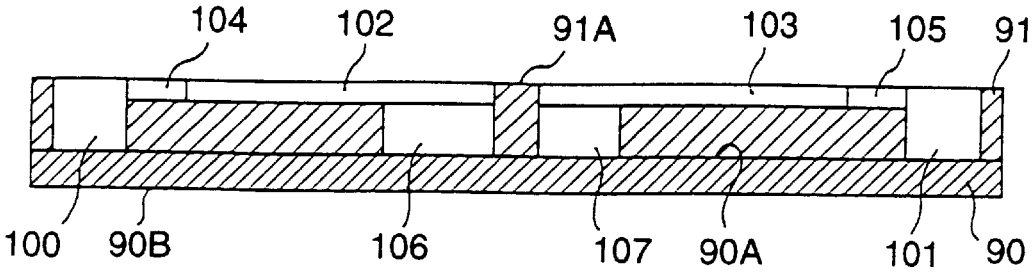
FIG. 15 shows another example of a method of manufacturing the print head and is a sectional view showing a process for forming a pressure chamber forming part.
Figure 15B:
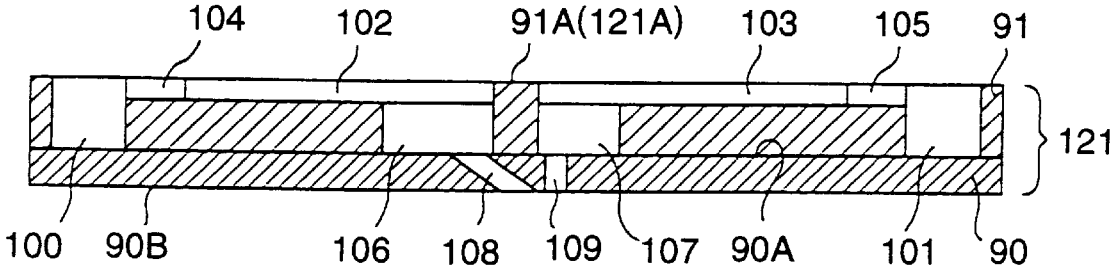
Figure 16A:
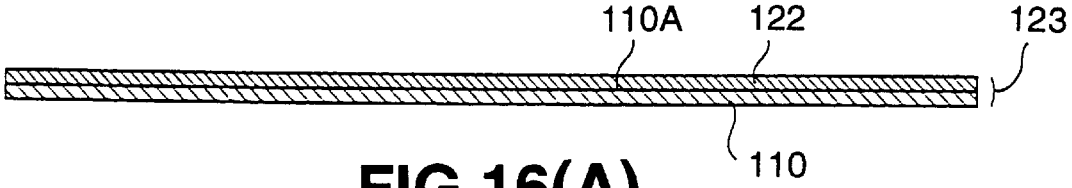
FIG. 16 shows another example of the method of manufacturing the print head and is a sectional view showing a process for forming a diaphragm.
Figure 16B:
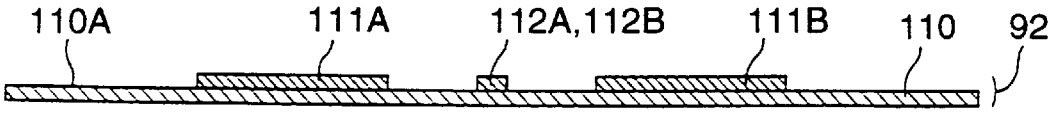
Figure 17A:
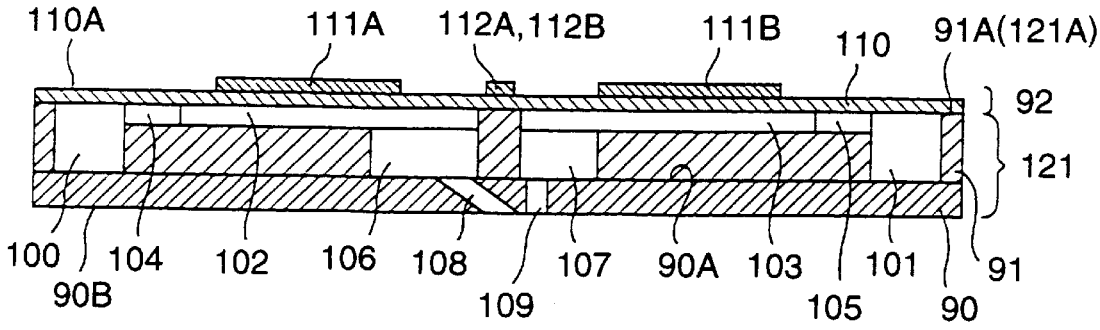
FIG. 17 shows another example of the method of manufacturing the print head and is a sectional view showing a process for completing the print head.
Figure 17B:
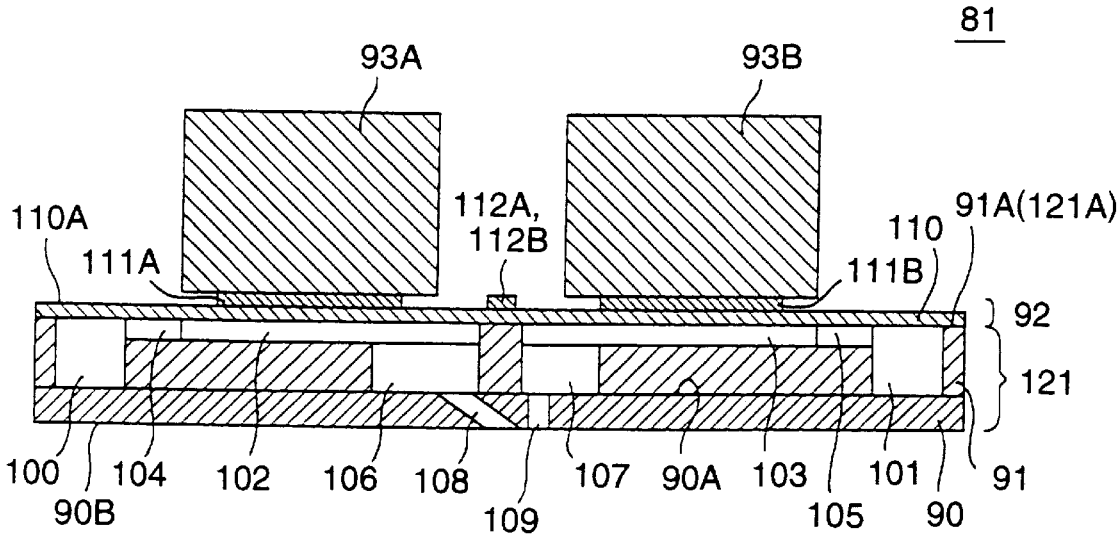

Referring to FIGS. 15 to 17, a method of manufacturing the print head 81 will be described below.

That is, as shown in FIG. 15 (A), the ink buffer tank 100, the diluent solvent buffer tank 101, the second liquid supply passage 104, the first liquid supply passage 105, the first and second pressure chambers 103 and 102, the second nozzle leading hole 106 and the first nozzle leading hole 107 are first formed by etching a plate consisting of stainless steel in a predetermined size and as a result, the pressure chamber forming part 91 is formed.

Next, as shown in FIG. 15 (A), a filmy member 120 such as an organic film which is a prototype of the orifice plate 90 is fixed on the side of the other surface 91B of the pressure chamber forming part 91 and as shown in FIG. 15 (B), the pressure chamber member 121 formed by bonding the orifice plate 90 onto the other surface 91B of the pressure chamber forming part 91 is formed by forming the quantity determining nozzle 108 or the emission nozzle 109 which is a through hole in a predetermined position of the filmy member 120 by an excimer laser beam and others so that the quantity determining nozzle or the emission nozzle communicates with the corresponding second nozzle leading hole 106 or the first nozzle leading hole 107.

In this case, in the print head 81, it is desirable to widen the range of determined quantity in which ink and a diluent solvent are mixed, that is, to widen the range of scales that an interval between the quantity determining nozzle 108 and the emission nozzle 109 is 100 μm or less. Therefore, in the print head 81 in this embodiment, distance between the opening of the quantity determining nozzle 108 and that of the emission nozzle 109 on the other surface 90B of the orifice plate 90 is decreased without decreasing distance between the corresponding first and second pressure chambers 103 and 102 by forming the quantity determining nozzle 108 diagonally as described above. Actually, even if distance between the corresponding first and second pressure chambers 103 and 102 is set to 200 μm or more if the thickness of the filmy member 120 shown in FIG. 15 (A) is set to 125 μm for example and the angle of the quantity determining nozzle 108 is set to 60 degrees, distance between the quantity determining nozzle 108 and the emission nozzle 109 can be set to 100 μm or less.

In the meantime, differently from the pressure chamber member, a laminated plate 63 in which a metallic layer 122 consisting of Cu or Ni and others is formed on one main surface 110A of the thermoplastic layer 110 consisting of thermoplastic material shown in FIG. 16 (A) is prepared, only plural first and second protruding portions 111B and 111A and the first and second pattern layers 112B and 112A respectively corresponding to each first and second pressure chambers 103 and 102 are left as shown in FIG. 16 (B) by etching the metallic layer 122 of the laminated plate 123, and the diaphragm 92 wherein the above first and second protruding portions 111B and 111A and the first and second pattern layers 112B and 112A are respectively laminated on one main surface 110A of the thermoplastic layer 110 is produced.

The above laminated plate 123 can be produced by forming the metallic layer 122 by bonding a plate consisting of Cu or Ni and others onto the thermoplastic layer 110 using an adhesive or by laminating the metallic layer 122 on the thermoplastic layer 110 by plating, or by forming the thermoplastic layer 110 by applying thermoplastic material on the metallic layer 122 consisting of a plate of Cu or Ni and others.

For the material of the thermoplastic layer 110 of the laminated plate 123, it is desirable that polyimide which is chemically stable for ink is used and an advantage that the diaphragm 92 can be produced at a low cost can be produced because technique for manufacturing a general flexible printed board can be used as it is by using polyimide. For such material, thermoplastic polyimide film, "Neoflex (trade mark)" manufactured by Mitsui Toatsu Chemicals, Inc. which is excellent in resistance to a chemical and heat resistance can be used.

For the material of the thermoplastic layer 110, material the glass transition point of which is 180 to 250° C. can be also used and hereby, in a later process for pressing, heating and bonding, pressurization temperature can be lowered.

Figure 18:
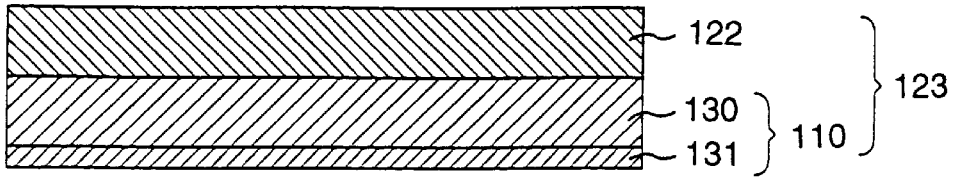
FIG. 18 is a sectional view showing another example of thermoplastic layer.

Further, the thermoplastic layer 110 of the laminated plate 123 is laminated by an organic film 131 which is a thermoplastic layer consisting of material the glass transition point of which is 180 to 250° C. and a thin film 130 as shown in FIG. 18, the laminated plate 123 may be also formed by fixing the above thermoplastic layer on a plate constituting the metallic layer 122 via the thin film 130 and hereby, the precision of the first and second protruding portions 111B and 111A and the first and second pattern layers 112B and 112A respectively formed on the thermoplastic layer 110 can be readily enhanced.

In the meantime, for a method of patterning the metallic layer 122 of the laminated plate 123, after sensitive material such as a dry film and liquid resist is laminated or applied on/to the metallic layer 122, the sensitive material is exposed using a mask and developed, the metallic layer can be patterned by etching the metallic layer 122 using residual sensitive material as a mask. In the concrete, if the metallic layer 122 is formed by copper, the above patterning can be made using dry film resist for the wiring of a printed board for sensitive material, using the aqueous solution of ferric chloride of approximately 10 to 50% for etchant and further, using the aqueous solution of sodium hydroxide of approximately 2 to 5% for a release agent of sensitive material.

Next, as shown in FIG. 17 (A), after the diaphragm 92 produced in the process described in relation to FIGS. 16 (A) and (B) is positioned and set on one main surface 121A of the pressure chamber member 121 (on one main surface 91A of the pressure chamber forming part 91) produced in the process described in relation to FIGS. 15 (A) and (B) so that each first and second protruding portions 111B nd 111A of the diaphragm 92 are respectively opposite to the center of the corresponding first or second pressure chamber 103 or 102 via the thermoplastic layer 110 of the diaphragm 92, the diaphragm is bonded on one main surface 91A of the pressure chamber forming part 91 by heating and pressing the thermoplastic layer 110 of the diaphragm 92. In this case, the function of bonding can be enhanced by executing cleaning for degreasing the diaphragm 92 and processing for drying the diaphragm 92 at approximately 90 to 120° C. when the diaphragm 92 is bonded onto one main surface 91A of the pressure chamber forming part 91.

Figure 19:
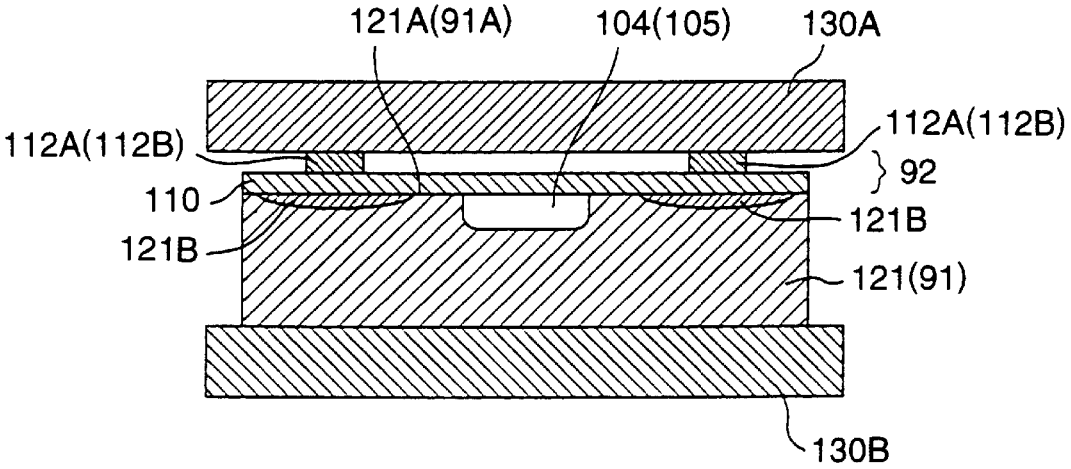
FIG. 19 is an enlarged sectional view of the main part showing a process for bonding the diaphragm to a pressure chamber member.

Actually, operation for bonding the diaphragm 92 onto one main surface 91A of the pressure chamber forming part 91 is executed by putting the diaphragm 92 positioned and set on one main surface 121A of the pressure chamber member 121 (on one main surface 91A of the pressure chamber forming part 91) between heated first and second plates 130A and 130B of a press as shown in FIG. 19. In the concrete, if the thermoplastic layer 110 of the diaphragm 92 is formed using Neoflex described above for example, the temperature of the first and second plates 130A and 130B of the press is set to approximately 230° C. and pressure is adjusted so that the pressure of approximately 20 to 30 $Kg/cm^2$ is applied to the bonded area of the diaphragm 92 and the pressure chamber forming part 91.

That is, for a diaphragm, as the diaphragm 92 provided with the thermoplastic layer 110 covering the first and second pressure chambers 103 and 102 and also provided with an adhesive property and the first and second pattern layers 112B and 112A laminated on the thermoplastic layer 110 at least in a position except parts opposite to the first and second pressure chambers 103 and 102 and parts opposite to the first and second liquid supply passages 105 and 104 is used in the print head of the printer in this embodiment, pressure is applied only to the first and second pattern layers 112B and 112A of the diaphragm 92 when the diaphragm 92 is set on one main surface 121A (on one main surface 91A) on which the first and second liquid supply passages 105 and 104 of the pressure chamber member 121 (the pressure chamber forming part 91) are formed as described above and the thermoplastic layer 110 of the diaphragm 92 is pressed, heated and bonded onto the pressure chamber member 121 (the pressure chamber forming part 91), no unnecessary pressure is applied to the parts opposite to the first and second liquid supply passages 105 and 104 in which the first and second pattern layers 112B and 112A are not formed, the first and second liquid supply passages 105 and 104 are not blocked by the thermoplastic layer 110 and operation for bonding the diaphragm 92 to the pressure chamber member 121 (the pressure chamber forming part 91) in which the first and second pressure chambers 103 and 102 are formed is facilitated.

Next, as shown in FIG. 17 (B), first and second piezoelectric elements 93B and 93A are respectively fixed on the first and second protruding portions 111B and 111A of the diaphragm 92 of a head constituting part consisting of the diaphragm 92 and the pressure chamber member 121 respectively formed as described above. Hereby, the print head 81 shown in FIG. 13 can be obtained.

(2-4) Operation and Effect in the Second Embodiment

In the above constitution, in the "carrier jet" printer 80 shown in FIG. 11, the controlling section 82 generates plural first and second driving signals S11A and S11B based upon a supplied input signal S1 as shown in FIG. 12 and the signals are respectively applied to the corresponding first or second piezoelectric element 93B or 93A of the print head 81.

Figure 20:
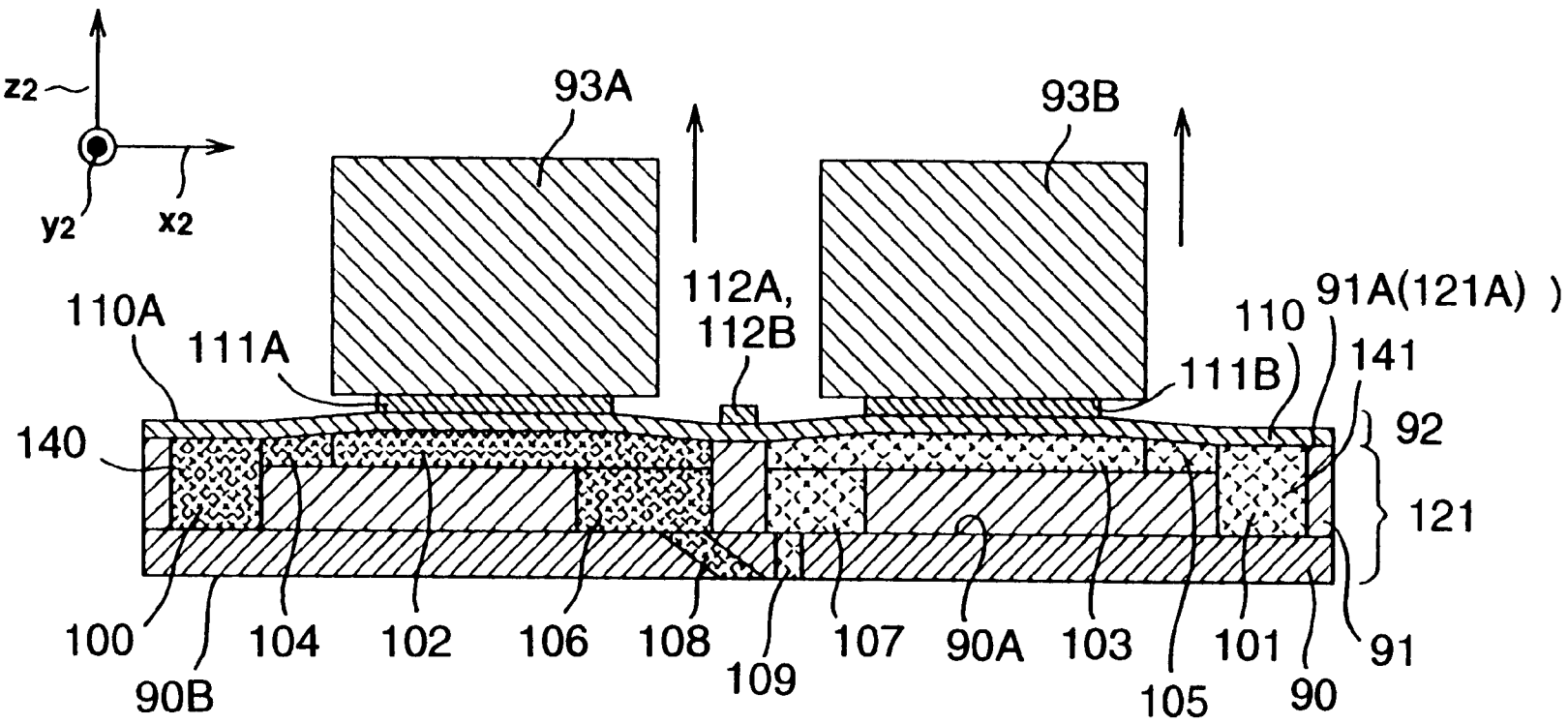
FIG. 20 is a schematic sectional view of the main part showing the operation of the print head in another example.

At this time, in the corresponding first and second piezoelectric elements 93B and 93A, when driving voltage in a pulse shape is applied to the respective first electrodes, a positive electric field is generated in a polarized direction based upon the driving voltage and as a result, as shown in FIG. 20, the corresponding first and second piezoelectric elements are displaced in a direction shown by an arrow $A_3$ in FIG. 20, that is, in a direction in which the diaphragm 92 is pulled on the side reverse to the corresponding first or second pressure chamber 103 or 102 (in Z direction), in other words in a direction in which the corresponding first or second pressure chamber 103 or 102 is swollen. At this time, as a meniscus is formed in a position in which the surface tension of a diluent solvent 141 or ink 140 is balanced in the vicinity of each end of the emission nozzle 109 and the quantity determining nozzle 108, the position of the meniscus is stable in a position shown in FIG. 20 even after the corresponding first or second piezoelectric element 93B or 93A pulls up the diaphragm 92.

Figure 21:
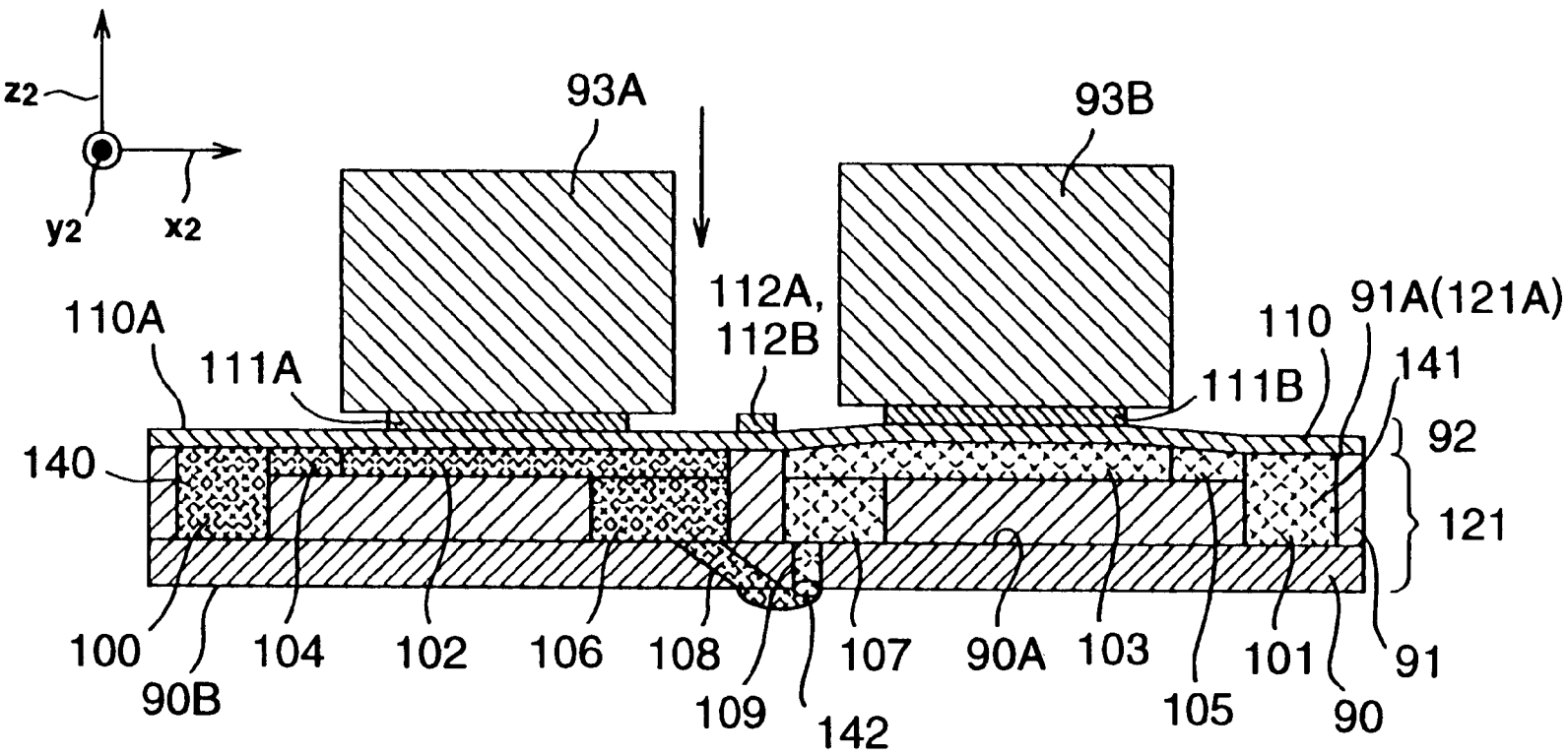
FIG. 21 is a schematic sectional view of the main part showing the operation of the print head in another example.

Next, as shown in FIG. 21, when the second piezoelectric element 93A is displaced in a direction shown by an arrow $A_4$ in FIG. 21, that is, the second piezoelectric element 93A is restored from a displaced state and the diaphragm 92 is restored to an original position because driving voltage applied to the second piezoelectric element 93A falls, pressure in the corresponding second pressure chamber 102 is increased and ink 140 in the second pressure chamber 102 is emitted outside via the corresponding second nozzle leading hole 106 and the quantity determining nozzle 108 in order by the above pressure.

In this case, as driving voltage in a pulse shape with a lean a fall of which is gentle is applied to the second piezoelectric element 93A, ink 140 in the corresponding second pressure chamber 102 overflows in the vicinity of the end of the quantity determining nozzle 108 without being emitted from the quantity determining nozzle 108. When the ink 140 touches the meniscus of a diluent solvent 141 existing in the vicinity of the end of the corresponding emission nozzle 109 and is mixed with the diluent solvent, mixed solution 142 of ink density according to a specified scale is formed.

Figure 22:
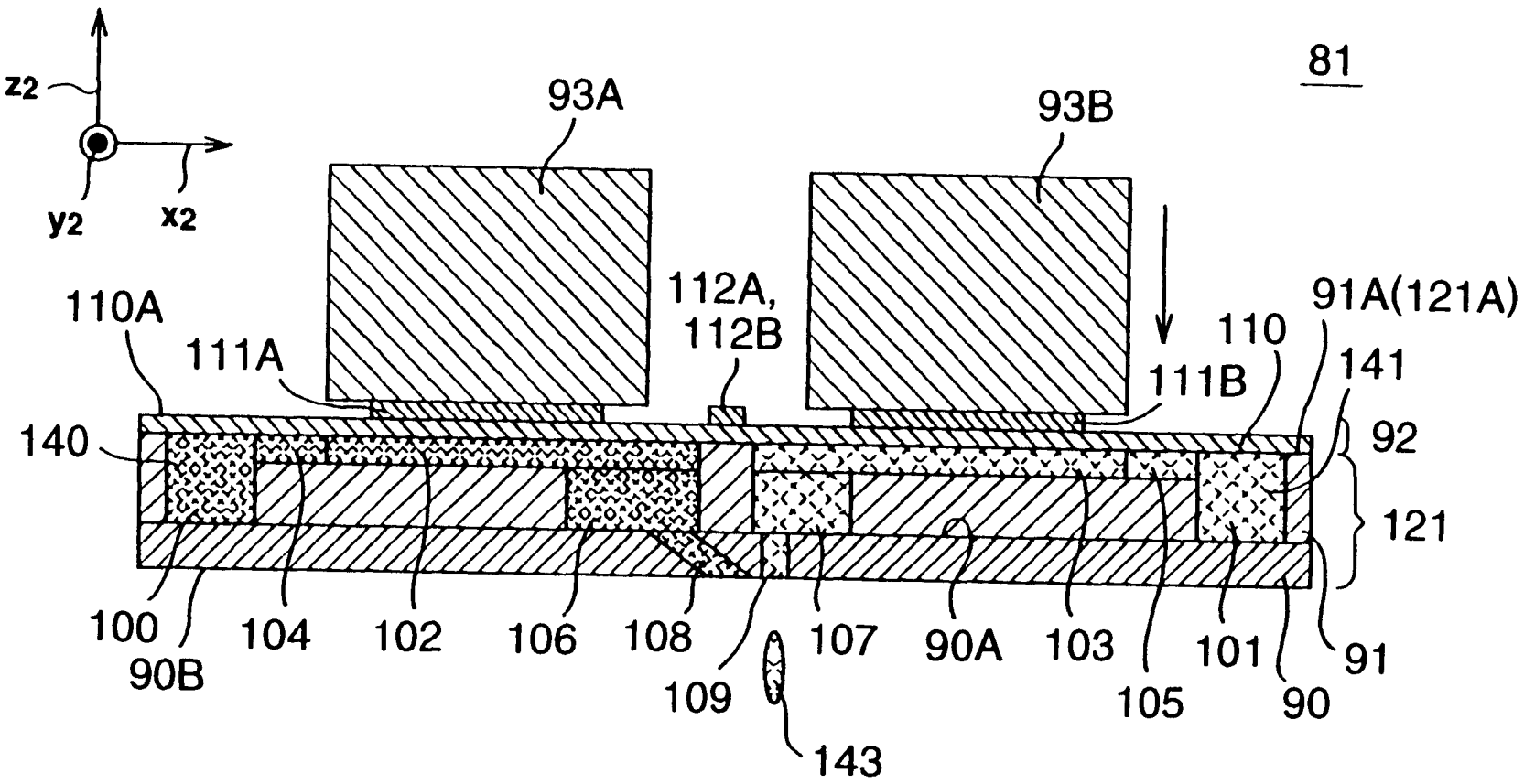
FIG. 22 is a schematic sectional view of the main part showing the operation of the print head in another example.

Next, as shown in FIG. 22, when driving voltage applied to the first piezoelectric element 93B immediately after ink 140 is emitted from the quantity determining nozzle 108 falls and the first piezoelectric element is displaced in a direction shown by an arrow $A_4$ in FIG. 22, that is, the first piezoelectric element 93B is restored from a displaced state, the pressure of the corresponding first pressure chamber 103 is increased and as a result, solution 142 in which ink 140 and a diluent solvent 141 are mixed is emitted from the corresponding emission nozzle 109. In this case, driving voltage applied to the first piezoelectric element 93B rapidly falls and mixed solution 142 formed at the end of the emission nozzle 109 is emitted from the emission nozzle 109 as one mixed droplet 143 shown in FIG. 22.

In the case of the print head 81, the diaphragm 92 is formed using the thermoplastic layer 110 consisting of thermoplastic material and provided with an adhesive property as described above and therefore, when the diaphragm 92 is bonded onto one main surface 91A of the pressure chamber forming part 91, no adhesive only for bonding of liquid and others and no adhesive provided with photosensitivity and an adhesive property such as a dry film are required.

Therefore, in the print head 81, a bonding process for bonding the diaphragm 92 onto one main surface 91A of the pressure chamber forming part 91 can be facilitated and as no high-priced apparatus such as an exposer is required in this process, a manufacturing cost can be reduced.

Also, in the print head 81, as plural approximately U-shaped first and second pattern layers 112B and 112A are formed on the thermoplastic layer 110 of the diaphragm 92 in a position except respective parts opposite to each second pressure chamber 102, the second liquid supply passage 104 communicating with the above second pressure chamber, each first pressure chamber 103 and the first liquid supply passage 105 communicating with the above first pressure chamber, pressure to be applied to the pressure chamber member 121 via the diaphragm 92 can be applied only to an area 121B under each first and second pattern layers 112B and 112A as shown in FIG. 19 in a process for bonding the diaphragm 92 onto one main surface 91A of the pressure chamber forming part 91.

Therefore, in the print head 81, unnecessary pressure can be prevented from being applied to the part opposite to each second liquid supply passage 104 or each first liquid supply passage 105 in the pressure chamber forming part 91 of the diaphragm 92 (the thermoplastic layer 110) in a process for bonding the diaphragm 92 to the pressure chamber forming part 91, and each second liquid supply passage 104 and each first liquid supply passage 105 can be securely prevented from being blocked by the thermoplastic layer 110 of the diaphragm 92 by the quantity.

Also, in the print head 81, as pressure to be applied to the thermoplastic layer 110 of the diaphragm 92 can be applied only to the first and second pattern layers 112B and 112A as described above in a process for bonding the diaphragm 92 onto one main surface 91A of the pressure chamber forming part 91, the pressurizing force of a press can be reduced.

According to the above constitution, a printer wherein the diaphragm 92 is formed using the thermoplastic layer 110, as the first and second pattern layers 112B and 112A with predetermined thickness are formed on one main surface 110A of the thermoplastic layer 110 at least in a position except parts opposite to the second pressure chamber 102, the second liquid supply passage 104 communicating with the above second pressure chamber 102, the first pressure chamber 103 and the first liquid supply passage 105 communicating with the above first pressure chamber, operation for bonding the diaphragm 92 onto one main surface 91A of the pressure chamber forming part 91 can be facilitated, the blockade of each second liquid supply passage 104 and each first liquid supply passage 105 in the pressure chamber forming part 91 can be remarkably reduced in the bonding process, and as a result, operation for bonding the diaphragm 92 onto one main surface 91A of the pressure chamber forming part 91 can be readily executed without blocking each second liquid supply passage 104 and each first liquid supply passage 105 in the pressure chamber forming part 91 can be realized.

(3) Other Embodiments

In the above first and second embodiments, a case that the first and second inventions are applied to a serial printer is described, however, the present invention is not limited to the above case and can be applied to other various types printers such as a parallel printer.

Also, in the above first and second embodiments, a case that as pressure increasing means for increasing pressure in the pressure chamber 41 of the pressure chamber member 61 and in the first and second pressure chambers 103 and 102 of the pressure chamber member 121, the piezoelectric element 33, the first and second piezoelectric elements 93B and 93A are applied is described, however, the present invention is not limited to the above case and can be applied to other various pressure increasing means.

Further, in the above first embodiment, a case that the pressure chamber member 61 is constituted by the orifice plate 50 and the pressure chamber forming part 31 is described, however, the present invention is not limited to the above case and a pressure chamber forming part and an orifice plate may be also integrated.

Figure 23:
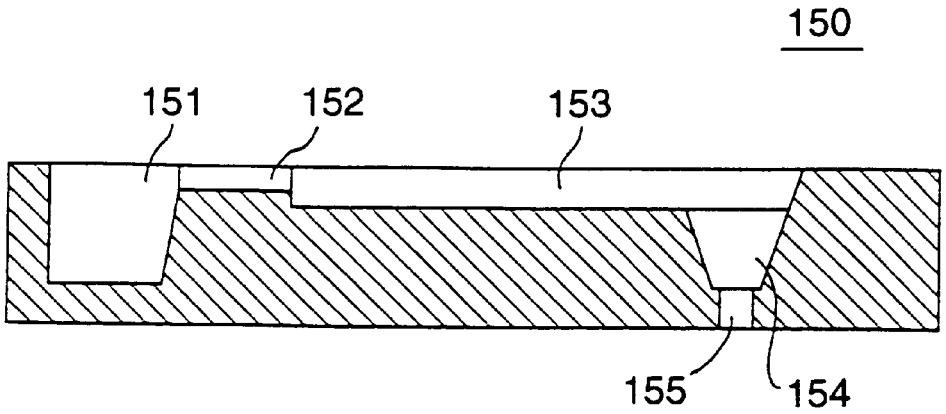
FIG. 23 is a sectional view showing an example of a pressure chamber forming part.

That is, as shown in FIG. 23, a pressure chamber forming part 150 provided with an ink buffer tank 151, an ink supply passage 152, a pressure chamber 153, a nozzle leading hole 154 and an emission nozzle 155 may be also formed by injection molding. At this time, if polyetherimide, polyethersulfone and others are used for the material of the pressure chamber forming part 150, the pressure chamber 153 in which the emission nozzle 155 is formed at narrow pitch can be formed and the emission nozzle 155 can be also formed by excimer laser beam machining.

Similarly, in the above second embodiment, a case that the pressure chamber forming part 121 is constituted by the orifice plate 90 and the pressure chamber forming part 91 is described, however, the present invention is not limited to the above case and a pressure chamber forming part and an orifice plate may be also integrated.

Figure 24:
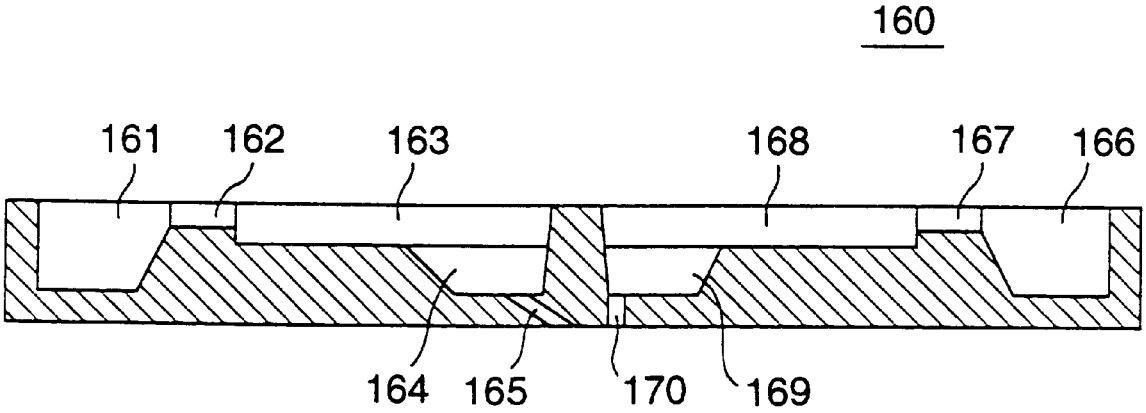
FIG. 24 is a sectional view showing another example of a pressure chamber forming part.

That is, as shown in FIG. 24, a pressure chamber forming part 160 provided with an ink buffer tank 161, a second liquid supply passage 162, a second pressure chamber 163, a second nozzle leading hole 164, a quantity determining nozzle 165, a diluent solvent buffer tank 166, a first liquid supply passage 167, a first pressure chamber 168, a first nozzle leading hole 169 and an emission nozzle 170 may be formed by injection molding. At this time, if polyetherimide, polyethersulfone and others are used for the material of the pressure chamber forming part 160, the first and second pressure chambers 168 and 163 in which the emission nozzle 170 and the quantity determining nozzle 165 are formed at narrow pitch can be formed, and the emission nozzle 170 and the quantity determining nozzle 165 can be also formed by excimer laser beam machining.

Further, in the above second embodiment, a case that a scale specified every dot is provided to each dot by adjusting the quantity of ink 140 is described, however, the present invention is not limited to the above case and a scale specified every dot may be also provided to each dot by adjusting the quantity of a diluent solvent 141. That is, a diluent solvent may be also emitted from the quantity determining nozzle and ink may be also emitted from the emission nozzle. In this case, the constitution and operation of the "carrier jet" print head can be equalized to those in the second embodiment. In this case, power for representing a pale color is reduced, however, on the contrary, as for a shadow, the constitution and operation of the "carrier jet" print head are advantageous because sufficient ink density can be obtained.

Further, in the above first and second embodiments, a case that the pattern layer 52 of the diaphragm 32, the first and second pattern layers 112B and 112A of the diaphragm 92 are formed in the shape of a letter U in a part except parts respectively opposite to the pressure chamber 41, the first and second pressure chambers 103 and 102, the liquid supply passage 42 communicating with the pressure chamber 41, the first and second liquid supply passages 105 and 104 respectively communicating with the first and second pressure chambers 103 and 102 is described, however, the present invention is not limited to the above case and in short, a pattern layer has only to be formed in a part except parts opposite to at least the pressure chamber 41, the first and second pressure chambers 103 and 102, the liquid supply passage 42 communicating with the pressure chamber 41, the first and second liquid supply passages 105 and 104 respectively communicating with the first and second pressure chambers 103 and 102 and a pattern layer may be also formed in any area respectively on the thermoplastic layers 50 and 110 in a part except the above opposite parts. Therefore, it need scarcely be said that for the shape of a pattern layer, other various shapes can be applied.

Further, in the above first and second embodiments, for the thermoplastic layers 50 and 110, material the glass transition point of which is 180 to 250° C. is used. When a thermoplastic layer is formed by a polyimide bonding film AS-2250 (trademark) manufactured by Hitachi Chemical Industry which is thermoplastic polyimide material and the glass transition point of which is 165° C. and the same printer as in the first and second embodiments is manufactured for comparison, a large quantity of flowing is caused at the pressurization and heating temperature of 180° C. When flowing is caused as described above, a liquid supply passage may be probably blocked and it is undesirable. Further, when a thermoplastic layer is formed by DS3200 (trademark) manufactured by Tomoegawa Paper which is thermoplastic polyimide material and the glass transition point of which is 172° C. and the same printer as in the first and second embodiments is manufactured for comparison, a large quantity of flowing is caused at the pressurization and heating temperature of 220° C. When flowing is caused as described above, a liquid supply passage may be probably blocked and it is undesirable. Even when pressurization and heating temperature is changed to 190° C., a large quantity of flowing is still caused. When flowing is caused as described above, a liquid supply passage may be probably blocked and it is undesirable. Further, in this case, sufficient bond strength cannot be obtained. That is, it is verified that for material for forming a thermoplastic layer, material the glass transition point of which is 180 to 250° C. is desirable.

2. Embodiments Corresponding to the Third and Fourth Inventions (1) First Embodiment In this embodiment, an example in which the present invention is applied to an ink jet printer emitting only ink, that is, an embodiment corresponding to the third invention will be described.

(1-1) Constitution of an Ink Jet Printer

The overall constitution of an ink jet printer in this embodiment is to be described, however, as the overall constitution is the same as in the first embodiment of the above embodiments corresponding to the first and second inventions, the description is omitted. That is, in the ink jet printer in this embodiment, an ink jet print head described later is used in place of the above print head 19. As the same controlling section as the above controlling section is also used in the ink jet printer in this embodiment, the description is also omitted.

(1-2) Constitution of an Ink Jet Print Head

Figure 25:
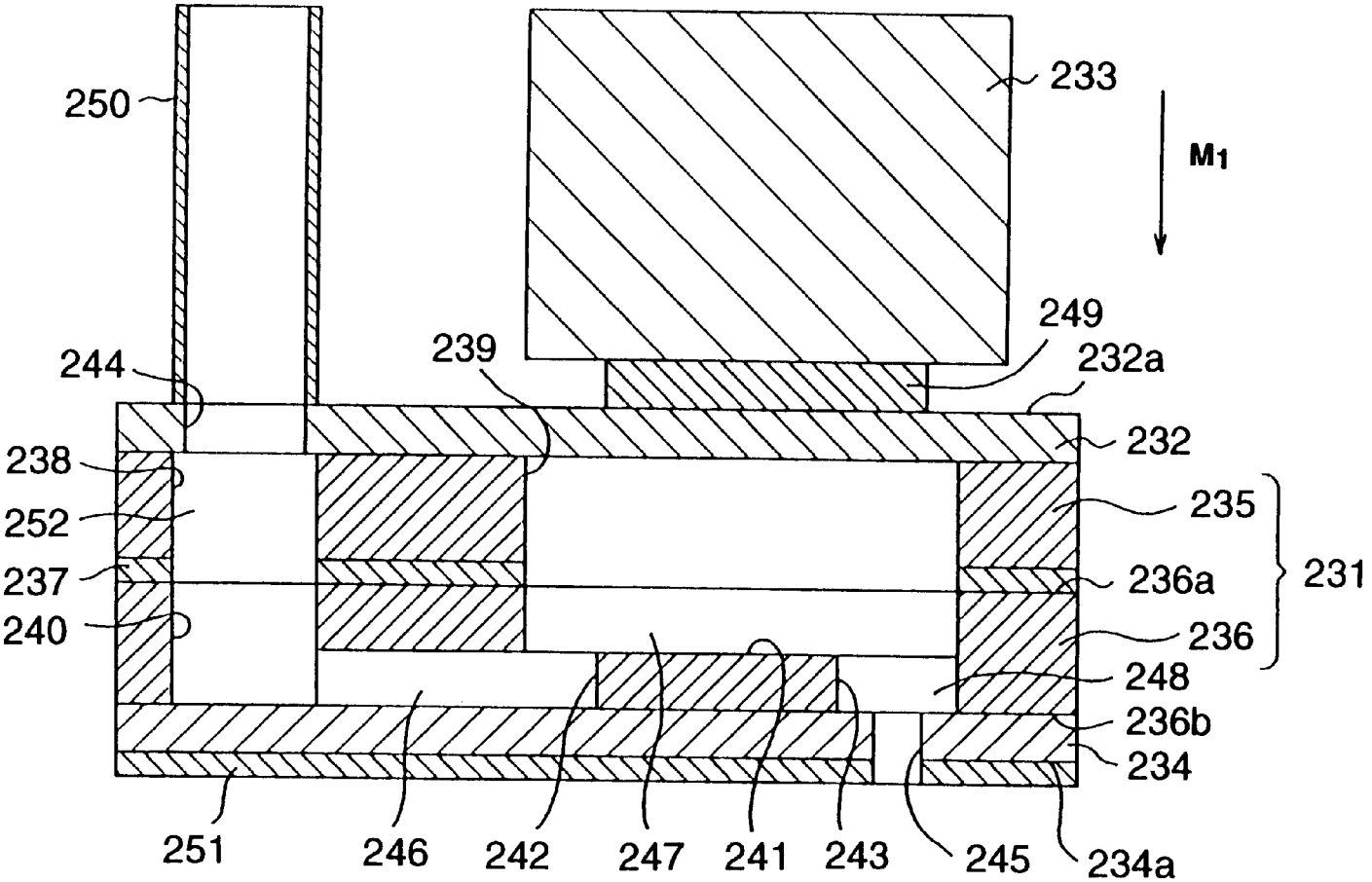
FIG. 25 is a schematic sectional view of the main part showing further another example of a print head.

Next, the constitution of an ink jet print head in the ink jet printer in this embodiment will be described. The print head is mainly constituted by a pressure chamber forming part 231, a diaphragm 232, a piezoelectric element 233 which is a laminated piezoelectric element and an orifice plate 234 which is a nozzle forming member as shown in FIG. 25.

The above pressure chamber forming part 231 is formed by bonding a first member 235 and a second member 236 by an adhesive layer 237. These first and second members 235 and 236 may be formed by stainless steel with the thickness of 0.1 mm for example and others.

First, for the first member 235, it is a plate member provided with a through hole part 238 constituting an ink buffer tank in a predetermined position and a through hole part 239 constituting a pressure chamber. In the meantime, the second member 236 is also a plate member, a through hole part 240 communicating with the above through hole part 238 forming the ink buffer tank in a position corresponding to the through hole part 238 for forming an ink buffer tank is formed and a groove part 241 communicating with the above through hole part 239 forming the pressure chamber in a position corresponding to the through hole part 239 for forming a pressure chamber is formed so that the groove part is open on one main surface 236*a*. Also, in the second member 236, the side the above through hole part 240 and the bottom of the groove part 241 communicate, the groove part 241 forming an ink supply passage is formed so that it is open on one main surface 236*b* on the reverse side of one main surface 236*a* which is opposite to the first member 235 and a through hole 243 forming a nozzle leading hole is formed so that the through hole is through from the bottom of the groove part 241 to one main surface 236*b*.

In the print head in this embodiment, a diaphragm 232 is arranged on the side of the first member 235 of the above pressure chamber forming part 231, an orifice plate 234 is arranged on the side of the second member 236 and the pressure chamber forming part 231 is held between the diaphragm 232 and the orifice plate 234 in the direction of the thickness. The above diaphragm 232 may be formed by Neoflex (trademark) manufactured by Mitsui Toatsu Chemical Industry which is excellent in heat resistance and resistance to a chemical and the glass transition point of which is 250° C. or less for example and the thickness may be set to approximately 20 μm. In the above diaphragm 232, an ink supply port 244 with a smaller diameter than the diameter of the through hole part 238 is formed in a position corresponding to the through hole part 238 to be an ink buffer tank.

In the meantime, the orifice plate 234 may be formed, for example by Neoflex (trademark) manufactured by Mitsui Toatsu Chemical Industry which is excellent in heat resistance and resistance to a chemical and the glass transition point of which is 250° C. or less and the thickness may be set to approximately 50 μm. It is desirable that such material is used because chemical stability is secured. Further, in the above orifice plate 234, an emission nozzle 245 with a smaller diameter than the diameter of the through hole 243 is formed in a position corresponding to the through hole 243 to be a nozzle leading hole. The emission nozzle 245 may be formed as a hole the section of which is circular for example.

That is, the through hole part 238, the through hole part 240, a groove part 242, the groove part 241, the through hole part 239 and the through hole 243 are connected by putting the pressure chamber forming part 231 between the diaphragm 232 and the orifice plate 234 in the direction of the thickness, a cavity formed as a result is closed by the diaphragm 232 and the orifice plate 234, and an ink buffer tank 252 formed from the side of the diaphragm 232 to the side of the orifice plate 234 respectively in the pressure chamber forming part 231 in the direction of the thickness, a liquid supply passage 246 connected to the above ink buffer tank and formed in the in-plane direction of the pressure chamber forming part 231, a pressure chamber 247 connected to the above liquid supply passage and formed on the side of the diaphragm and a nozzle leading hole 248 connected to the above pressure chamber 247 which is open on the side of the orifice plate 234 are sequentially formed. As described above, as the ink supply port 244 is formed in the diaphragm 232 and the emission nozzle 245 is formed in the orifice plate 234, ink flows in the order of the ink supply port 244, the ink buffer tank 252, the liquid supply passage 246, the pressure chamber 247, the nozzle leading hole 248 and the emission nozzle 245.

Also, in the print head in this embodiment, a protruding portion 249 is formed in a position corresponding to the pressure chamber 247 on one main surface 232*a* on the reverse side to a surface on which the diaphragm 232 is bonded to the pressure chamber forming part 231 and a piezoelectric element 233 is mounted via the protruding portion 249. For the above piezoelectric element 233, the one in which a piezoelectric member and a conductive member are alternately laminated is used. At this time, the laminated number of piezoelectric members and conductive members may be freely set.

The protruding portion 249 is formed so that the area is smaller than that of the pressure chamber 247 in a plan or that of the piezoelectric element 233 in a plan. Further, an ink supply pipe 250 connected to an ink tank not shown is connected in a position corresponding to the ink supply port 244 on one main surface 232*a* of the above diaphragm 232.

Furthermore, in the print head in this embodiment, a liquid repelling film 251 is formed on one main surface 234*a* which is a nozzle open surface of the orifice plate 234.

Figure 26:
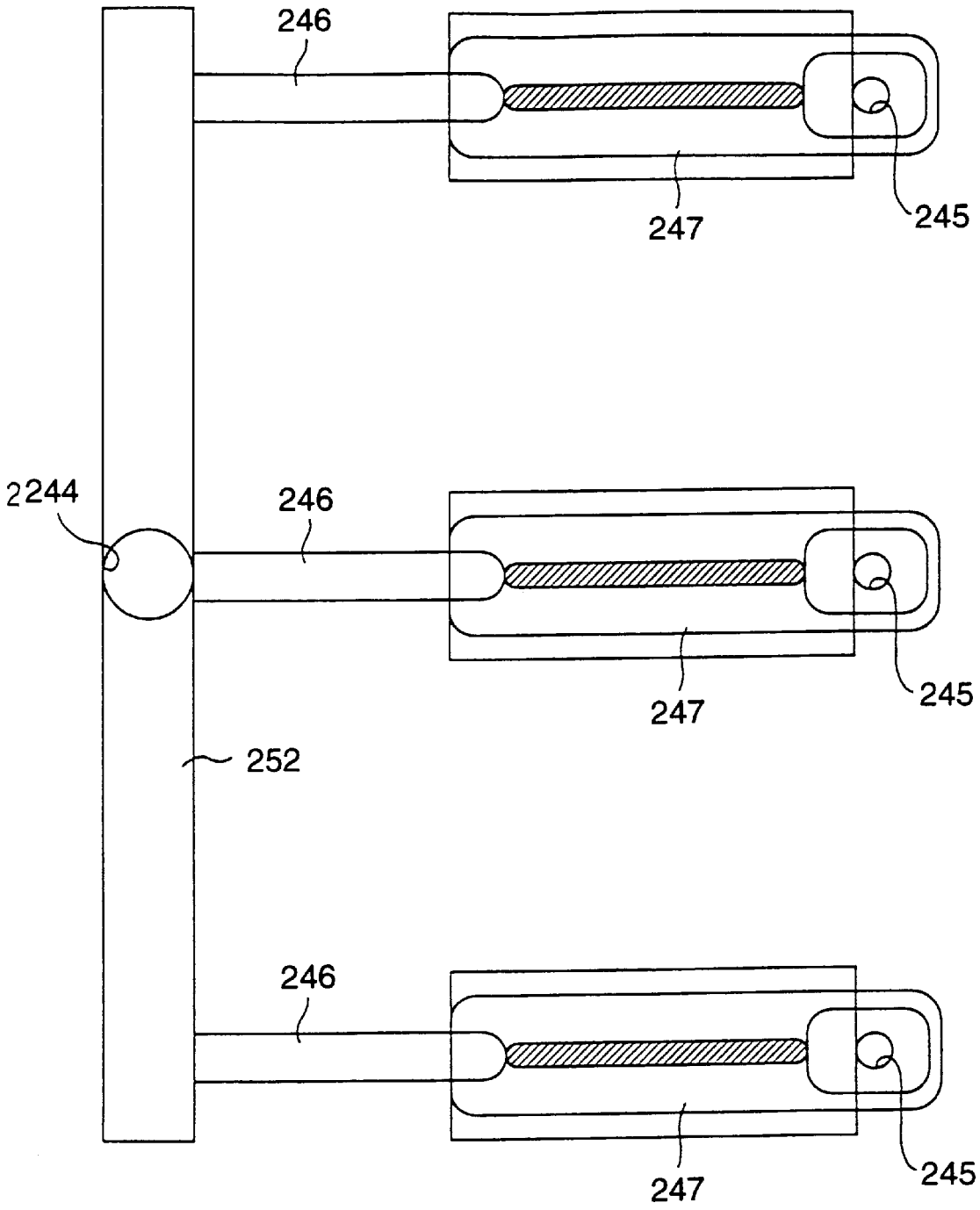
FIG. 26 is a schematic plan of the main part showing further another example of the print head.

In the printer in this embodiment, as schematically shown in FIG. 26, the ink buffer tank 252 in the print head is formed by a tubular member, plural print heads described above are arranged in parallel at a predetermined interval in the longitudinal direction of the ink buffer tank 252, and the ink buffer tank 252 functions as an ink distribution pipe common to each print head. Each liquid supply passage 246 is connected to each print head so that the liquid supply passage is perpendicular to the ink buffer tank 252 in the longitudinal direction. Therefore, the emission nozzle 245 of each print head is open on one surface. That is, ink is supplied from an ink tank not shown to the ink buffer tank 252 and supplied from here to the liquid supply passage 246 of each print head.

Particularly in the printer in this embodiment, the diaphragm 232 and the pressure chamber forming part 231 respectively of a print head are bonded by an adhesive layer consisting of thermoplastic resin.

Particularly in the printer in this embodiment, the orifice plate 234 of a print head is bonded to the pressure chamber forming part 231 by thermocompression bonding.

Further, particularly in the printer according to the present invention, the first member 235 and the second member 236 respectively constituting the pressure chamber forming part 231 are bonded by an adhesive layer 237 consisting of thermosetting resin as described above.

That is, in the printer in this embodiment, an adhesive layer 237 consisting of thermoplastic resin is formed between the pressure chamber forming part 231 and the diaphragm 232 and the bond strength of the diaphragm 232 to the pressure chamber forming part 231 is sufficiently secured.

(1-3) Operation in the First Embodiment

The operation of the printer in this embodiment is as follows: That is, as the piezoelectric element 233 used in the print head of the printer in this embodiment is provided with a property that the piezoelectric element is linearly displaced in a direction reverse to a direction shown by an arrow $M_1$ in FIG. 25 when driving voltage is applied to it, the piezoelectric element lifts the diaphragm 232 via the protruding portion 249 bonded to the piezoelectric element and as shown in FIG. 27, the volume of the pressure chamber 247 is increased.

Figure 27:
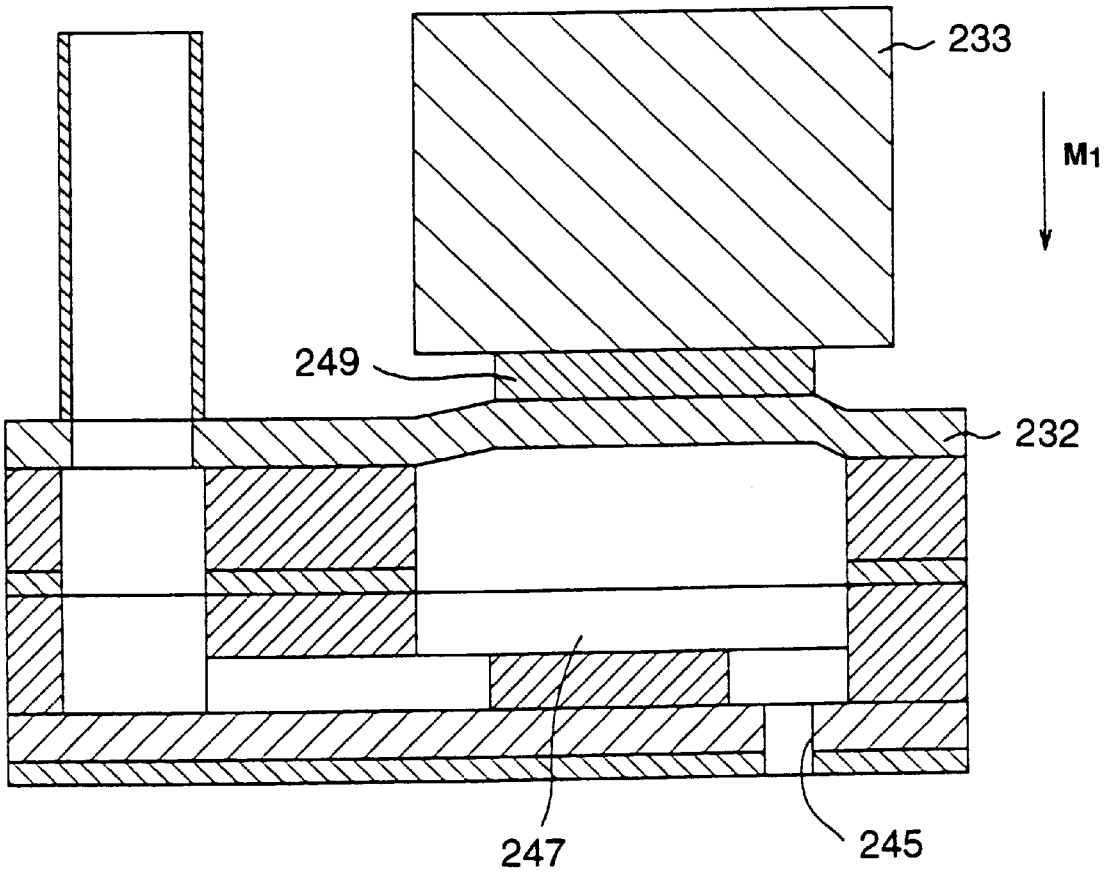
FIG. 27 is a schematic sectional view of the main part showing a state in which the volume of an ink pressure chamber is increased in further another example of the print head.

As the piezoelectric element 233 is provided with a property that the piezoelectric element is linearly displaced in the direction shown by the arrow $M_1$ in FIG. 27 when the application to the piezoelectric element of driving voltage is released, the piezoelectric element presses and curves the diaphragm 232 via the protruding portion 249 bonded to the piezoelectric element, decreases the volume of the pressure chamber 247 and increases pressure in the pressure chamber 247. At this time, as the protruding portion 249 is set so that the planar area is smaller than that of the piezoelectric element 233, the displacement of the piezoelectric element 233 can be transmitted to only a position of the diaphragm 232 corresponding to the pressure chamber 247.

Therefore, in case printing is made by the printer, first predetermined driving voltage is applied to the piezoelectric element 233. As described above, the piezoelectric element is displaced in the direction reverse to the direction shown by the arrow $M_1$ in FIG. 27 and the volume of the pressure chamber 247 is increased. As a result, when the displacement of the piezoelectric element 233 is finished after the meniscus of ink not shown formed at the end of the emission nozzle 245 once recedes on the side of the pressure chamber 247, the meniscus is stable in the vicinity of the end of the emission nozzle 245 because the meniscus is balanced with surface tension and the emission of ink is ready.

Next, when the application to the piezoelectric element 233 of driving voltage is released, the piezoelectric element 233 is displaced in the direction shown by the arrow $M_1$ in FIG. 27 to be restored to an original shape. As a result, the pressure chamber 247 is restored to an original size and as the pressure in the pressure chamber 247 is increased, ink is emitted from the emission nozzle 245. At this time, the change in time of driving voltage applied to the piezoelectric element 233 is set so that ink can be emitted from the emission nozzle 245.

(1-4) A method of Manufacturing the Ink Jet Print Head

Figure 28:
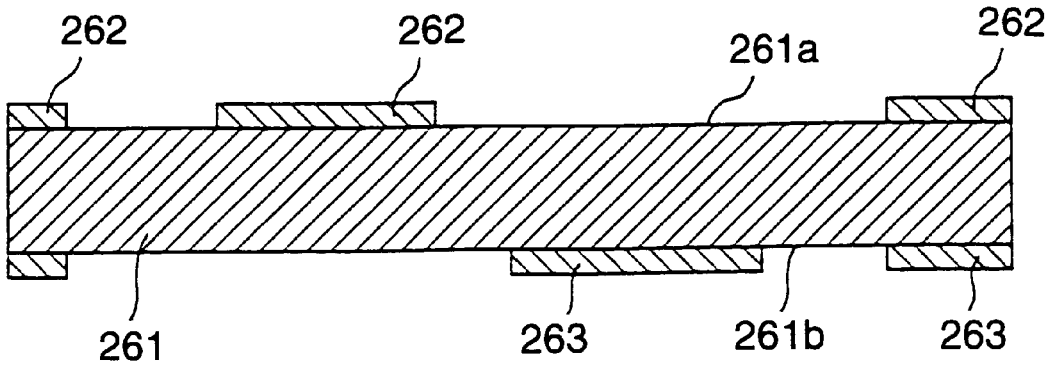
FIG. 28 shows further another embodiment of a method of manufacturing the print head in the order of processes and is a schematic sectional view of the main part showing a process for forming resist on a plate.

Next, a method of manufacturing the print head of the printer in this embodiment will be described. First, the second member of a pressure chamber forming part is formed. That is, as shown in FIG. 28, resist such as a photosensitive dry film and liquid resist is applied to one main surface 261*a* of a plate 261 consisting of stainless steel approximately 0.1 mm thick, parts corresponding to positions in which a through hole part for forming an ink buffer tank and a groove part for forming a pressure chamber are formed are exposed using a mask provided with a pattern which enables etching and a resist 262 is formed.

Also, parts corresponding to positions in which a groove part forming a liquid supply passage and a groove part for forming a nozzle leading hole are formed are similarly exposed using a mask provided with a pattern which enables etching and a resist 263 is also formed on a main surface 261*b* opposite to one main surface 261*a* of the plate 261.

Figure 29:
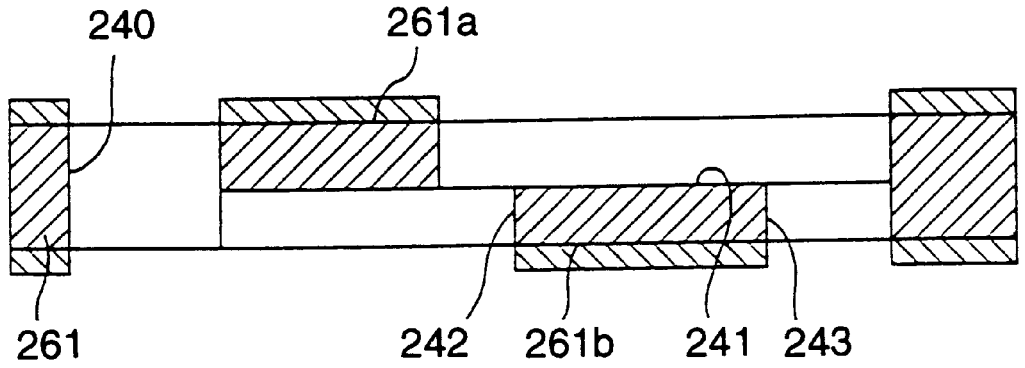
FIG. 29 shows further another example of the method of manufacturing the print head in the order of processes and is a schematic sectional view of the main part showing a state of etching.

Next, etching is made by dipping the above plate 261 in etchant such as aqueous solution of ferric chloride using the resists 262 and 263 as a mask for predetermined time. As a result, as shown in FIG. 29, the ink buffer tank is formed, the through hole part 240 which is through from one main surface 261*a* to the main surface 261*b* opposite to one main surface 261*a* and the pressure chamber are formed, the groove part 241 which is open on one main surface 261*a* and the liquid supply passage connecting the side of the through hole part 240 and the bottom of the groove part 241 are formed, the groove part 242 which is open on one main surface 261*b* and the nozzle leading hole are formed, and the through hole 243 which is through from the bottom of the groove part 241 to one main surface 261*b* is formed.

If etching is made as described above, etched quantity from each surface of opposite main surfaces 261*a* and 261*b* of the plate 261 is set so that it is approximately a little more than a half of the thickness of the plate. That is, in this embodiment, as the thickness of the plate 261 is set to 0.1 mm, etched quantity from one main surface of the plate 261 is approximately 0.055 mm. Hereby, the through hole part 240, the groove part 241, the groove part 242 and the through hole 243 can be formed stably, enhancing the dimensional precision of them.

Also, as etched quantity from each surface of the plate 261 is equal, an etching condition when the groove part 241 which is open on one main surface 261*a* is formed and an etching condition when the liquid supply passage is formed, the groove part 242 which is open on one main surface 261*b* and the nozzle leading hole are formed and the through hole 243 which is open on one main surface 261*b* is formed can be set to the same condition and as a result, an etching process can be readily executed for a short time.

The through hole 243 which functions as the above nozzle leading hole is formed so that the diameter is larger than that of a nozzle of an orifice plate formed in a postprocess in an extent that the above has no effect upon the increase of pressure in a pressure chamber if pressure is applied to the pressure chamber.

Figure 30:
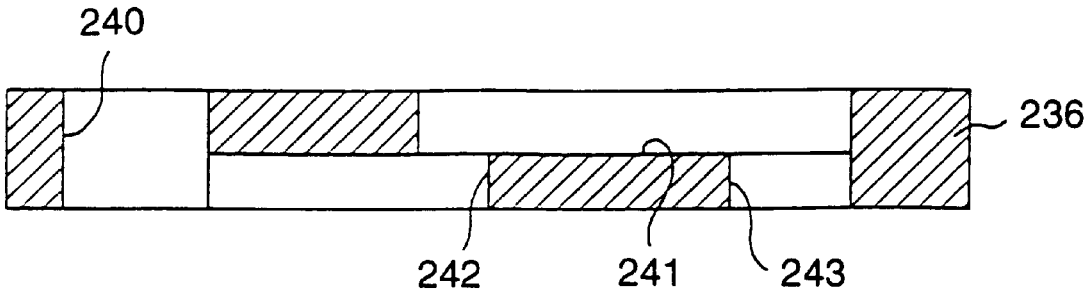
FIG. 30 shows further another example of the method of manufacturing the print head in the order of processes and is a schematic sectional view of the main part showing a process for forming a second member.

Next, the resists 262 and 263 are removed. If a dry film resist is used for the resists 262 and 263, the aqueous solution including sodium hydroxide by 5% or less for example is used and if liquid resist material is used for the resists 262 and 263, dedicated alkali solution is used. As a result, as shown in FIG. 30, the second member 236 in which the through hole part 240, the groove part 241, the groove part 242 and the through hole 243 are formed is formed.

Figure 31:
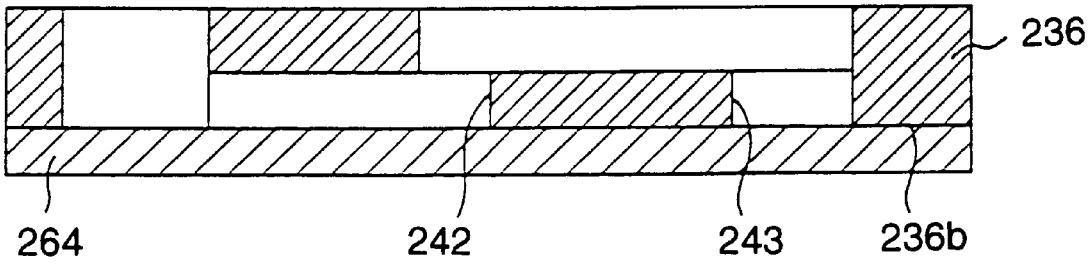
FIG. 31 shows further another example of the method of manufacturing the print head in the order of processes and is a schematic sectional view of the main part showing a process for arranging a plate on the second member.

Next, as shown in FIG. 31, a plate 264 which is to be an orifice plate is bonded on the side of one main surface 236*b* on which the groove part 242 forming a liquid supply passage and the through hole 243 forming a nozzle leading hole are open by thermocompression bonding. The plate 264 may be formed by Neoflex (trademark) manufactured by Mitsui Toatsu Chemical Industry the glass transition point of which is 250° C. or less for example and the thickness may be set to approximately 50 $\mu$m. For the condition of thermocompression bonding, it is desirable that pressurization temperature is set to approximately 230° C. and pressure is set to approximately 20 to 30 kgf/cm$^2$. The bond strength between the plate 264 and the second member 236 can be enhanced by thermocompression bonding as described above and they can be effectively bonded.

As described above, if the plate 264 and the second member 236 are bonded without forming a nozzle beforehand, precision for alignment is not required so much and bonding is facilitated. Further, in this embodiment, as the plate 264 and the second member 236 are bonded without using an adhesive, an adhesive is prevented from blocking the groove part 242 forming a liquid supply passage.

Figure 32:
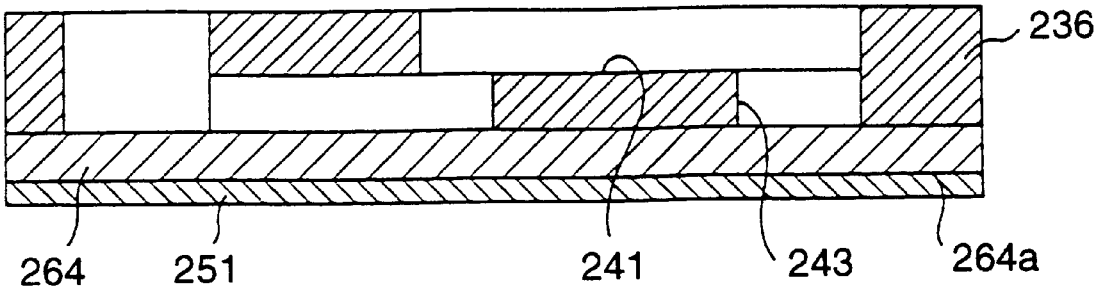
FIG. 32 shows further another example of the method of manufacturing the print head in the order of processes and is a schematic sectional view of the main part showing a process for forming a liquid repelling film.

Next, as shown in FIG. 32, liquid repelling processing is applied to one main surface 264*a* of the plate on the reverse side of the surface of the plate 264 opposite to the second member 236 and a liquid repelling film 251 is formed. The above liquid repelling film 251 repels ink, is formed to prevent ink from adhering around a nozzle formed in a postprocess and it is desirable that if a nozzle is formed by an excimer laser beam in the postprocess, the liquid repelling film is formed by material free from a burr and peeling. For such material, denatured polytetrafluoroethylene coating 958-207 (trademark) manufactured by Dupon for example in which fluorine material is dispersed in polyimide material, material the absorption coefficient of which is 0.4% or less of polyimide material, for example Upicoat FS-100L (trademark) manufactured by Ube Industries, Ltd. which is polyimide overcoat ink, Upifine FP-100 (trademark) manufactured by Ube Industries, Ltd. which is polyimide coating material and others can be given and further, polybenzimidazole provided with a liquid repelling property, for example NPBI (trademark) manufactured by Hoechst which is application-type polybenzimidazole material and others can be given.

Figure 33:
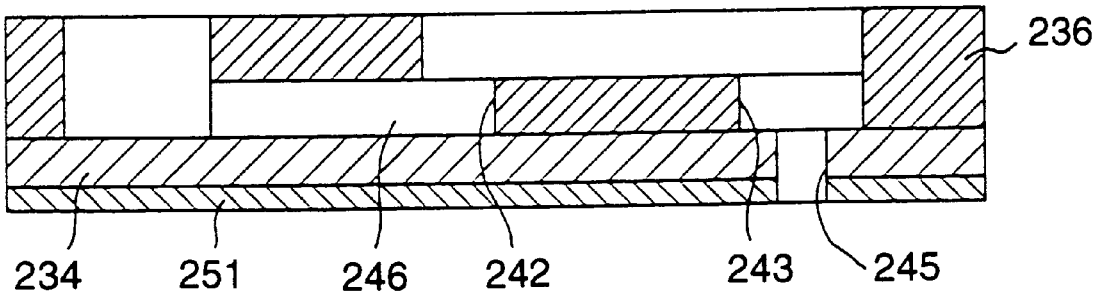
FIG. 33 shows further another example of the method of manufacturing the print head in the order of processes and is a sectional view showing a process for completing an orifice plate.

Next, a nozzle which is through the plate 264 is formed by perpendicularly radiating an excimer laser beam via the groove part 241 and the through hole 243 from the side of the second member 236 and the orifice plate 234 provided with the emission nozzle 245 in a position corresponding to the through hole 243 which functions as a nozzle leading hole shown in FIG. 33 is completed. At this time, it need scarcely be said that a hole communicating with the emission nozzle 245 is also formed in the liquid repelling film 251.

As a plate consisting of resin is used for the plate 264 which is to be the orifice plate 234 in a method of manufacturing a printer in this embodiment, workability by an excimer laser beam when a nozzle is formed is very satisfactory and the emission nozzle 245 is readily formed. Further, as the liquid repelling film 251 is also formed by material which is excellent in workability by an excimer laser beam, the hole communicating with the emission nozzle 245 is readily formed.

Also, as the diameter of the through hole 243 which functions as a nozzle leading hole is set so that it is larger than that of the emission nozzle 245, precision for aligning the through hole 243 and the emission nozzle 245 is loosened and the second member 236 is prevented from screening a laser beam in laser beam machining.

Further, the groove part 242 and the through hole 243 are closed by bonding the orifice plate 234 to the second member 236 as described above and the liquid supply passage 246 and the nozzle leading hole 248 are formed.

Figure 34:
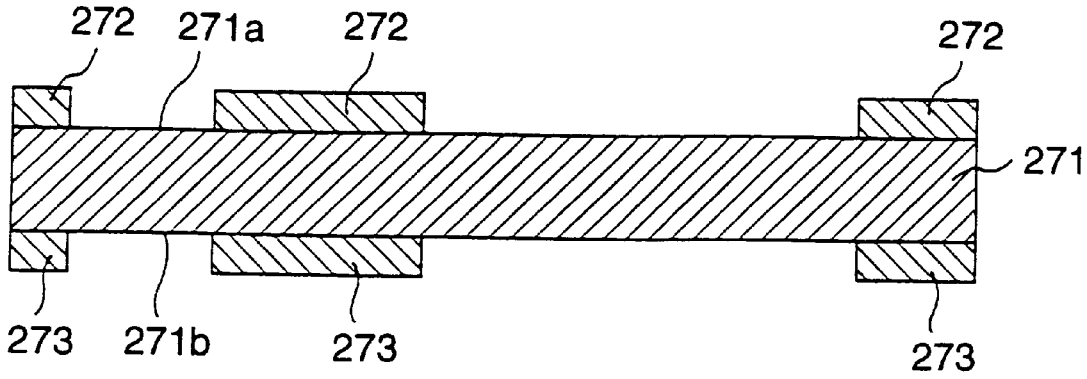
FIG. 34 shows further another example of the method of manufacturing the print head in the order of processes and is a schematic sectional view of the main part showing a process for forming resist on the plate.

Next, a first member of the pressure chamber forming part is formed. That is, as shown in FIG. 34, after resist such as a photosensitive dry film and liquid resist is applied to opposite main surfaces 271*a* and 271*b* of a plate 271 consisting of stainless steel approximately 0.1 mm thick, parts corresponding to positions in which a through hole part for forming an ink buffer tank and a through hole part for forming a pressure chamber are formed are exposed using a mask provided with a pattern which enables etching and resists 272 and 273 are formed.

Next, etching is made by dipping the above plate 271 in etchant such as aqueous solution of ferric chloride using the resists 262 and 263 as a mask for predetermined time.

Figure 35:
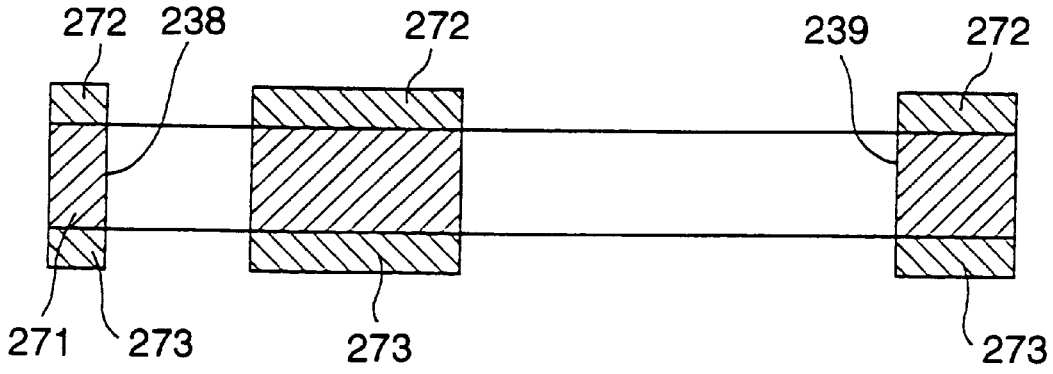
FIG. 35 shows further another example of the method of manufacturing the print head in the order of processes and is a schematic sectional view of the main part showing a state of etching.

As a result, as shown in FIG. 35, a through hole part 238 forming an ink buffer tank and a through hole 239 forming a pressure chamber are formed in a predetermined position of the plate 271.

At this time, etched quantity from each surface of opposite main surfaces 271*a* and 271*b* of the plate 271 is set so that it is approximately a little more than a half of the thickness of the plate 271. That is, in this embodiment, as the thickness of the plate 271 is set to 0.1 mm, etched quantity from one main surface of the plate 271 is approximately 0.055 mm. Hereby, dimensional precision between the through hole part 238 and the through hole part 239 can be enhanced and they can be formed stably.

Figure 36:
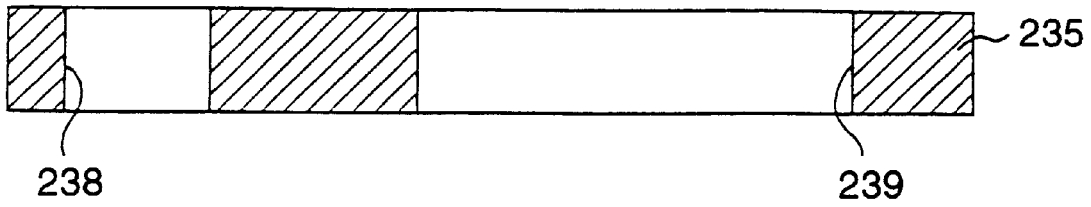
FIG. 36 shows further another example of the method of manufacturing the print head in the order of processes and is a schematic sectional view of the main part showing a process for forming a first member.

Next, the resists 272 and 273 are removed. If a dry film resist is used for the resists 272 and 273, the aqueous solution including sodium hydroxide by 5% or less for example is used and if liquid resist material is used for the resists 272 and 273, dedicated alkali solution is used. As a result, as shown in FIG. 36, a first member 235 in which the through hole part 238 and the through hole part 239 are formed is formed.

Figure 37:
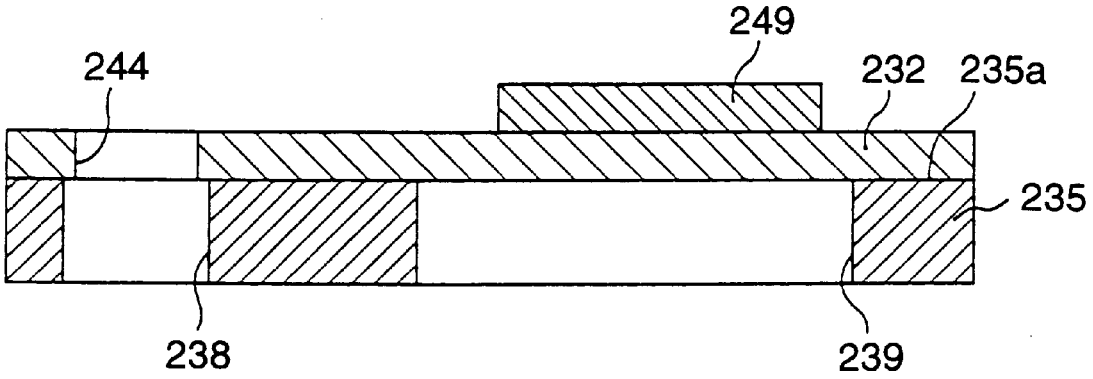
FIG. 37 shows further another example of the method of manufacturing the print head in the order of processes and is a schematic sectional view of the main part showing a process for arranging a diaphragm on the first member.

Next, as shown in FIG. 37, a diaphragm 232 is bonded on the main surface 235*a* on the side reverse to the surface of the first member 235 on which the first member and the second member are bonded by thermocompression bonding. The diaphragm 232 may be formed by Neoflex (trademark) manufactured by Mitsui Toatsu Chemical Industry the glass transition point of which is 250° C. or less for example and the thickness may be set to approximately 20 μm. The above diaphragm 232 is provided with a protruding portion 249 with planar area smaller than each planar area of a pressure chamber and a piezoelectric element laminated in a post-process in a position corresponding to the pressure chamber. The protruding portion 249 can be formed by etching a metallic foil film as in a process for forming a printed wiring board after forming metallic foil film material such as Cu and Ni approximately 18 μm thick for example on the above diaphragm 232 consisting of resin. It need scarcely be said that an ink supply port 244 the diameter of which is smaller than that of the through hole part and which communicates with the through hole part is formed in a position corresponding to the through hole part 238 which functions as an ink buffer tank in the diaphragm 232.

As a result, an adhesive layer which is a part of the diaphragm 232 and consists of thermoplastic resin is formed between the first member 235 and the diaphragm 232.

For the condition of thermocompression bonding, it is desirable that pressurization temperature is set to approximately 230° C. and pressure is set to approximately 20 to 30 kgf/cm$^2$. Bond strength between the diaphragm 232 and the first member 235 can be enhanced by such thermocompression bonding and they can be effectively bonded.

Figure 38:
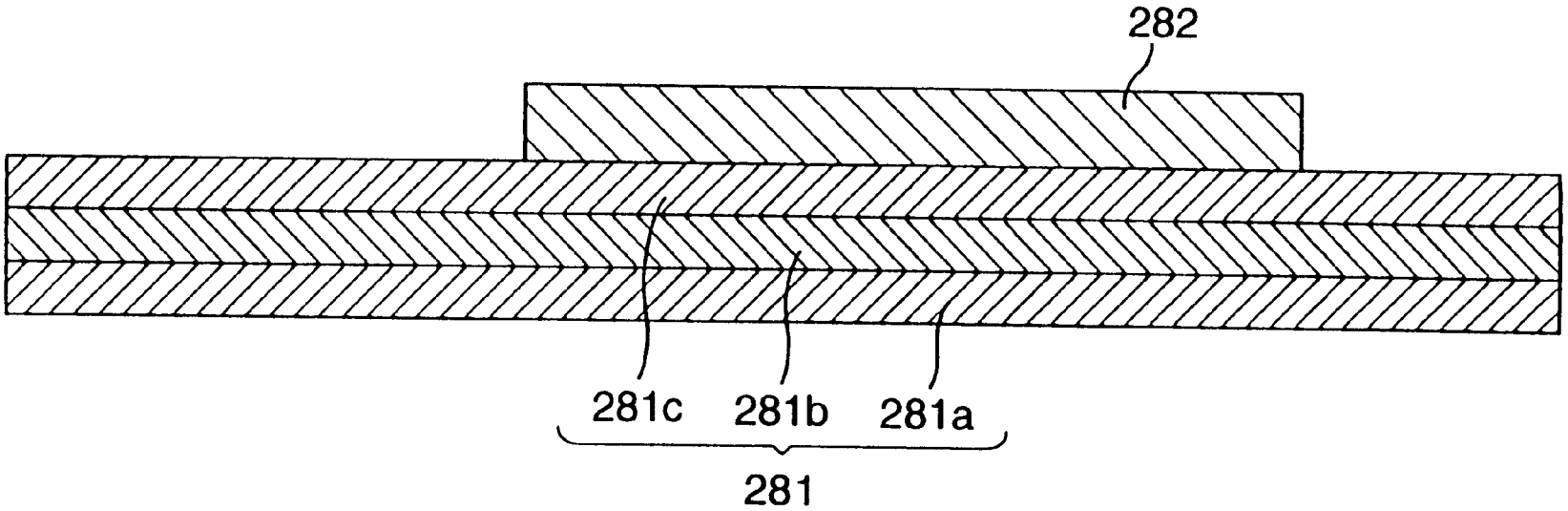
FIG. 38 shows further another example of the method of manufacturing the print head in the order of processes and is a schematic sectional view of the main part showing material for forming the diaphragm.

The diaphragm 232 provided with the protruding portion 249 can be further readily formed if the following material is used: For such material, as shown in FIG. 38, a metallic wrapping film (trademark) manufactured by Mitsui Toatsu Chemical Industry in which a metallic foil film 282 consisting of Cu with the thickness of approximately 18 μm is formed on a film 281 formed by Neoflex (trademark) manufactured by Mitsui Toatsu Chemical Industry which is approximately 20 μm thick and the glass transition point of which is 250° C. or less can be given. The above film 281 is constituted by laminating a first resin layer 281*a* the glass transition point of which is 250° C. or less and which shows an adhesive property in the range of the temperature of approximately 220 to 230° C., a second resin layer 281*b* that is polyimide material the glass transition point of which is 300° C. or more and which does not show an adhesive property at temperature below 300° C. and a third resin layer 281*c* the glass transition point of which is 300° C. or less and which shows an adhesive property in the range of the temperature of approximately 270 to 280° C., and the metallic foil film 282 is bonded onto the third resin layer 281*c*. As an adhesive which is softened at relatively low temperature is not used in the material, the protruding portion 249 can be formed on the diaphragm 232 as heat-resistant structure.

Figure 39:
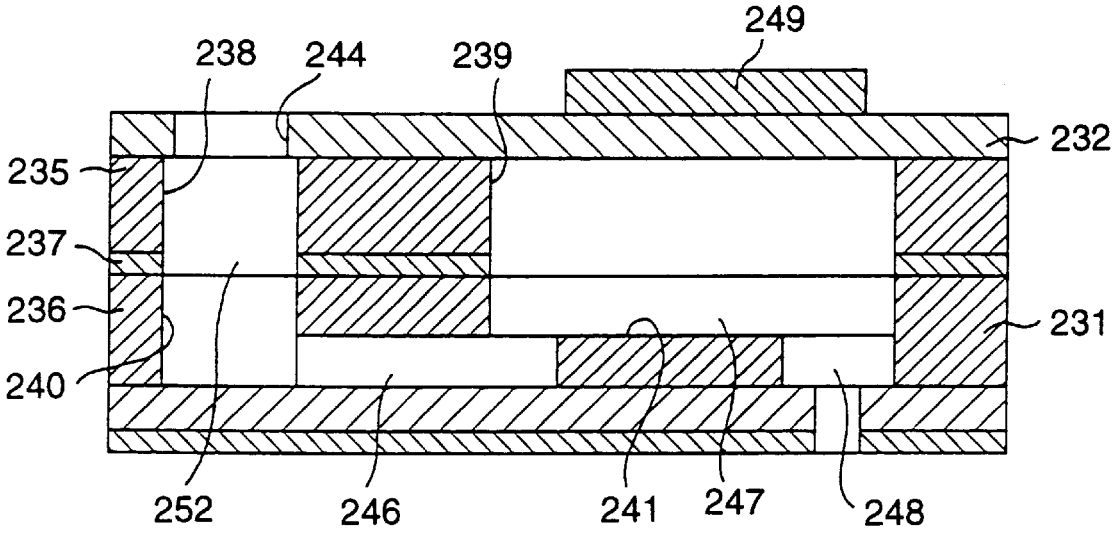
FIG. 39 shows further another example of the method of manufacturing the print head in the order of processes and is a schematic sectional view of the main part showing a process for bonding the first member and a second member.

Next, the first member 235 and the second member 236 are bonded by thermosetting resin. That is, the first member 235 and the second member 236 are bonded by an adhesive layer 237 consisting of thermosetting resin with the through hole part 238 and the through hole part 240 aligned and with the through hole part 239 and the groove part 241 aligned as shown in FIG. 39 and the pressure chamber forming part 231 is completed.

The ink buffer tank 252 in which both ends of the through hole part 238 and the through hole part 240 are covered is formed and the pressure chamber 247 consisting of the through hole part 239 and the groove part 241 is formed respectively by bonding the first member 235 and the second member 236 as described above. As a result, the ink buffer tank 252, the liquid supply passage 246, the pressure chamber 247 and the nozzle leading hole 248 are continuously formed.

Next, the piezoelectric element 233 is bonded to the protruding portion 249 using an epoxy adhesive for example, the ink supply pipe 250 is connected to the ink supply port 244 of the diaphragm 232 and the print head shown in FIG. 25 is completed.

In the method of manufacturing the print head in this embodiment, as the diaphragm 232 is bonded to the first member 235 beforehand by thermoplastic resin, the orifice plate 234 is bonded to the second member 236 beforehand and afterward, the first member 235 and the second member 236 respectively constituting the pressure chamber forming part 231 are bonded by an adhesive layer 237 consisting of thermosetting resin, the thermoplastic resin bonding the first member 235 and the diaphragm 232 is not influenced in the bonding process, no heat and nothing are applied to the liquid repelling film 251 of the orifice plate 234 bonded to the second member 236 and a range in which a liquid repelling film is selected is widened.

(1-5) Effect in the First Embodiment

Therefore, in the printer in this embodiment, as the diaphragm 232 and the pressure chamber forming part 231 are bonded by thermoplastic resin in the print head, the bond strength of the diaphragm 232 is secured, as the liquid repelling film 251 is not influenced by heat, heat resistance is not required for the liquid repelling film 251 so much, a liquid repelling film provided with liquid repelling performance according to an actual service condition can be used as the liquid repelling film 251, a range in which the liquid repelling film 251 is selected can be widened and productivity is improved.

Also, in the printer in this embodiment, as the groove part 242 forming the liquid supply passage 246 is formed on the side of the orifice plate 234 in the print head, the above groove part 242 is prevented from being blocked by an adhesive in a process for bonding the second member 236 and the first member 235, resistance to a flow in the liquid supply passage 246 caused by blockade by an adhesive can be prevented from being increased and high reliability can be obtained.

Further, in the printer in this embodiment, as the liquid supply passage 246 is formed on the side of the orifice plate 234 in the print head, a range in which thermoplastic resin bonding the diaphragm 232 and the first member 235 is selected, in this case the range of material for forming the diaphragm 232 is widened and productivity is improved.

Furthermore, in the printer in this embodiment, the first member 235 and the second member 236 respectively constituting the pressure chamber forming part 231 are bonded by thermosetting epoxy resin for example in the print head, however, as these first and second members 235 and 236 are both provided with mechanical rigidity, compared with the diaphragm 232, a warp caused in bonding can be prevented without applying pressure so much in bonding.

That is, in the printer in this embodiment, the first member 235 and the second member 236 are readily bonded without increasing temperature and pressure so much in the print head, the constraint of a range in which an adhesive used in bonding is selected is decreased, the deterioration of the performance of the liquid repelling film is reduced, the occurrence of failure in a process such as the liquid repelling film adheres to a bonding jig can be also decreased and productivity is enhanced.

Further, in the printer in this embodiment, the pressure chamber forming part 231 is formed by stainless steel in the print head, the orifice plate 234 is formed by resin and the deformation of the orifice plate 234 in case pressure is applied to the pressure chamber 247 can be reduced, compared with a case that both the pressure chamber forming part and the orifice plate are formed by resin. Also, in this embodiment, as the second member 236 also exists in the lower part of the pressure chamber 247, ink can be stably emitted from the emission nozzle 245.

(2) Second Embodiment

In this embodiment, an example in which the present invention is applied to a "carrier jet" printer wherein ink is a quantity determined medium, a diluent solvent is an emitted medium, ink is mixed with a diluent solvent and emitted, that is, an embodiment corresponding to the fourth invention will be described.

(2-1) Constitution of the "Carrier Jet" Printer

The overall constitution of the "carrier jet" printer in this embodiment is to be described, however, as the overall constitution is the same as in the second embodiment of the embodiments corresponding to the above first and second inventions, the description is omitted. That is, in the "carrier jet" printer in this embodiment, a "carrier jet" print head described later is used in place of the above print head 81. As the same controlling section as the above controlling section is also used in the "carrier jet" printer in this embodiment, the description is also omitted.

Figure 40:
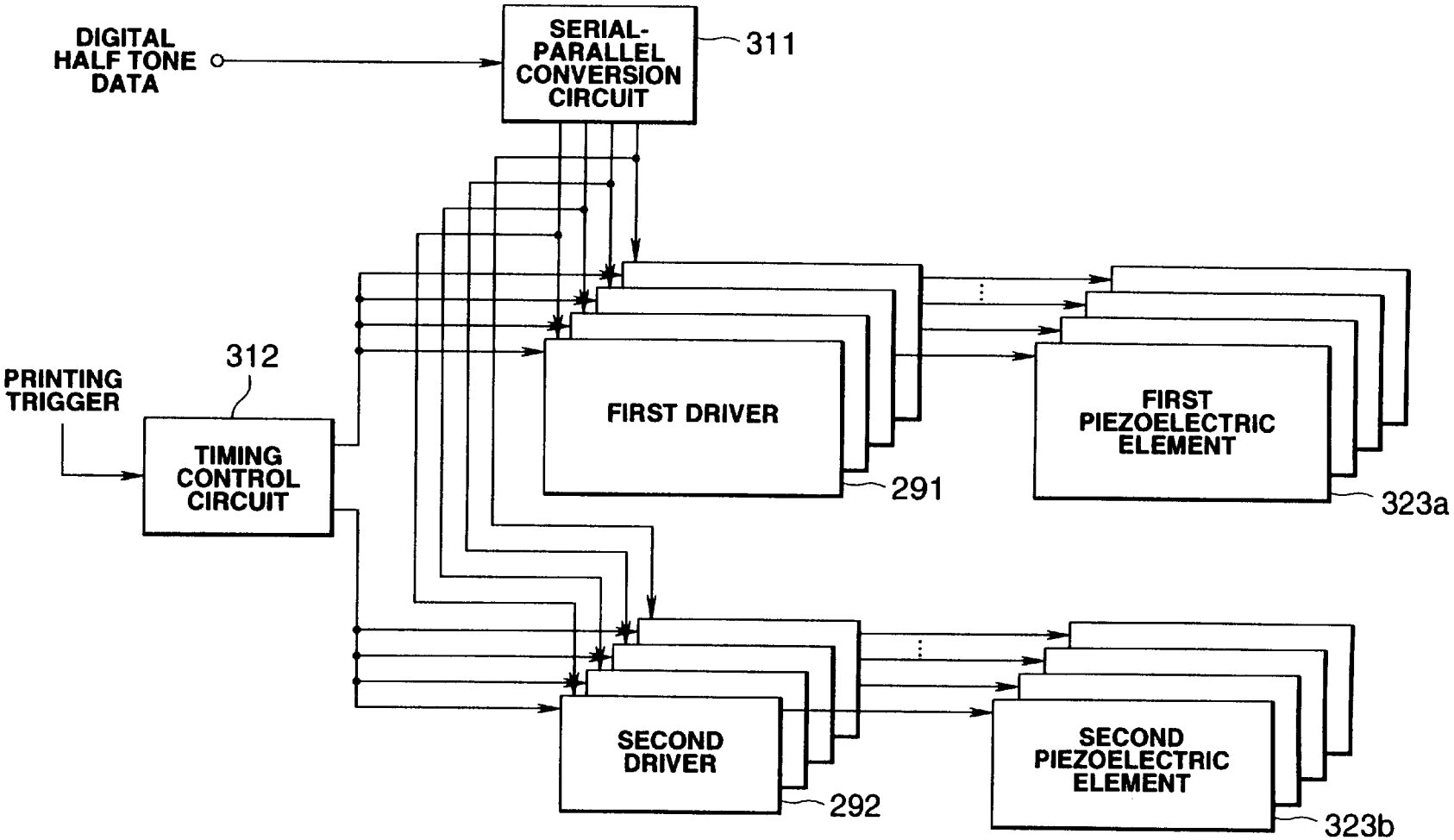
FIG. 40 is a circuit block diagram showing a circuit for driving a print head.

FIG. 40 shows a driving circuit in case the "carrier jet" print head is used. That is, digital halftone data is supplied from another block and sent to a first driver 291 and a second driver 292 by a serial-parallel conversion circuit 311. If the digital halftone data sent by the serial-parallel conversion circuit 311 is a predetermined threshold or less, the determination of quantity and emission are not performed. At printing timing, a printing trigger is output from another block, a timing control circuit 312 detects the output printing trigger, and a quantity determined part control signal and an emission control signal are respectively output to the first driver 291 and the second driver 292 at predetermined timing.

(2-2) Constitution of the "Carrier Jet" Print Head

Next, the constitution of the "carrier jet" print head of the "carrier jet" printer in this embodiment will be described. The print head in this embodiment is mainly constituted by a pressure chamber forming part 321, a diaphragm 322, first and second piezoelectric elements 323*a* and 323*b* which are respectively a laminated piezoelectric element and an orifice plate 324.

The above pressure chamber forming part 321 is formed by bonding a first member 325 and a second member 326 by an adhesive layer 127. These first and second members 325 and 326 may be formed by stainless steel approximately 0.1 mm thick for example. First, for the first member 325, it is a plate member provided with a through hole part 328 constituting an ink buffer tank in a predetermined position and a through hole part 329 constituting a second pressure chamber and provided with a through hole part 338 constituting a diluent solvent buffer tank in a predetermined position and a through hole part 339 constituting a first pressure chamber. In the above first member 325, the through hole parts 329 and 339 are formed in the vicinity of approximately the center at a predetermined interval, and the through hole parts 328 and 338 are respectively formed with the through hole parts 329 and 339 put between the through hole parts 328 and 338 respectively at a predetermined interval from these through hole parts 329 and 339.

In the meantime, the second member 326 is also a plate member, a through hole part 330 communicating with the through hole part 328 and forming an ink buffer tank is formed in a position corresponding to the above through hole part 328 forming an ink buffer tank, and a groove part 331 communicating with the through hole part 329 and forming a pressure chamber is formed in a position corresponding to the above through hole part 329 forming the second pressure chamber so that the groove part is open on one main surface 326*a*. Also, in the second member 326, a through hole part 340 communicating with the through hole part 338 and forming a diluent solvent buffer tank is formed in a position corresponding to the above through hole part 338 forming the diluent solvent buffer tank and a groove part 341 communicating with the through hole part 339 and forming the first pressure chamber is formed in a position corresponding to the above through hole part 339 forming the first pressure chamber so that the groove part is open on one main surface 326*a*.

Further, in the second member 326, a groove part 332 connecting the side of the above through hole part 330 and the bottom of the above groove part 331 and forming a second liquid supply passage is formed so that the groove part is open on one main surface 326*b* on the side reverse to one main surface 326*a* which is opposite to the first member 325, and a through hole 333 forming a second nozzle leading hole is formed so that the through hole is through from the bottom of the groove part 331 to one main surface 326*b*. Furthermore, in the second member 326, a groove part 342 connecting the side of the above through hole part 340 and the bottom of the above groove part 341 and forming a first liquid supply passage is formed so that the groove part is open on one main surface 326*b* on the side reverse to one main surface 326*a* which is opposite to the first member 325, and a through hole 343 forming a first nozzle leading hole is formed so that the through hole is through from the bottom of the groove part 341 to one main surface 326*b*.

In the print head in this embodiment, the diaphragm 322 is arranged on the side of the first member 325 of the above pressure chamber forming part 321, the orifice plate 324 is arranged on the side of the second member 326 and the pressure chamber forming part 321 is held between the diaphragm 322 and the orifice plate 324 in the direction of the thickness. The above diaphragm 322 may be formed by Neoflex (trademark) manufactured by Mitsui Toatsu Chemical Industry which is excellent in heat resistance and resistance to a chemical and the glass transition point of which is 250° C. or less for example and the thickness may be set to approximately 20 $\mu$m. In the above diaphragm 322, an ink supply port 334 with smaller diameter than that of the through hole part 328 is formed in a position corresponding to the through hole part 328 which functions as an ink buffer tank and a diluent solvent supply port 354 with smaller diameter than that of the through hole part 338 is formed in a position corresponding to the through hole part 338 which functions as a diluent solvent buffer tank.

In the meantime, the orifice plate 324 may be formed by Neoflex (trademark) manufactured by Mitsui Toatsu Chemical Industry which is excellent in heat resistance and resistance to a chemical and the glass transition point of which is 250° C. or less for example and the thickness may be set to approximately 50 μm. If such material is used, chemical stability is secured and it is desirable. Further, in the above orifice plate 324, a quantity determining nozzle 335 with smaller diameter than that of the through hole 333 is formed in a position corresponding to the through hole 333 which functions as the second nozzle leading hole and an emission nozzle 355 with smaller diameter than that of the through hole 343 is formed in a position corresponding to the through hole 343 which functions as the first nozzle leading hole. These quantity determining nozzle 335 and the emission nozzle 355 may be formed as a hole the section of which is circular for example, it is desirable to put the respective ends of these openings close that for example, the emission nozzle 355 is formed in the direction of the thickness of the orifice plate and the quantity determining nozzle 335 is formed so that it gradually approaches the end of the opening of the emission nozzle 355.

That is, when the pressure chamber forming part 321 is put between the diaphragm 322 and the orifice plate 324 in the direction of the thickness, the through hole part 328, the through hole part 330, the groove part 332, the groove part 331, the through hole 329 and the through hole 333 are connected, a cavity formed as a result is closed by the diaphragm 322 and the orifice plate 324, and an ink buffer tank 352 formed in the direction of the thickness of the pressure chamber forming part 321 from the side of the diaphragm 322 to the side of the orifice plate 324, a second liquid supply passage 346 connected to the above ink buffer tank and formed in an in-plane direction of the pressure chamber forming part 321, a second pressure chamber 347 connected to the above second liquid supply passage and formed on the side of the diaphragm and a second nozzle leading hole 348 connected to the above second pressure chamber 347 and open on the side of the orifice plate 324 are sequentially formed.

As the ink supply port 334 is formed in the diaphragm 322 as described above and the quantity determining nozzle 335 is formed in the orifice plate 324, ink flows in the order of the ink supply port 334, the ink buffer tank 352, the second liquid supply passage 346, the second pressure chamber 347, the second nozzle leading hole 348 and the quantity determining nozzle 335.

Similarly, the through hole part 338, the through hole part 340, the groove part 342, the groove part 341, the through hole 339 and the through hole 343 are connected, a cavity formed as a result is closed by the diaphragm 322 and the orifice plate 324, and a diluent solvent buffer tank 362 formed in the direction of the thickness of the pressure chamber forming part 321 from the side of the diaphragm 322 to the side of the orifice plate 324, a first liquid supply passage 356 connected to the above diluent solvent buffer tank and formed in an in-plane direction of the pressure chamber forming part 321, a first pressure chamber 357 connected to the above first liquid supply passage and formed on the side of the diaphragm and a first nozzle leading hole 358 connected to the above first pressure chamber 357 and open on the side of the orifice plate 324 are sequentially formed.

Also, similarly, as the diluent solvent supply port 354 is formed in the diaphragm 322 and the nozzle 355 is formed in the orifice plate 324, ink flows in the order of the diluent solvent supply port 354, the diluent solvent buffer tank 362, the first liquid supply passage 356, the first pressure chamber 357, the first nozzle leading hole 358 and the emission nozzle 355.

Also, in the print head in this embodiment, a second protruding portion 349 is formed in a position corresponding to the second pressure chamber 347 on one main surface 322*a* on the side reverse to the surface of the diaphragm 322 which is bonded to the pressure chamber forming part 321 and a second piezoelectric element 323*b* is set via the second protruding portion 349. Further, a first protruding portion 359 is also formed in a position corresponding to the first pressure chamber 357 and a first piezoelectric element 323*a* is set via the first protruding portion 359. For the above first and second piezoelectric elements 323*a* and 323*b*, a piezoelectric element in which a piezoelectric member and a conductive member are alternately laminated can be given. At this time, the laminated number of each piezoelectric member and each conductive member is free.

These first and second protruding portions 359 and 349 are formed so that the respective planar areas are smaller than those of the first and second pressure chambers 357 and 347 and those of the first and second piezoelectric elements 323*a* and 323*b*. Further, an ink supply pipe 350 connected to an ink tank not shown is connected in a position corresponding to the ink supply port 334 on one main surface 322*a* of the above diaphragm 322 and a diluent solvent supply pipe 360 connected to a diluent solvent tank not shown is connected in a position corresponding to the diluent solvent supply port 354.

Furthermore, in the print head in this embodiment, a liquid repelling film 351 is formed on one main surface 324*a* which is a nozzle open face of the orifice plate 324.

Figure 42:
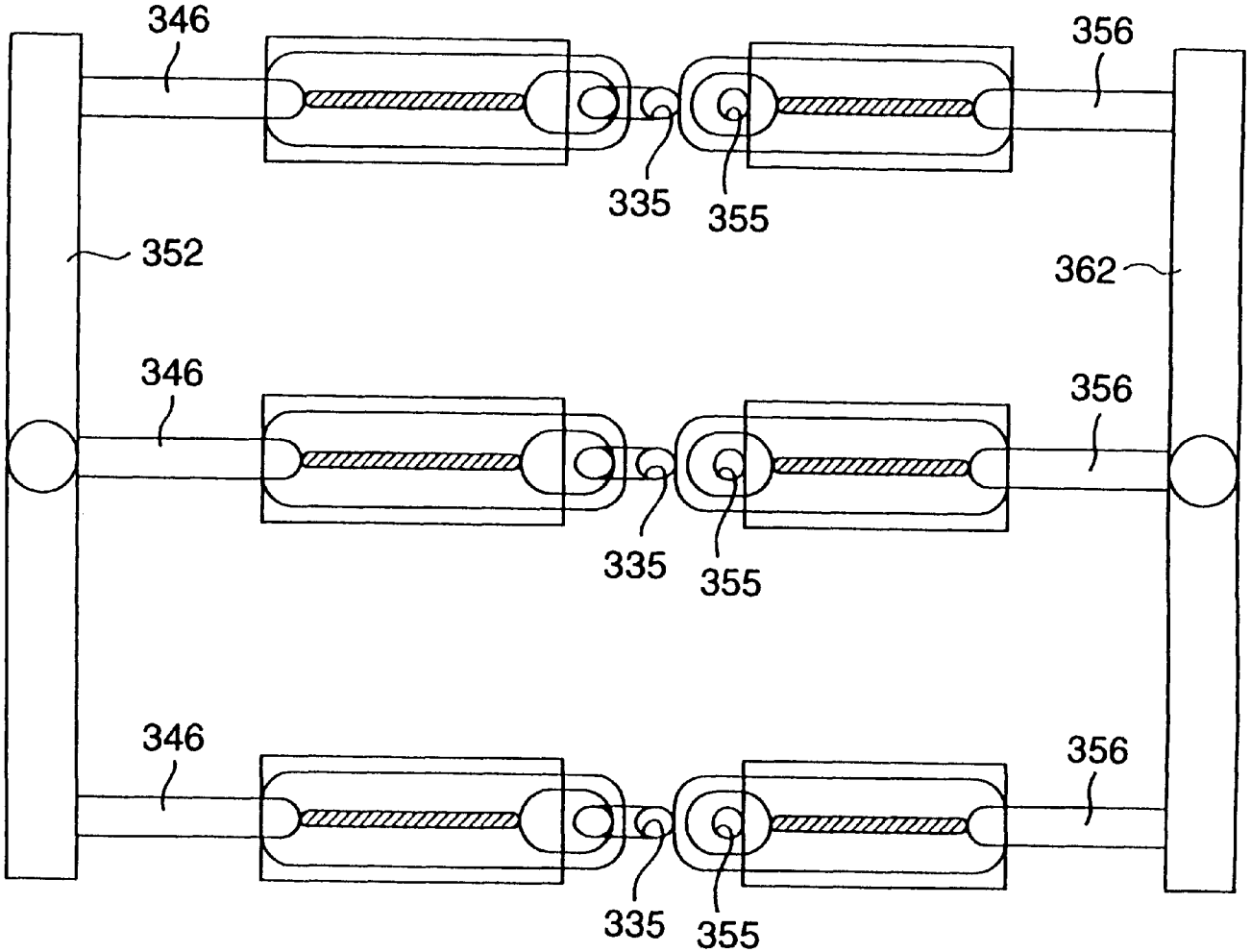
FIG. 42 is a schematic plan of the main part showing further another example of the print head.

In the printer in this embodiment, as schematically shown in FIG. 42, the ink buffer tank 352 and the diluent solvent buffer tank 362 in the print head are formed by a tubular member, plural print heads described above are arranged in parallel at a predetermined interval in the longitudinal direction of the ink buffer tank 352 and the diluent solvent buffer tank 362, the ink buffer tank 352 functions as an ink distribution pipe common to each print head and the diluent solvent buffer tank 362 also functions as a diluent solvent distribution pipe common to each print head. In these print heads, as the above print heads, the second liquid supply passage 346 is connected to the ink buffer tank 352 and the first liquid supply passage 356 is connected to the diluent solvent buffer tank 362. Therefore, the quantity determining nozzle 335 and the emission nozzle 355 in each print head are adjacent and open on one face.

That is, in the printer in this embodiment, ink is supplied from an ink tank not shown to the ink buffer tank 352, supplied from here to the second liquid supply passage 346 of each print head, in the meantime, a diluent solvent is also supplied from a diluent solvent tank not shown to the diluent solvent buffer tank 362 and supplied from here to the first liquid supply passage 356 of each print head.

Particularly in the printer in this embodiment, the diaphragm 322 and the pressure chamber forming part 321 of each print head are bonded by an adhesive layer consisting of thermoplastic resin.

Also, particularly in the printer in this embodiment, the orifice plate 324 of each print head is bonded to the pressure chamber forming part 321 by thermocompression bonding.

Further, particularly in the printer according to the present invention, the first member 325 and the second member 326 respectively constituting the pressure chamber forming part 321 are bonded by an adhesive layer 327 consisting of thermosetting resin as described above.

That is, in the printer in this embodiment, the adhesive layer 327 consisting of thermoplastic resin is formed between the pressure chamber forming part 321 and the diaphragm 322 and the bond strength of the diaphragm 322 to the pressure chamber forming part 321 is sufficiently secured.

(2-3) Operation in the Second Embodiment

Figure 43:
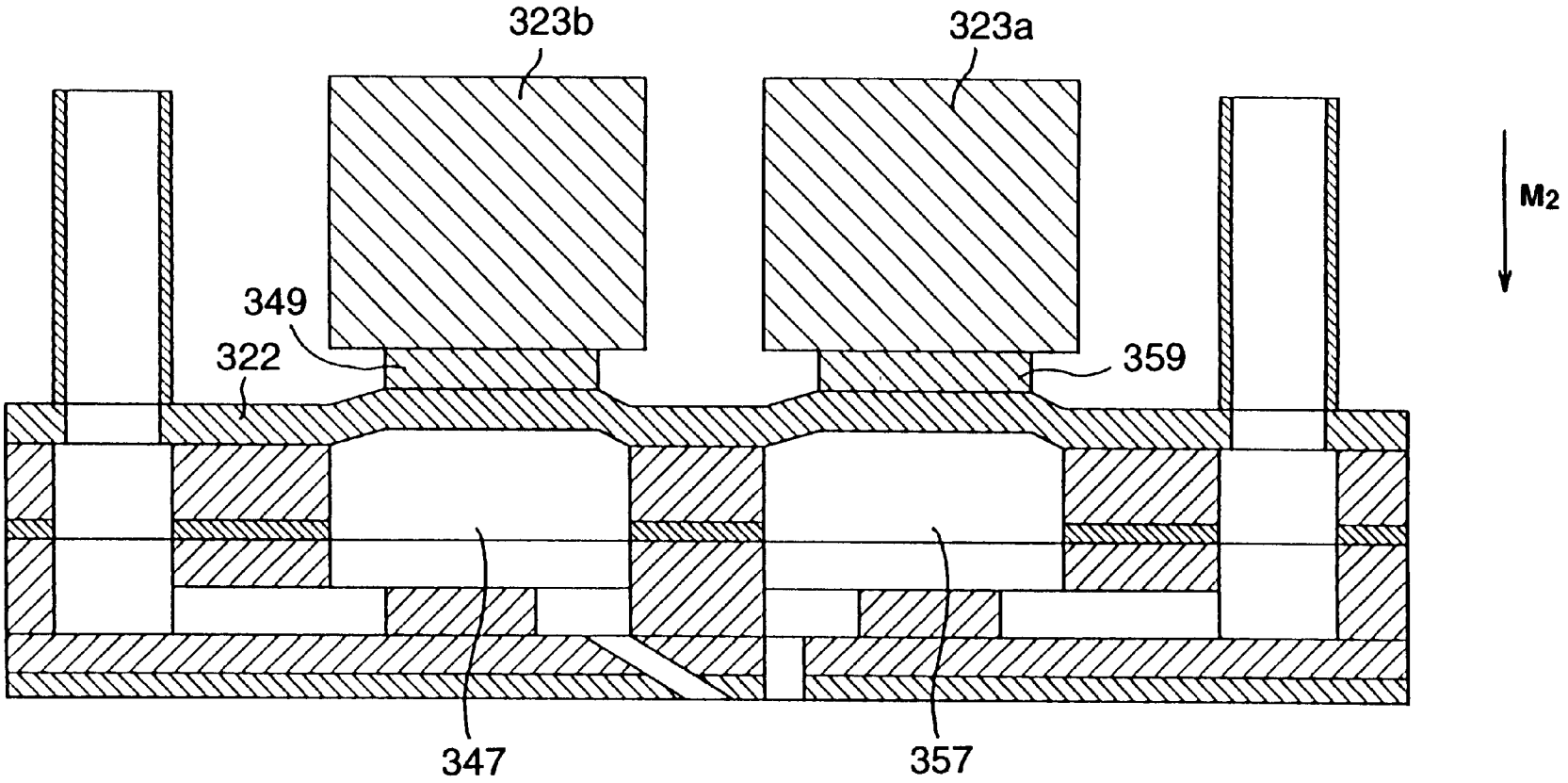
FIG. 43 is a schematic sectional view of the main part showing a state in which the volume of first and second pressure chambers is respectively increased in further another example of the print head.

The operation of the printer in this embodiment is as follows: That is, as the second piezoelectric element 323*b* used in the print head of the printer in this embodiment is provided with a property in which the second piezoelectric element is linearly displaced in a direction reverse to a direction shown by an arrow $M_2$ in FIG. 41 when driving voltage is applied to the second piezoelectric element, the second piezoelectric element lifts the diaphragm 322 with the second protruding portion 349 bonded to the second piezoelectric element as a center and as shown in FIG. 43, the volume of the second pressure chamber 347 is increased. This is also the same in the case of the first piezoelectric element 323*a* and as the first piezoelectric element is provided with a property in which the first piezoelectric element is linearly displaced in a direction reverse to the direction shown by the arrow $M_2$ in FIG. 41 when driving voltage is applied to the first piezoelectric element, the first piezoelectric element lifts the diaphragm 322 with the first protruding portion 359 bonded to the first piezoelectric element as a center and as shown in FIG. 43, the volume of the first pressure chamber 357 is increased.

Figure 41:
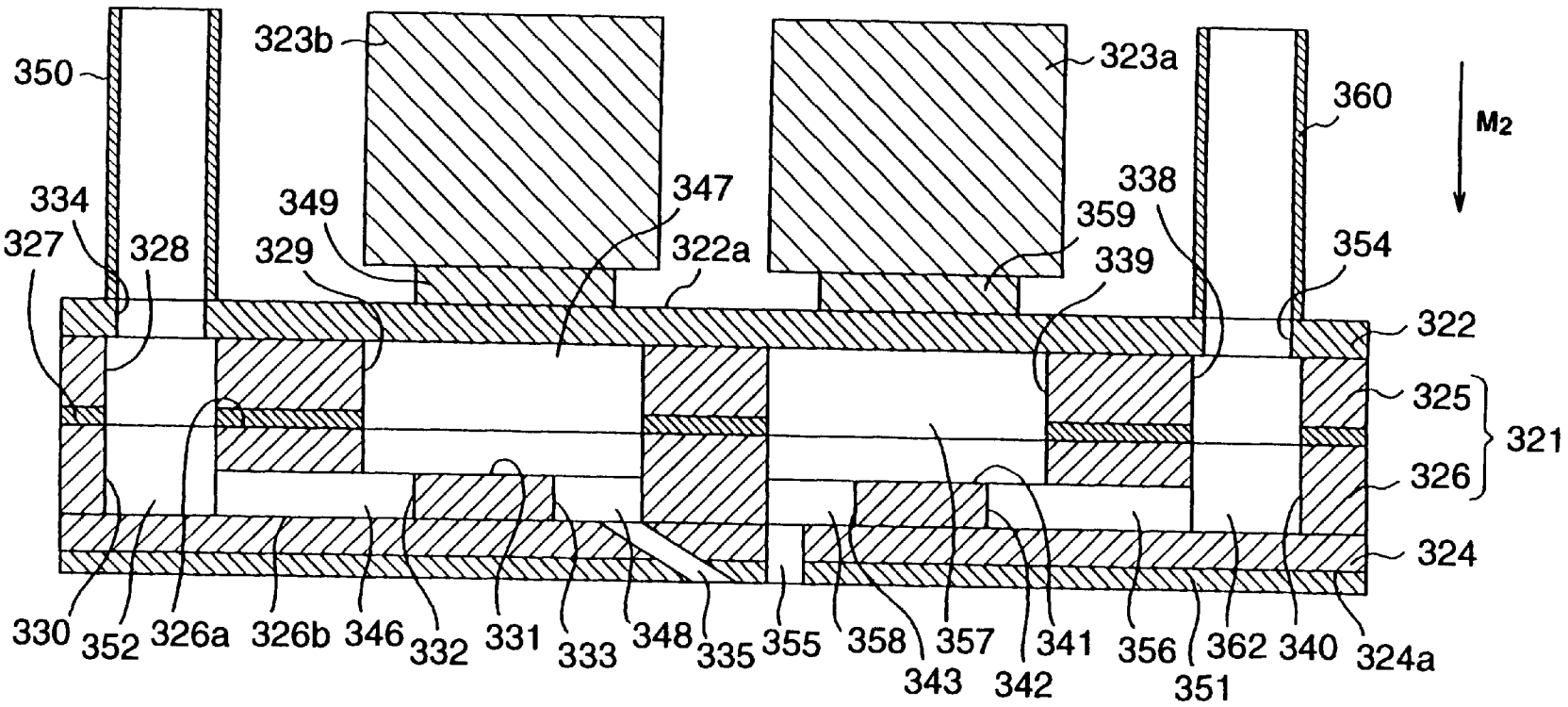
FIG. 41 is a schematic sectional view of the main part showing further another example of a print head.

As the first and second piezoelectric elements 323*a* and 323*b* are provided with a property that the piezoelectric elements are linearly displaced in the direction shown by the arrow $M_2$ in FIG. 41 when the application to the respective piezoelectric elements of driving voltage is released, the piezoelectric elements respectively press and curve the diaphragm 322 via the first and second protruding portions 359 and 349 respectively bonded to the piezoelectric elements, decrease the volume of the first or second pressure chamber 357 or 347 and increase pressure in the first or second pressure chamber 357 or 347. At this time, as the first and second protruding portions 359 and 349 are set so that the respective planar areas are smaller than those of the first and second piezoelectric elements 323*a* and 323*b*, the displacement of the first and second piezoelectric elements 323*a* and 323*b* can be transmitted to only a position of the diaphragm 322 corresponding to the first pressure chamber 357 or the second pressure chamber 347.

Figure 44A:
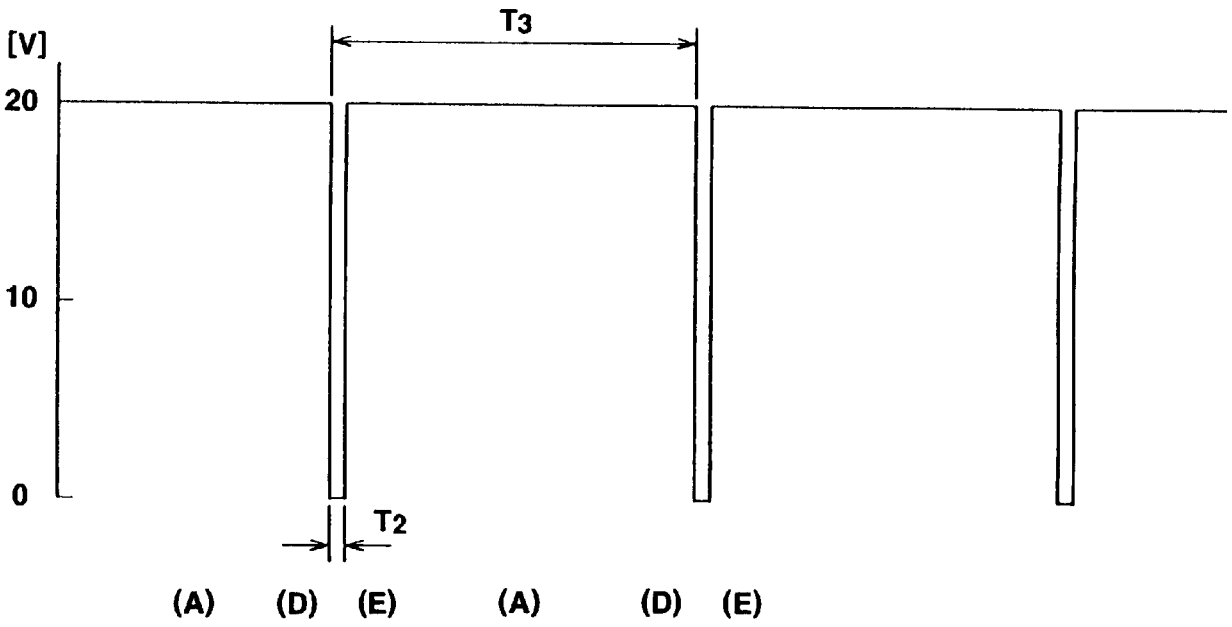
FIG. 44 is a chart showing timing in which voltage for driving the print head is applied.
Figure 44B:
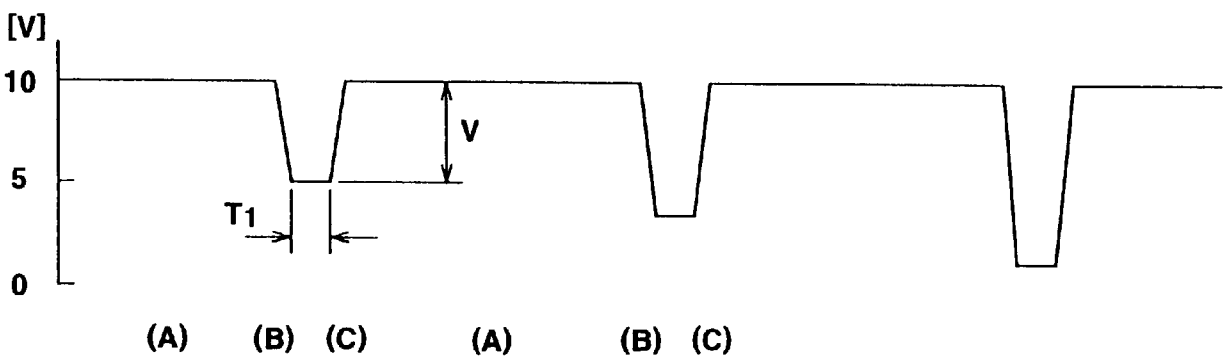

Next, FIG. 44 shows the timing of the application of driving voltage in case printing is made by the printer constituted as described above. FIG. 44 shows the timing of the application of driving voltage in case a piezoelectric element in so-called $d_{31}$ mode is used for the first and second piezoelectric elements 323*a* and 323*b*.

That is, as shown in FIG. 44(*a*), on standby before printing, for example the voltage of 20 V is applied to the first piezoelectric element 323*a* provided in a position corresponding to the first pressure chamber 357 beforehand at time shown by (A) in FIG. 44(*a*) and as shown in FIG. 44(*b*), on standby before printing, for example the voltage of 10 V is applied to the second piezoelectric element 323*b* provided in a position corresponding to the second pressure chamber 347 beforehand at the time shown by (A) in FIG. 44(*b*). As a result, as shown in FIG. 43, the volume of the second pressure chamber 347 and the first pressure chamber 357 is increased. At this time, a meniscus is formed at the respective ends of both the emission nozzle 355 and the quantity determining nozzle 335.

Figure 45:
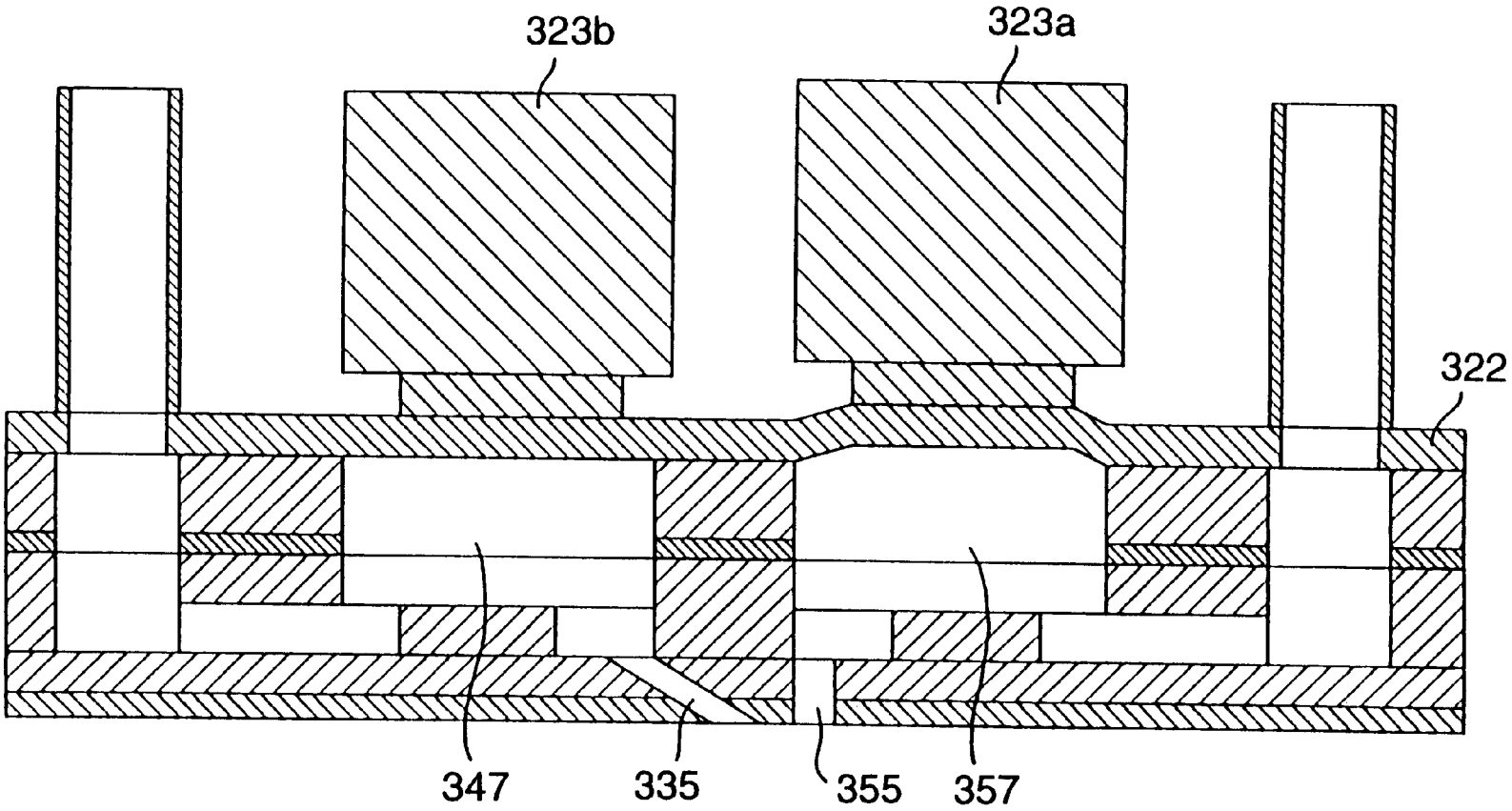
FIG. 45 is a schematic sectional view of the main part showing a state in which the volume of the second pressure chamber is restored in further another example of the print head.

In printing, the voltage of the second piezoelectric element 323*b* is gradually decreased up to 5 V for example at time shown by (B) in FIG. 44(*b*) so as to determine quantity according to a signal without emitting a quantity determined medium and in this state, the voltage is held for 150 μsec. for example. Then, the second piezoelectric element 323*b* is gradually extended in a direction shown by the arrow $M_2$ in FIG. 41, as shown in FIG. 45 the second pressure chamber 347 is gradually pressurized via the diaphragm 322, as the second pressure chamber 347 tries to be restored to an original state, internal pressure is applied to the quantity determining nozzle 335, ink percolates from outside the quantity determining nozzle 335 to the vicinity of the opening of the emission nozzle 355 and is mixed with a diluent solvent in the emission nozzle 355. Voltage at this time is set according to a scale of image data and the quantity of ink complies with image data.

Afterward, ink is drawn into the quantity determining nozzle 335 and the voltage of the second piezoelectric element 323*b* is gradually restored up to 10 V at time shown by (C) in FIG. 44(*b*) so as to leave only ink the quantity of which is determined in the vicinity of the opening of the emission nozzle 355. As a result, the second piezoelectric element 323*b* is gradually reduced in a direction reverse to the direction shown by the arrow $M_2$ in FIG. 41, the internal pressure of the quantity determining nozzle 335 is released and ink tries to return in the quantity determining nozzle 335. Hereby, only ink the quantity of which is determined is left in the vicinity of the opening of the emission nozzle 355.

Next, to emit a diluent solvent from the emission nozzle 355, as shown in FIG. 44(*a*), the voltage of the first piezoelectric element 323*a* is decreased up to 0 V for example at time shown by (D) in FIG. 44(*a*). As a result, the first piezoelectric element 323*a* is extended in the direction shown by the arrow $M_2$ in FIG. 41, the first pressure chamber 357 is pressurized via the diaphragm 322, as the first pressure chamber 357 tries to be restored to an original shape, internal pressure is applied to the emission nozzle 355. As a result, a diluent solvent is pushed out by internal pressure in the emission nozzle 355 and solution in which the diluent solvent and ink left in the vicinity of the opening of the emission nozzle 355 are mixed is formed.

Next, for example, for 50 μsec. from the time shown by (D) in FIG. 44(*a*), the voltage of the first piezoelectric element is held 0 V, when at time shown by (E) in FIG. 44(*a*) the voltage of the first piezoelectric element 323*a* is restored to 20 V for example, the piezoelectric element 323*a* is reduced in the direction reverse to the direction shown by the arrow $M_2$ in FIG. 41, the internal pressure of the emission nozzle 355 is released and a diluent solvent tries to return in the emission nozzle 355. Hereby, furrowing is made between a diluent solvent in the emission nozzle 355 and mixed solution, finally the mixed solution is emitted from the emission nozzle 355, the mixed solution is fixed on printing paper and printed.

The internal pressure of the first pressure chamber 357 and the second pressure chamber 347 is then restored, a diluent solvent and ink are respectively filled in the emission nozzle 355 and the quantity determining nozzle 335 again and the printer is on printing standby again.

However, ink quantity determining pulse length shown by an arrow $T_i$ in FIG. 44(*b*) between time shown by (B) in FIG. 44(*b*) and time shown by (C) in FIG. 44(*b*), diluent solvent emission pulse length shown by an arrow $T_2$ in FIG. 44(*a*) between time shown by (D) in FIG. 44(*a*) and time shown by (E) in FIG. 44(*a*) and ink quantity determining voltage shown by an arrow V in FIG. 44(*b*) are variable.

As shown in FIGS. 44(*a*) and (*b*), printing is executed by repeating the above operation and a printing cycle shown by an arrow $T_3$ in FIG. 44(*a*) may be set to 1 msec. for example.

That is, a signal from the driving circuit shown FIG. 40 is output at the above timing shown in FIG. 44 and according to the signal, predetermined voltage is applied to the first piezoelectric element 323*a* and the second piezoelectric element 323*b*.

(2-4) A method of Manufacturing the "Carrier Jet" Print Head

Figure 46:
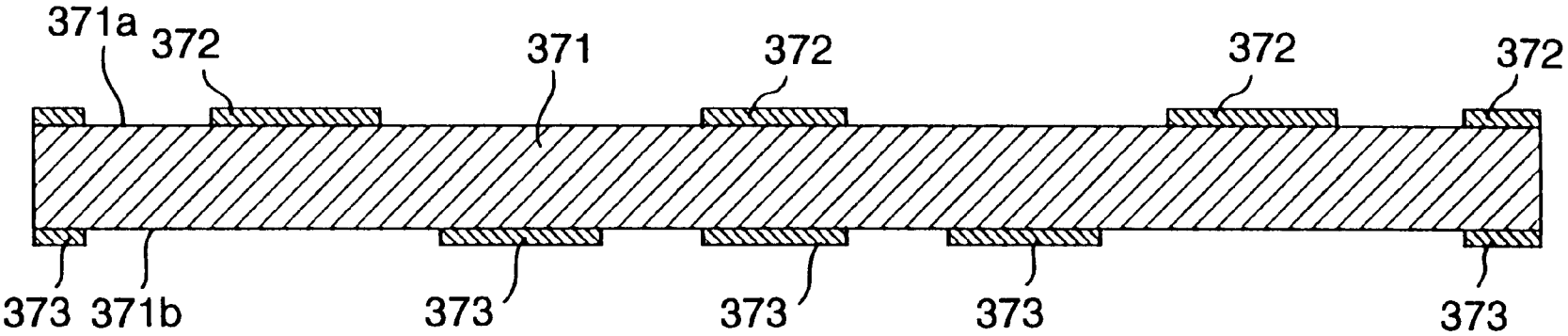
FIG. 46 shows further another embodiment of a method of manufacturing the print head in the order of processes and is a schematic sectional view of the main part showing a process for forming resist on a plate.

Next, a method of manufacturing the print head of the printer in this embodiment will be described. First, the second member of the pressure chamber forming part is formed. That is, as shown in FIG. 46, after resist such as a photosensitive dry film and liquid resist is applied to one main surface 371*a* of the plate 371 consisting of stainless steel approximately 0.1 mm thick, parts corresponding to positions in which through hole parts for forming an ink buffer tank and a diluent solvent buffer tank and groove parts for forming first and second pressure chambers are formed are exposed using a mask provided with a pattern which enables etching and resists 372 are formed.

Also, parts corresponding to positions in which groove parts for forming first and second liquid supply passages and through holes for forming first ad second nozzle leading holes are formed are exposed using a mask provided with a pattern which enables etching and resists 373 are also formed one main surface 371*b* opposite to one main surface 371*a* of the plate 371.

Figure 47:
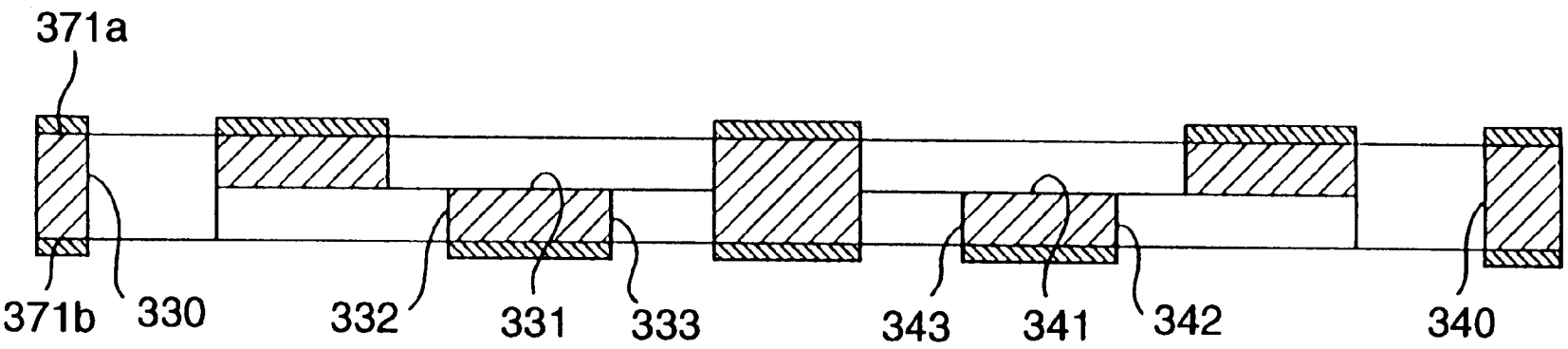
FIG. 47 shows further another example of the method of manufacturing the print head in the order of processes and is a schematic sectional view of the main part showing a state of etching.

Next, etching is made by dipping the above plate 371 in etchant such as aqueous solution of ferric chloride using the resists 372 and 373 as a mask for predetermined time. As a result, as shown in FIG. 47, the ink buffer tank is formed, the through hole part 330 which is through from one main surface 371*a* to the main surface 371*b* opposite to one main surface 371*a* and the second pressure chamber are formed, the groove part 331 which is open on one main surface 371*a* and the second liquid supply passage connecting the side of the through hole part 330 and the bottom of the groove part 331 are formed, the groove part 332 which is open on one main surface 371*b* and the second nozzle leading hole are formed, and the through hole 333 which is through from the bottom of the groove part 331 to one main surface 371*b* is formed. As shown in FIG. 47, the diluent solvent buffer tank is formed, the through hole part 340 which is through from one main surface 371*a* to the main surface 371*b* opposite to one main surface 371*a* and the first pressure chamber are formed, the groove part 341 which is open on one main surface 371*a* and the first liquid supply passage connecting the side of the through hole part 340 and the bottom of the groove part 341 are formed, the groove part 342 which is open on one main surface 371*b* and the first nozzle leading hole are formed, and the through hole 343 which is through from the bottom of the groove part 341 to one main surface 371*b* is formed.

If etching is made as described above, etched quantity from each surface of opposite main surfaces 371*a* and 371*b* of the plate 371 is set so that it is approximately a little more than a half of the thickness of the plate 371. That is, in this embodiment, as the thickness of the plate 371 is set to 0.1 mm, etched quantity from one main surface of the plate 371 is approximately 0.055 mm. Hereby, the through hole parts 330 and 340, the groove parts 331 and 341, the groove parts 332 and 342 and the through holes 333 and 343 can be formed stably, enhancing the dimensional precision of them.

Also, as etched quantity from each surface of the plate 371 is equal, an etching condition when the first and second pressure chambers are formed and the groove parts 341 and 331 which are open on one main surface 371*a* are formed and an etching condition when the first and second liquid supply passages are formed, the groove parts 342 and 332 which are open on one main surface 371*b* and the first and second nozzle leading holes are formed and the through holes 343 and 333 which are open on one main surface 371*b* are formed can be set to the same condition and as a result, an etching process can be readily executed for a short time.

The through hole 333 which functions as the above second nozzle leading hole and the through hole 343 which functions as the first nozzle leading hole are formed so that the respective diameters are larger than the diameter of the quantity determining nozzle or that of the emission nozzle of an orifice plate formed in a postprocess in an extent that the above has no effect upon the increase of pressure in the second pressure chamber or the first pressure chamber if pressure is applied to the second pressure chamber or the first pressure chamber.

Figure 48:
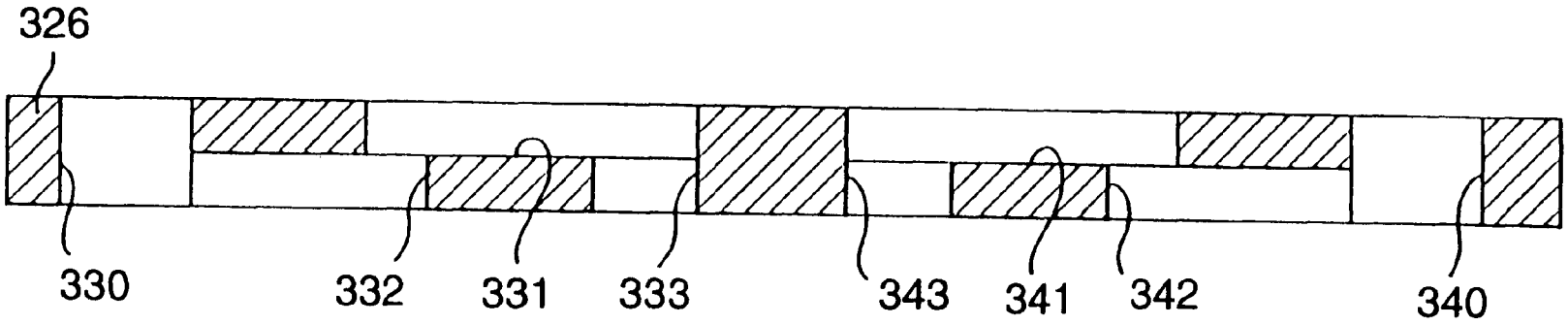
FIG. 48 shows further another example of the method of manufacturing the print head in the order of processes and is a schematic sectional view of the main part showing a process for forming a second member.

Next, the resists 372 and 373 are removed. If a dry film resist is used for the resists 372 and 373, the aqueous solution including sodium hydroxide by 5% or less for example is used and if liquid resist material is used for the resists 372 and 373, dedicated alkali solution for example is used. As a result, as shown in FIG. 48, the second member 326 in which the through hole parts 330 and 340, the groove parts 331 and 341, the groove parts 332 and 342 and the through holes 333 and 343 are formed is formed.

Figure 49:
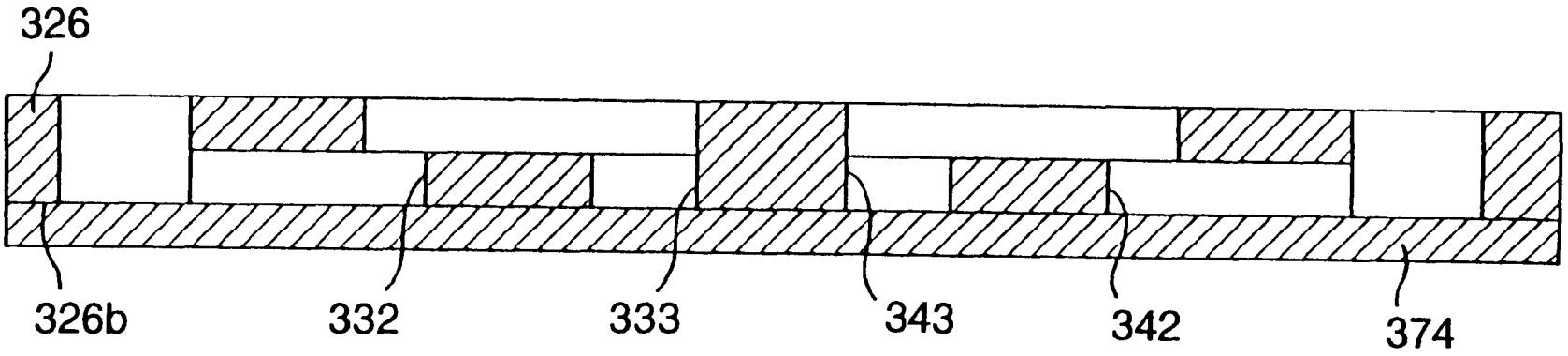
FIG. 49 shows further another example of the method of manufacturing the print head in the order of processes and is a schematic sectional view of the main part showing a process for arranging a plate on the second member.

Next, as shown in FIG. 49, a plate 374 which is to be an orifice plate is bonded on the side of one main surface 326*b* on which the groove part 332 forming a second liquid supply passage and the through hole 333 forming a second nozzle leading hole are open and the groove part 342 forming a first liquid supply passage and the through hole 343 forming a first nozzle leading hole are open by thermocompression bonding. The plate 374 may be formed by Neoflex (trademark) manufactured by Mitsui Toatsu Chemical Industry the glass transition point of which is 250° C. or less for example and the thickness may be set to approximately 50 $\mu$m. For the condition of thermocompression bonding, it is desirable that pressurization temperature is set to approximately 230° C. and pressure is set to approximately 20 to 30 kgf/cm$^2$. The bond strength between the plate 374 and the second member 326 can be enhanced by thermocompression bonding as described above and they can be effectively bonded and the plate and the second member can be effectively bonded.

As described above, if the plate 374 and the second member 326 are bonded without forming a nozzle beforehand, precision for alignment is not required so much and bonding is facilitated. Further, in this embodiment, as the plate 374 and the second member 326 are bonded without using an adhesive, an adhesive is prevented from blocking the groove parts 342 and 332 forming the first and second liquid supply passages.

Figure 50:
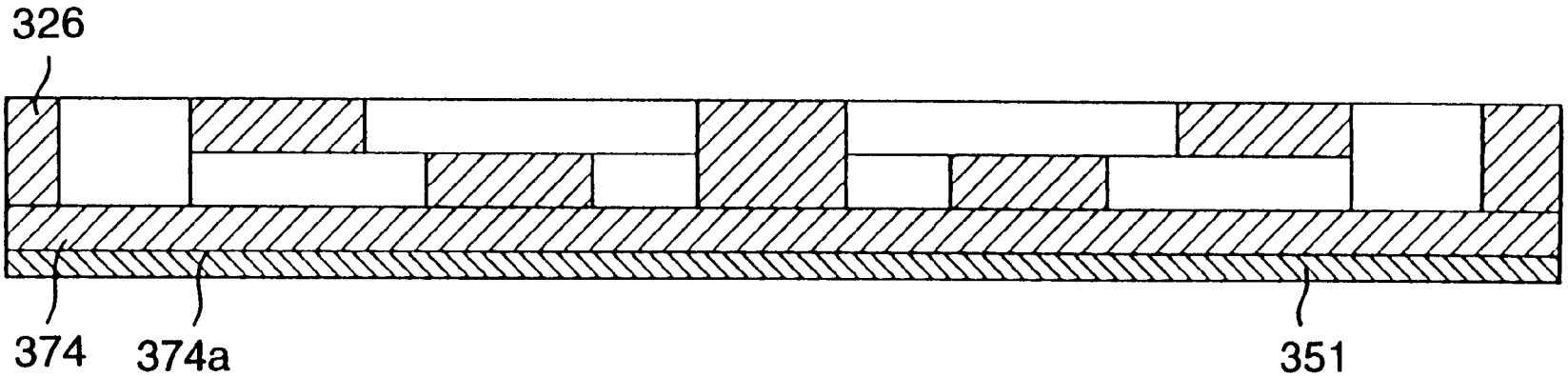
FIG. 50 shows further another example of the method of manufacturing the print head in the order of processes and is a schematic sectional view of the main part showing a process for forming a liquid repelling film.

Next, as shown in FIG. 50, liquid repelling processing is applied to one main surface 374*a* of the plate on the reverse side of the surface of the plate 374 opposite to the second member 326 and a liquid repelling film 351 is formed. The above liquid repelling film 351 repels ink and a diluent solvent, is formed to prevent ink or a diluent solvent from adhering around a nozzle formed in a postprocess and it is desirable that if a nozzle is formed by an excimer laser beam in the postprocess, the liquid repelling film is formed by material free from a burr and peeling. For such material, denatured polytetrafluoroethylene coating 958-207 (trademark) manufactured by Dupon for example in which fluorine material is dispersed in polyimide material, material the absorption coefficient of which is 0.4% or less of polyimide material, for example Upicoat FS-100L (trademark) manufactured by Ube Industries, Ltd. which is polyimide overcoat ink, Upifine FP-100 (trademark) manufactured by Ube Industries, Ltd. which is polyimide coating material and others can be given and further, polybenzimidazole provided with a liquid repelling property, for example NPBI (trademark) manufactured by Hoechst which is application-type polybenzimidazole material and others can be given.

Figure 51:
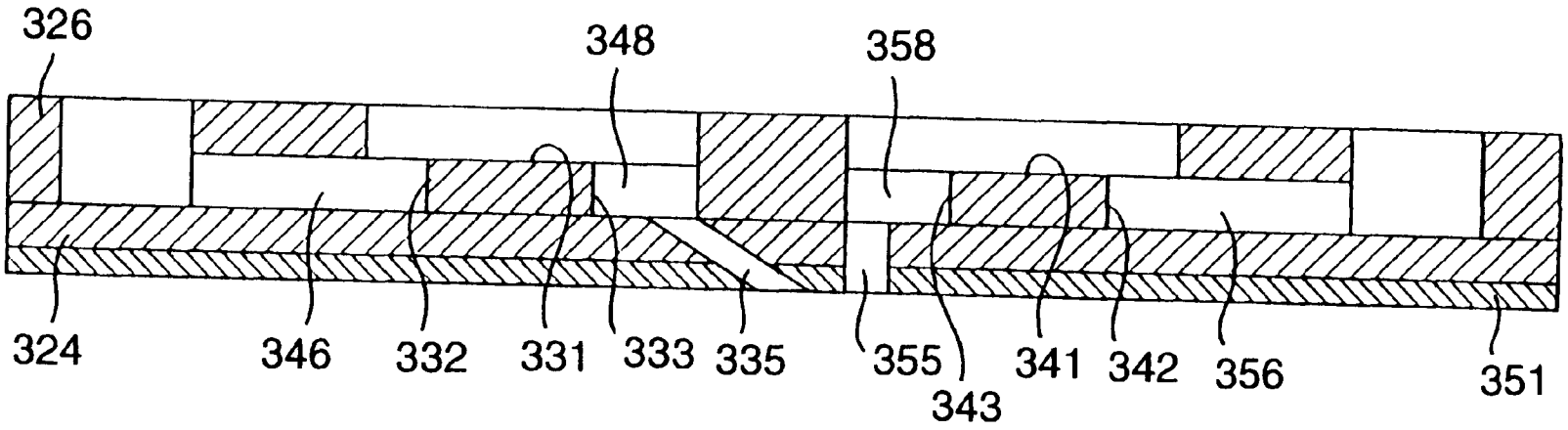
FIG. 51 shows further another example of the method of manufacturing the print head in the order of processes and is a sectional view showing a process for completing an orifice plate.

Next, an emission nozzle 355 which is through the plate 374 is formed by perpendicularly radiating an excimer laser beam via the groove part 341 and the through hole 343 from the side of the second member 326, similarly a quantity determining nozzle 335 which is through the plate 374 and the opening of which is adjacent to the emission nozzle 355 at a predetermined interval is formed by diagonally radiating an excimer laser beam via the groove part 331 and the through hole 333 from the side of the second member 326, and as shown in FIG. 51, the orifice plate 324 provided with the quantity determining nozzle 335 in a position corresponding to the through hole 333 which functions as a second nozzle leading hole and the emission nozzle 355 in a position corresponding to the through hole 343 which functions as a second nozzle leading hole is completed. At this time, it need scarcely be said that a hole which is to communicate with the quantity determining nozzle 335 and the emission nozzle 355 respectively is also formed in the liquid repelling film 351.

In the method of manufacturing the printer in this embodiment, as a plate consisting of resin is used for the plate 374 which functions as the orifice plate 324, workability by an excimer laser beam when a nozzle is formed is very satisfactory and the quantity determining nozzle 335 and the emission nozzle 355 are readily formed. Further, as the liquid repelling film 351 is also formed by material which is excellent in the workability by an excimer laser beam, a hole which is to communicate with the quantity determining nozzle 335 and the emission nozzle 355 respectively is readily formed.

As the through hole 333 which functions as a second nozzle leading hole is provided with a larger diameter than the diameter of the quantity determining nozzle 335 and the through hole 343 functions as a first nozzle leading hole is provided with a larger diameter than the diameter of the emission nozzle 355, precision required for aligning the through hole 333 and the quantity determining nozzle 335, and the through hole 343 and the emission nozzle 355 is relaxed, and the second member 326 is prevented from screening a laser beam in laser beam machining.

Further, by bonding the orifice plate 324 to the second member 326 as described above, the groove part 332 and the through hole 333 are closed, the second liquid supply passage 346 and the second nozzle leading hole 348 are formed, the groove part 342 and the through hole 343 are closed, and the first liquid supply passage 356 and the first nozzle leading hole 258 are formed.

Figure 52:
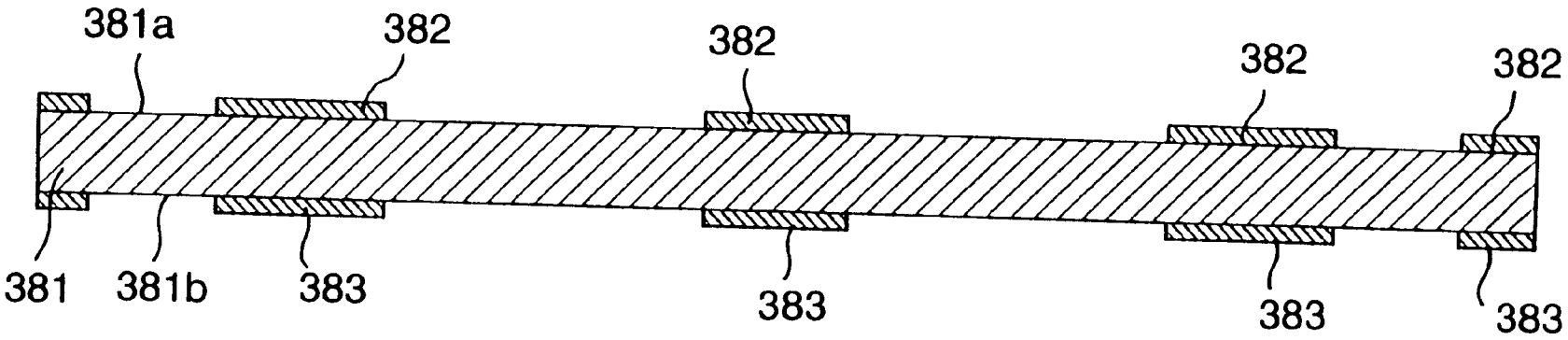
FIG. 52 shows further another example of the method of manufacturing the print head in the order of processes and is a schematic sectional view of the main part showing a process for forming resist on the plate.

Next, a first member of the pressure chamber forming part is formed. That is, as shown in FIG. 52, after resist such as a photosensitive dry film and liquid resist is applied to opposite main surfaces 381*a* and 381*b* of a plate 381 consisting of stainless steel approximately 0.1 mm thick, parts corresponding to positions in which through hole parts for forming an ink buffer tank and a diluent solvent buffer tank and through hole parts for forming first and second pressure chambers are formed are exposed using a mask provided with a pattern which enables etching and resists 382 and 383 are formed.

Next, etching is made by dipping the above plate 381 in etchant such as aqueous solution of ferric chloride for predetermined time using the resists 382 and 383 as a mask.

Figure 53:
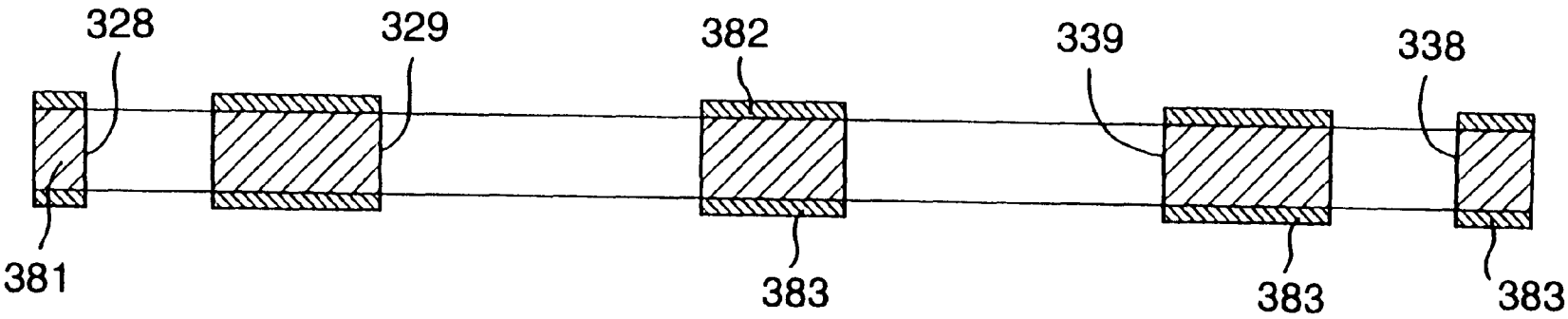
FIG. 53 shows further another example of the method of manufacturing the print head in the order of processes and is a schematic sectional view of the main part showing a state of etching.

As a result, as shown in FIG. 53, a through hole part 328 forming an ink buffer tank and a through hole part 329 forming a second pressure chamber are formed in a predetermined position of the plate 381 and a through hole part 338 forming a diluent solvent buffer tank and a through hole part 339 forming a first pressure chamber are formed.

At this time, etched quantity from each surface of opposite main surfaces 381*a* and 381*b* of the plate 381 is set so that it is approximately a little more than a half of the thickness of the plate 381. That is, in this embodiment, as the thickness of the plate 381 is set to 0.1 mm, etched quantity from one main surface of the plate 381 is approximately 0.055 mm. Hereby, the dimensional precision of the through hole parts 328 and 338 and the through hole parts 329 and 339 can be enhanced and they can be formed stably.

Figure 54:
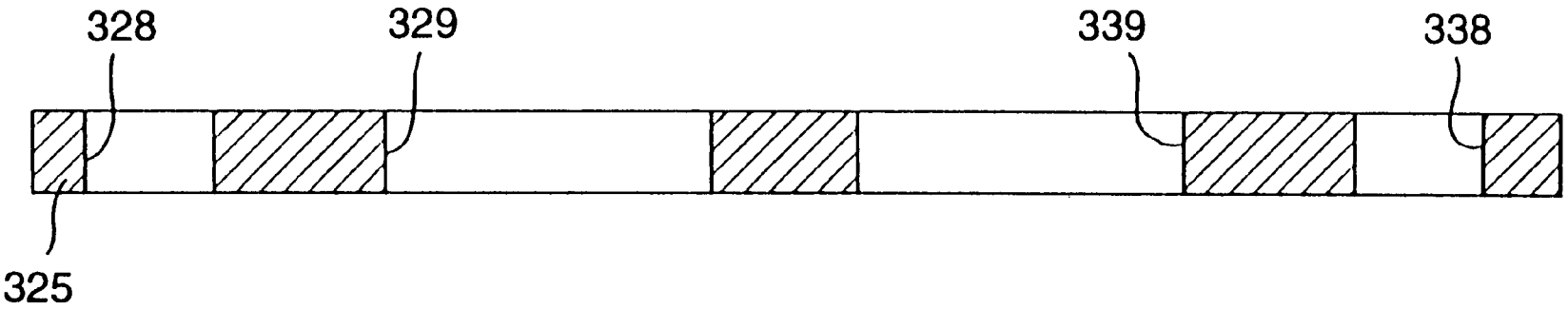
FIG. 54 shows further another example of the method of manufacturing the print head in the order of processes and is a schematic sectional view of the main part showing a process for forming a first member.

Next, the resists 382 and 383 are removed. If a dry film resist is used for the resists 382 and 383, the aqueous solution including sodium hydroxide by 5% or less for example is used and if liquid resist material is used for the resists 382 and 383, dedicated alkali solution for example is used. As a result, as shown in FIG. 54, a first member 325 in which the through hole parts 328 and 338 and the through hole parts 329 and 339 are formed is formed.

Figure 55:
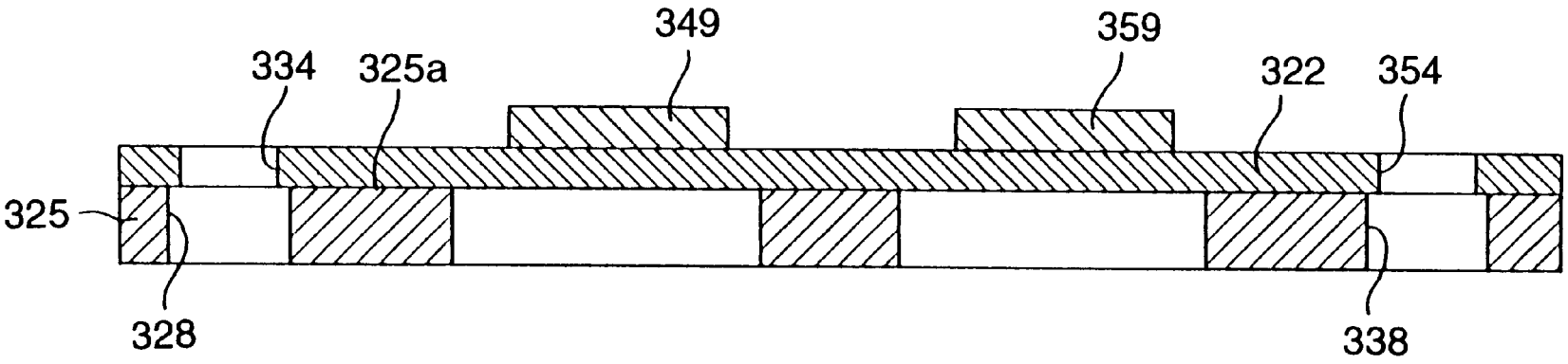
FIG. 55 shows further another example of the method of manufacturing the print head in the order of processes and is a schematic sectional view of the main part showing a process for arranging a diaphragm on the first member.

Next, as shown in FIG. 55, a diaphragm 322 is bonded on the main surface 325*a* on the side reverse to the surface of the first member 325 on which the first member and the second member are bonded by thermocompression bonding. The diaphragm 322 may be formed by Neoflex (trademark) manufactured by Mitsui Toatsu Chemical Industry the glass transition point of which is 250° C. or less for example and the thickness may be set to approximately 20 $\mu$m. The above diaphragm 322 is provided with a first protruding portion 359 with planar area smaller than each planar area of the first pressure chamber and a first piezoelectric element laminated in a postprocess in a position corresponding to the first pressure chamber and provided with a second protruding portion 349 with planar area smaller than each planar area of the second pressure chamber and a second piezoelectric element laminated in a postprocess in a position corresponding to the second pressure chamber. The first and second protruding portions 359 and 349 can be formed by etching a metallic foil film as in a process for forming a printed wiring board after forming metallic foil film material such as Cu and Ni approximately 18 $\mu$m thick for example on the above diaphragm 322 consisting of resin. It need scarcely be said that in the diaphragm 322, an ink supply port 334 the diameter of which is smaller than that of the through hole part 328 and which communicates with the through hole part is formed in a position corresponding to the through hole part 328 which functions as an ink buffer tank and a diluent solvent supply port 354 the diameter of which is smaller than that of the through hole part 338 and which communicates with the through hole part is formed in a position corresponding to the through hole part 338 which functions as a diluent solvent buffer tank.

As a result, an adhesive layer which is a part of the diaphragm 322 and consists of thermoplastic resin is formed between the first member 325 and the diaphragm 322.

For the condition of thermocompression bonding, it is desirable that pressurization temperature is set to approximately 230° C. and pressure is set to approximately 20 to 30 kgf/cm$^2$. Bond strength between the diaphragm 322 and the first member 325 can be enhanced by such thermocompression bonding and they can be effectively bonded.

Figure 56:
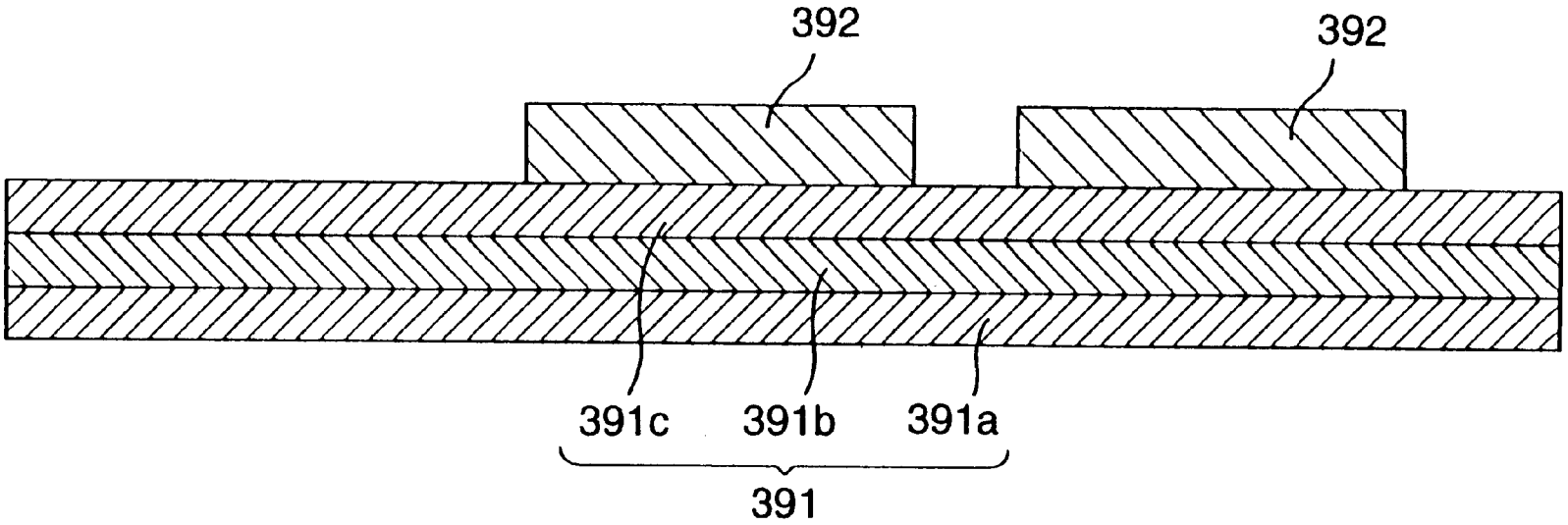
FIG. 56 shows further another example of the method of manufacturing the print head in the order of processes and is a schematic sectional view of the main part showing material for forming the diaphragm.

The diaphragm 322 provided with the first and second protruding portions 359 and 349 can be further readily formed if the following material is used: For such material, as shown in FIG. 56, a metallic wrapping film (trademark) manufactured by Mitsui Toatsu Chemical Industry in which a metallic foil film 392 consisting of Cu with the thickness of approximately 18 μm is formed on a film 391 formed by Neoflex (trademark) manufactured by Mitsui Toatsu Chemical Industry which is approximately 20 μm thick and the glass transition point of which is 250° C. or less can be given. The above film 391 is constituted by laminating a first resin layer 391*a* the glass transition point of which is 250° C. or less and which shows an adhesive property in the range of the temperature of approximately 220 to 230° C., a second resin layer 391*b* that is polyimide material the glass transition point of which is 300° C. or more and which does not show an adhesive property at temperature below 300° C. and a third resin layer 391*c* the glass transition point of which is 300° C. or less and which shows an adhesive property in the range of the temperature of approximately 270 to 280° C., and the metallic foil film 392 is bonded onto the third resin layer 391*c*. As an adhesive which is softened at relatively low temperature is not used in the material, the first and second protruding portions 359 and 349 can be formed on the diaphragm 322 as heat-resistant structure.

Figure 57:
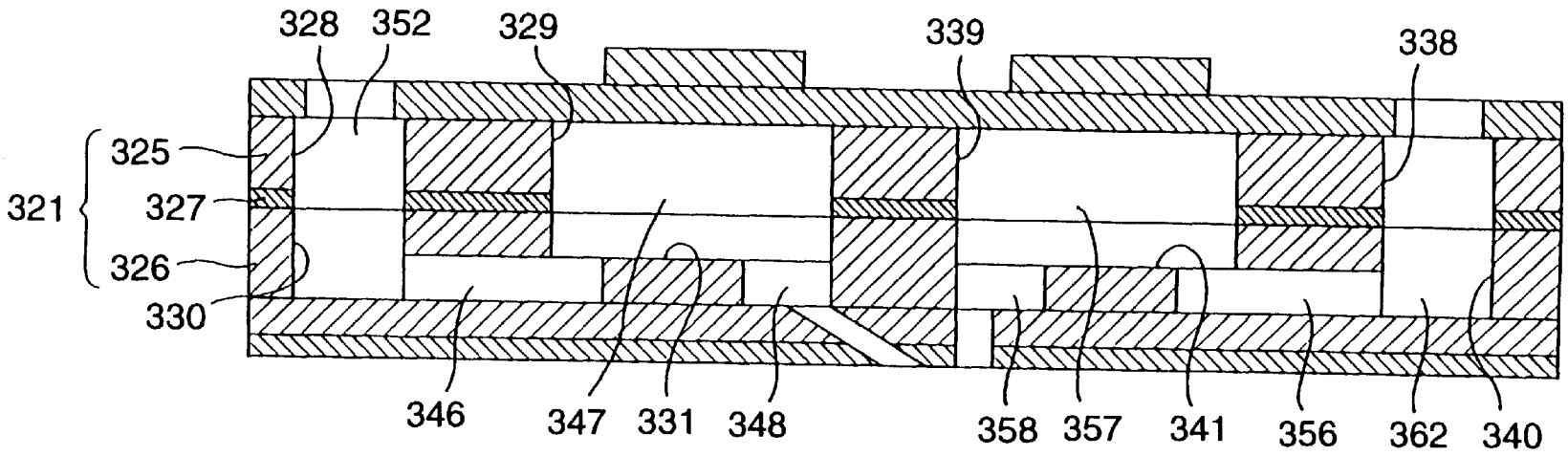
FIG. 57 shows further another example of the method of manufacturing the print head in the order of processes and is a schematic sectional view of the main part showing a process for bonding the first member and a second member.

Next, the first member 325 and the second member 326 are bonded by thermosetting resin. That is, the first member 325 and the second member 326 are bonded by an adhesive layer 327 consisting of thermosetting resin with the through hole part 328 and the through hole part 330 aligned, with the through hole part 329 and the groove part 331 aligned and with the through hole part 339 and the groove part 341 aligned as shown in FIG. 57 and the pressure chamber forming part 321 is completed.

The ink buffer tank 352 in which both ends of the through hole part 328 and the through hole part 330 are covered is formed and the second pressure chamber 347 consisting of the through hole part 329 and the groove part 331 is formed respectively by bonding the first member 325 and the second member 326 as described above. As a result, the ink buffer tank 352, the second liquid supply passage 346, the second pressure chamber 347 and the second nozzle leading hole 348 are continuously formed.

Also, similarly, the diluent solvent buffer tank 362 in which both ends of the through hole part 338 and the through hole part 340 are covered is formed and the first pressure chamber 357 consisting of the through hole part 339 and the groove part 341 is formed. As a result, the diluent solvent buffer tank 362, the first liquid supply passage 356, the first pressure chamber 357 and the first nozzle leading hole 358 are continuously formed.

Next, the second piezoelectric element 323*b* is bonded to the second protruding portion 349 using an epoxy adhesive for example, the ink supply pipe 350 is connected to the ink supply port 344 of the diaphragm 322, the first piezoelectric element 323*a* is bonded to the first protruding portion 359, the diluent solvent supply pipe 360 is connected to the diluent solvent supply port 354 of the diaphragm 322 and the print head shown in FIG. 41 is completed.

In the method of manufacturing the print head in this embodiment, as the diaphragm 322 is bonded to the first member 325 beforehand by thermoplastic resin, the orifice plate 324 is bonded to the second member 326 beforehand and afterward, the first member 325 and the second member 326 respectively constituting the pressure chamber forming part 321 are bonded by an adhesive layer 327 consisting of thermosetting resin, the thermoplastic resin bonding the first member 325 and the diaphragm 322 is not influenced in the bonding process, no heat and nothing are applied to the liquid repelling film 351 of the orifice plate 324 bonded to the second member 326 and a range in which a liquid repelling film is selected is widened.

(2-5) Effect in the Second Embodiment

Therefore, in the printer in this embodiment, as the diaphragm 322 and the pressure chamber forming part 321 are bonded by thermoplastic resin in the print head, the bond strength of the diaphragm 322 is secured, as the liquid repelling film 351 is not influenced by heat, heat resistance is not required for the liquid repelling film 351 so much, a liquid repelling film provided with liquid repelling performance according to an actual service condition can be used as the liquid repelling film 351, a range in which the liquid repelling film 351 is selected can be widened and productivity is improved.

Also, in the printer in this embodiment, as the groove part 332 forming the second liquid supply passage 346 and the groove part 342 forming the first liquid supply passage 356 are formed on the side of the orifice plate 324 in the print head, the above groove parts 332 and 342 are prevented from being blocked by an adhesive in a process for bonding the second member 326 and the first member 325, resistance to a flow caused by blockade by an adhesive in the second liquid supply passage 346 and the first liquid supply passage 356 can be prevented from being increased and high reliability can be obtained.

Further, as the second liquid supply passage 346 and the first liquid supply passage 356 are formed on the side of the orifice plate 324, a range in which thermoplastic resin bonding the diaphragm 322 and the first member 325 is selected, in this case, a range in which material forming the diaphragm 322 is selected is widened and productivity is improved.

Furthermore, in the printer in this embodiment, the first member 325 and the second member 326 respectively constituting the pressure chamber forming part 321 are bonded by thermosetting resin such as epoxy resin in the print head, however, as these first and second members 325 and 326 are both provided with mechanical rigidity, compared with the diaphragm 322, a warp caused in bonding can be prevented without applying pressure so much in bonding.

That is, in the printer in this embodiment, the first member 325 and the second member 326 are readily bonded without increasing temperature and pressure so much in the print head, the constraint of a range in which an adhesive used in bonding is selected is decreased, the deterioration of the performance of the liquid repelling film is reduced, the occurrence of failure in a process such as the liquid repelling film adheres to a bonding jig can be also decreased and productivity is enhanced.

Further, in the printer in this embodiment, the pressure chamber forming part 321 is formed by stainless steel in the print head, the orifice plate 324 is formed by resin and the deformation of the orifice plate 324 in case pressure is applied to the first and second pressure chambers 357 and 347 can be reduced, compared with a case that both the pressure chamber forming part and the orifice plate are formed by resin. Also, in this embodiment, as the second member 326 also exists in the lower part of the first and second pressure chambers 357 and 347, ink or a diluent solvent can be stably emitted from the quantity determining nozzle 335 and the emission nozzle 355.

Furthermore, as the deformation of the orifice plate 324 is reduced as described above, pressure in the first and second pressure chambers 357 and 347 can be effectively and stably increased even if voltage respectively applied to the first and second piezoelectric elements 323*a* and 323*b* is decreased and power consumption is reduced.

(3) Other Embodiments

Figure 58:
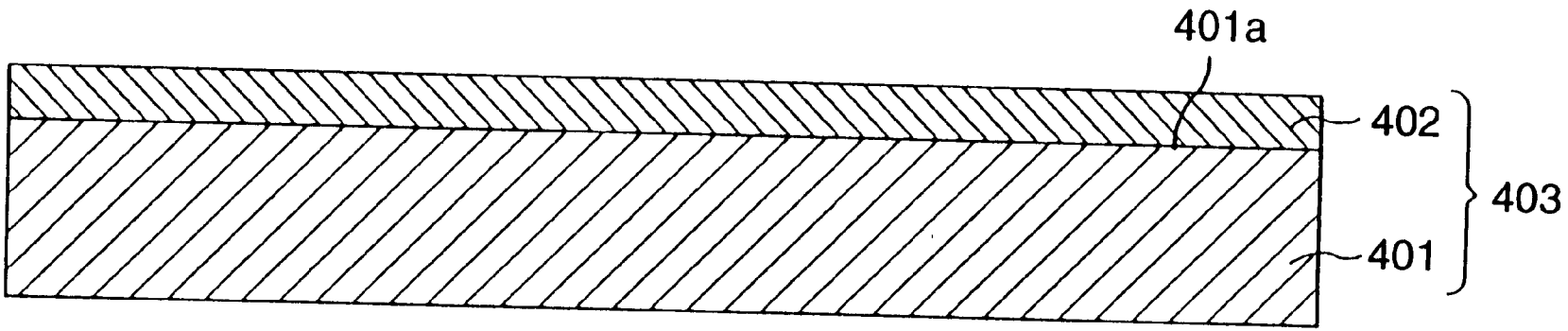
FIG. 58 is a sectional view showing an example of material usable for an orifice plate.

In the example of the print head in the printer in the above first and second embodiments, the orifice plate is formed by one type of resin, however, the orifice plate may be also formed by a plate 403 constituted by applying resin material 402 which is approximately 7 μm thick and the glass transition point of which is 250° C. or less, for example Neoflex (trademark) manufactured by Mitsui Toatsu Chemical Industry onto one main surface 401*a* of resin material 401 which is approximately 125 μm thick and the glass transition point of which is 250° C. or more, for example Capton (trademark) manufactured by Dupon as shown in FIG. 58. In this case, a nozzle is also formed by excimer laser beam machining and others.

As a thicker orifice plate is formed than in the above example when the orifice plate is formed by such a plate 403, the strength of the orifice plate can be more secured, the length of a nozzle can be extended and therefore, the directivity of an emitted ink droplet can be enhanced.

In the print head in the two solution mixed type printer such as the above "carrier jet" printer, if the orifice plate is formed by the plate 403 consisting of two types of resin materials as described above, allowance can be made for the inclination of the quantity determining nozzle and as an interval between the first and second pressure chambers can be readily widened, ink and a diluent solvent can be securely prevented from leaking.

Figure 59:
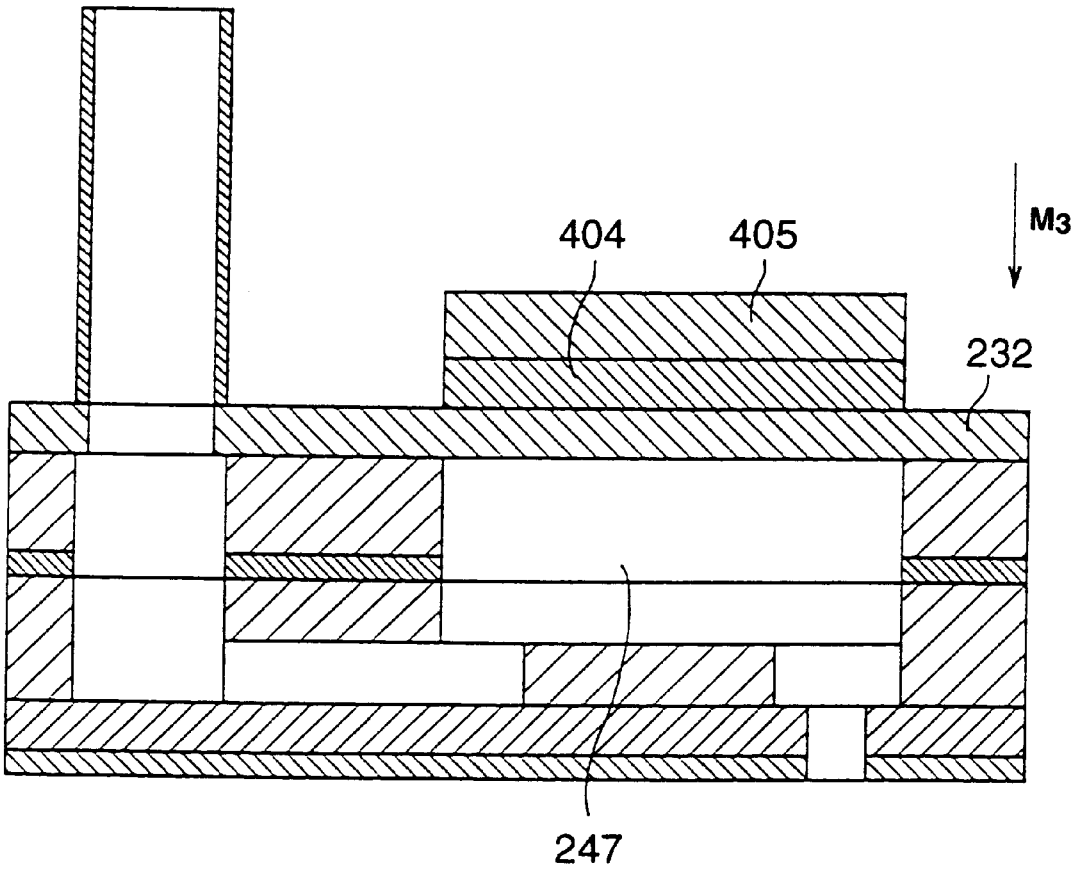
FIG. 59 is a schematic sectional view of the main part showing further another example of a print head.

In the printer according to an ink jet method in the above first embodiment, the piezoelectric element which is a laminated piezoelectric element as means for applying pressure to the pressure chamber is used, however, for the pressure applying means, a piezoelectric element consisting of a single plate may be also used. That is, a diaphragm 404 provided with planar area approximately equal to that of the pressure chamber 247 is laminated in a position corresponding to the pressure chamber 247 on the diaphragm 232 of a print head shown in FIG. 59 and provided with approximately the same constitution as in the print head shown in FIG. 25 and a piezoelectric element 405 consisting of a plate may be also laminated further on the laminated diaphragm. In FIG. 59, the same reference numbers are allocated to parts provided with the same constitution as in FIG. 25 and the description is omitted.

In the printer, an orifice plate may be also formed by the above two layers of resin material and the same effect can be obtained as in the above case.

For the polarization of the piezoelectric element 405 and a direction in which voltage is applied, the piezoelectric element 405 is set so that when voltage is applied to the piezoelectric element 405, the piezoelectric element is contracted in an in-plane direction of the diaphragm 404 and bent in a direction shown by an arrow $M_3$ in FIG. 59.

Figure 60:
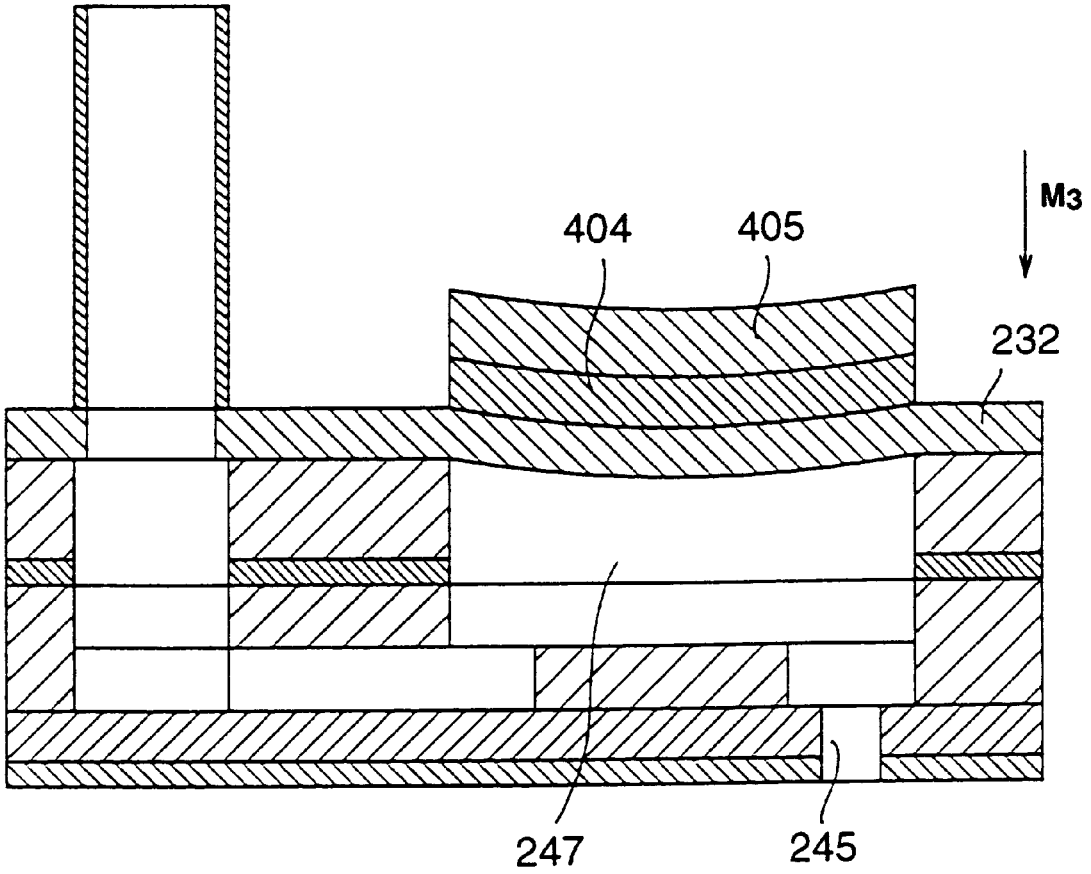
FIG. 60 is a schematic sectional view of the main part showing a state in which the volume of a pressure chamber is decreased in further another example of the print head.

Therefore, in the print head according to the ink jet method, when driving voltage is applied to the piezoelectric element 405, the piezoelectric element 405 is bent in the direction shown by the arrow $M_3$ in FIG. 60, presses the diaphragm 404 and curves the diaphragm 232. As a result, the volume of the pressure chamber 247 is decreased, the pressure of the pressure chamber 247 is increased and ink is emitted from the emission nozzle 245.

In this case, the change in time of driving voltage applied to the piezoelectric element 405 is shown in the waveform of voltage at which ink can be emitted from the emission nozzle 245.

Figure 61:
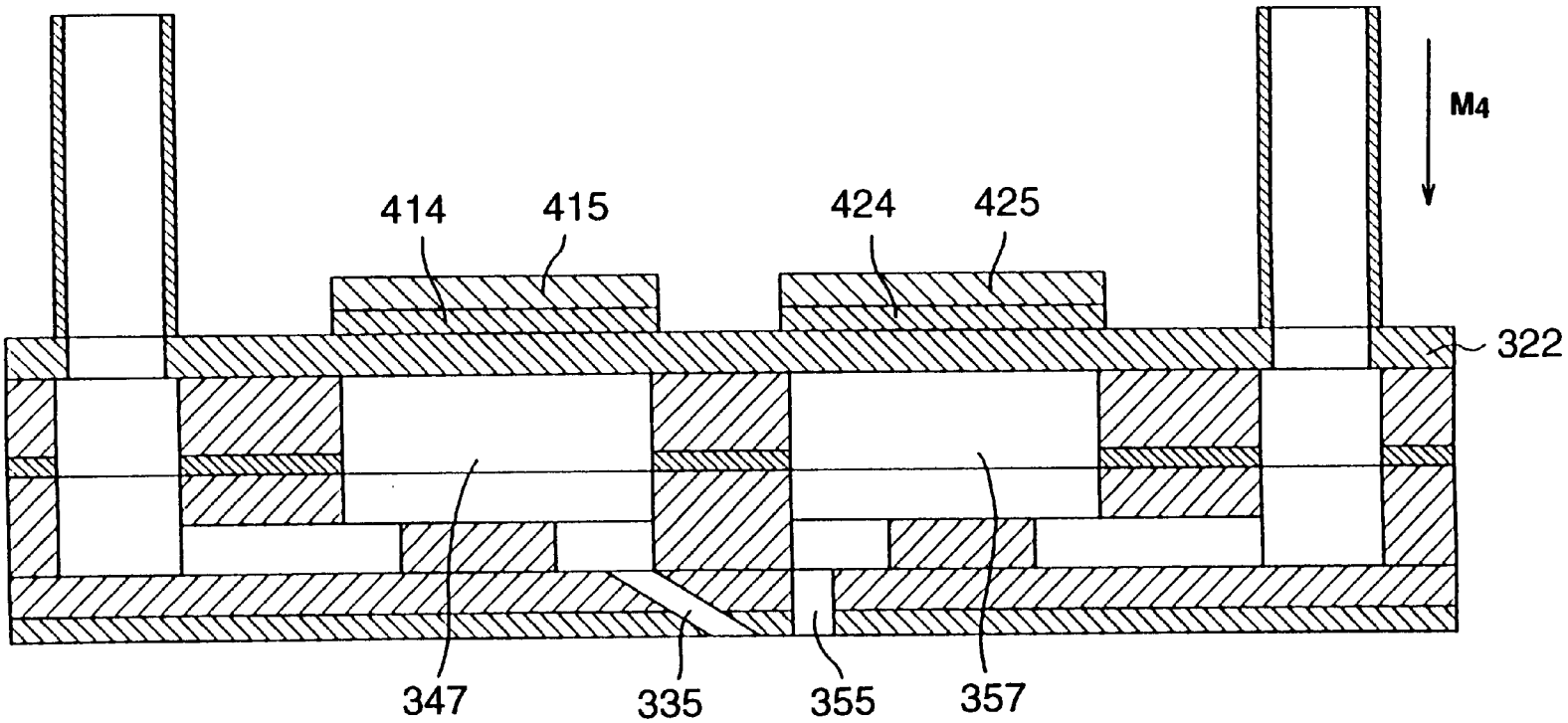
FIG. 61 is a schematic sectional view of the main part showing further another example of a print head.

The above piezoelectric element can be also applied to the print head of a two solution mixed type printer such as the above "carrier jet" printer. That is, a diaphragm 414 provided with planar area approximately equal to that of the second pressure chamber 347 is laminated in a position corresponding to the second pressure chamber 347 on the diaphragm 322 of a print head shown in FIG. 61 provided with approximately the same constitution as the print head shown in FIG. 41, a second piezoelectric element 415 consisting of a plate is laminated further on the laminated diaphragm, a diaphragm 424 provided with planar area approximately equal to that of the first pressure chamber 357 is laminated in a position corresponding to the first pressure chamber 357 on the diaphragm 322 of a print head shown in FIG. 61 provided with approximately the same constitution as the print head shown in FIG. 41, a first piezoelectric element 425 consisting of a plate may be also laminated further on the laminated diaphragm. In FIG. 61, the same reference numbers are allocated to parts provided with the same constitution as in FIG. 41 and the description is omitted.

In the printer, an orifice plate may be also formed by the above two layers of resin material and the same effect can be obtained as in the above case.

For the polarization of the first and second piezoelectric elements 425 and 415 and a direction in which voltage is applied, the first and second piezoelectric elements 425 and 415 are set so that when voltage is applied to the first and second piezoelectric elements 425 and 415, the first and second piezoelectric elements are contracted in the respective in-plane directions of the diaphragms 424 and 414 and bent in a direction shown by an arrow $M_4$ in FIG. 61.

Therefore, in case printing is executed, first, a meniscus is respectively formed by a diluent solvent and ink in positions in which each meniscus is balanced with each surface tension, in other words, in the vicinity of the respective ends of the emission nozzle 355 and the quantity determining nozzle 335 without applying driving voltage to the first and second piezoelectric elements 425 and 415 in the print head of the two solution mixed type printer and the printer is ready for printing.

Figure 62:
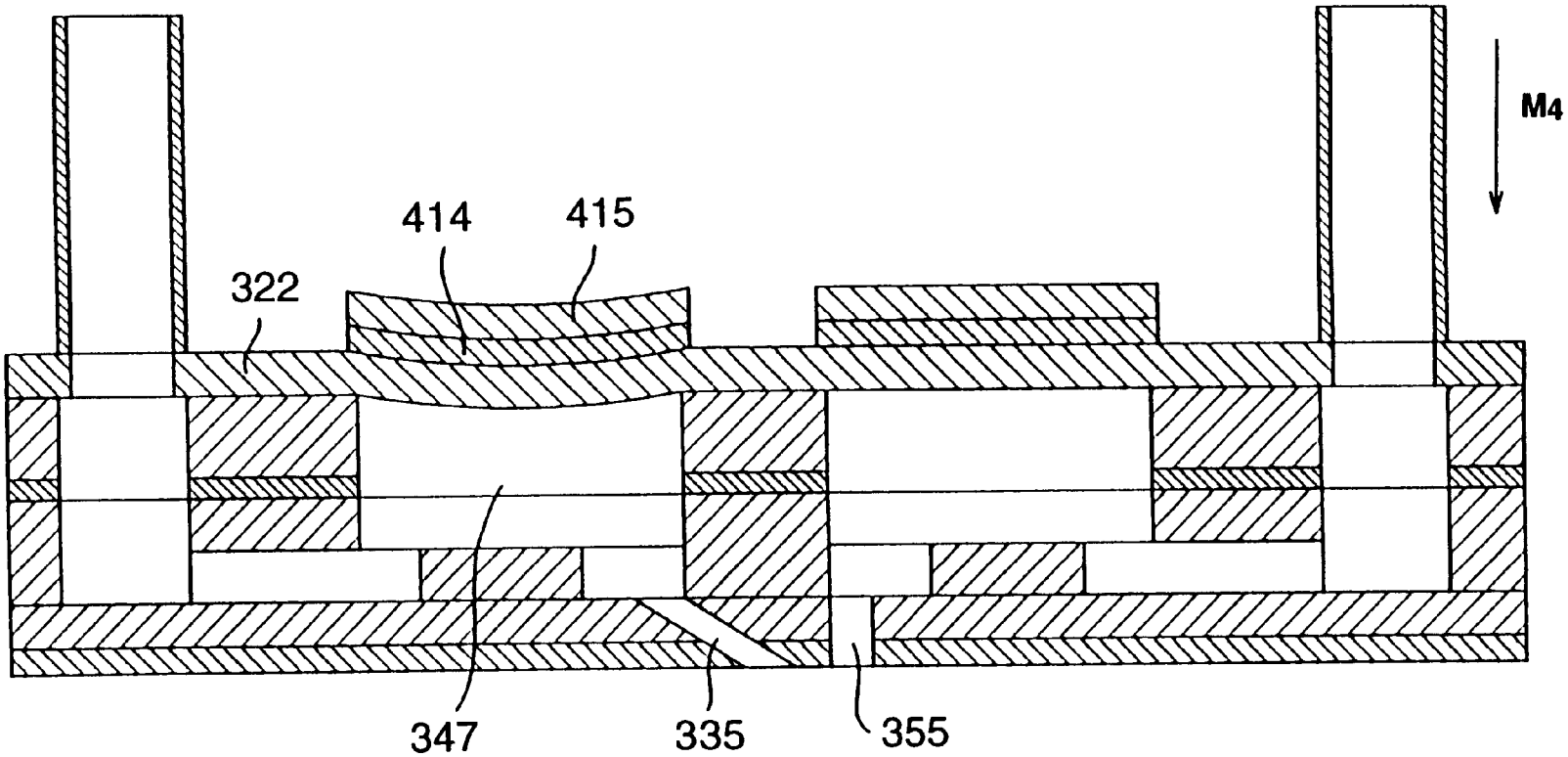
FIG. 62 is a schematic sectional view of the main part showing a state in which the volume of a second pressure chamber is decreased in further another example of the print head.

Next, to determine the quantity of ink, driving voltage is applied to the second piezoelectric element 415. Hereby, as shown in FIG. 62, the second piezoelectric element 415 is bent in a direction shown by the arrow $M_4$ in FIG. 62, a part corresponding to the second pressure chamber 347 of the diaphragm 322 is curved in the direction shown by the arrow $M_4$ in FIG. 62, as a result, the volume of the second pressure chamber 437 is decreased and pressure in the second pressure chamber 347 is increased.

As the value of voltage applied to the second piezoelectric element 415 is set to a value according to the scale of image data, ink in quantity according to image data is pushed out from the end of the quantity determining nozzle 335.

Ink pushed out from the quantity determining nozzle 335 touches a diluent solvent forming a meniscus in the vicinity of the end of the emission nozzle 355 and is mixed with the diluent solvent.

Next, the application of driving voltage to the second piezoelectric element 415 is released, pressure in the second pressure chamber 347 is restored to an original state, excessive ink pushed out from the quantity determining nozzle 335 is pulled in and only quantity determined ink is left in the vicinity of the end of the emission nozzle 355.

Figure 63:
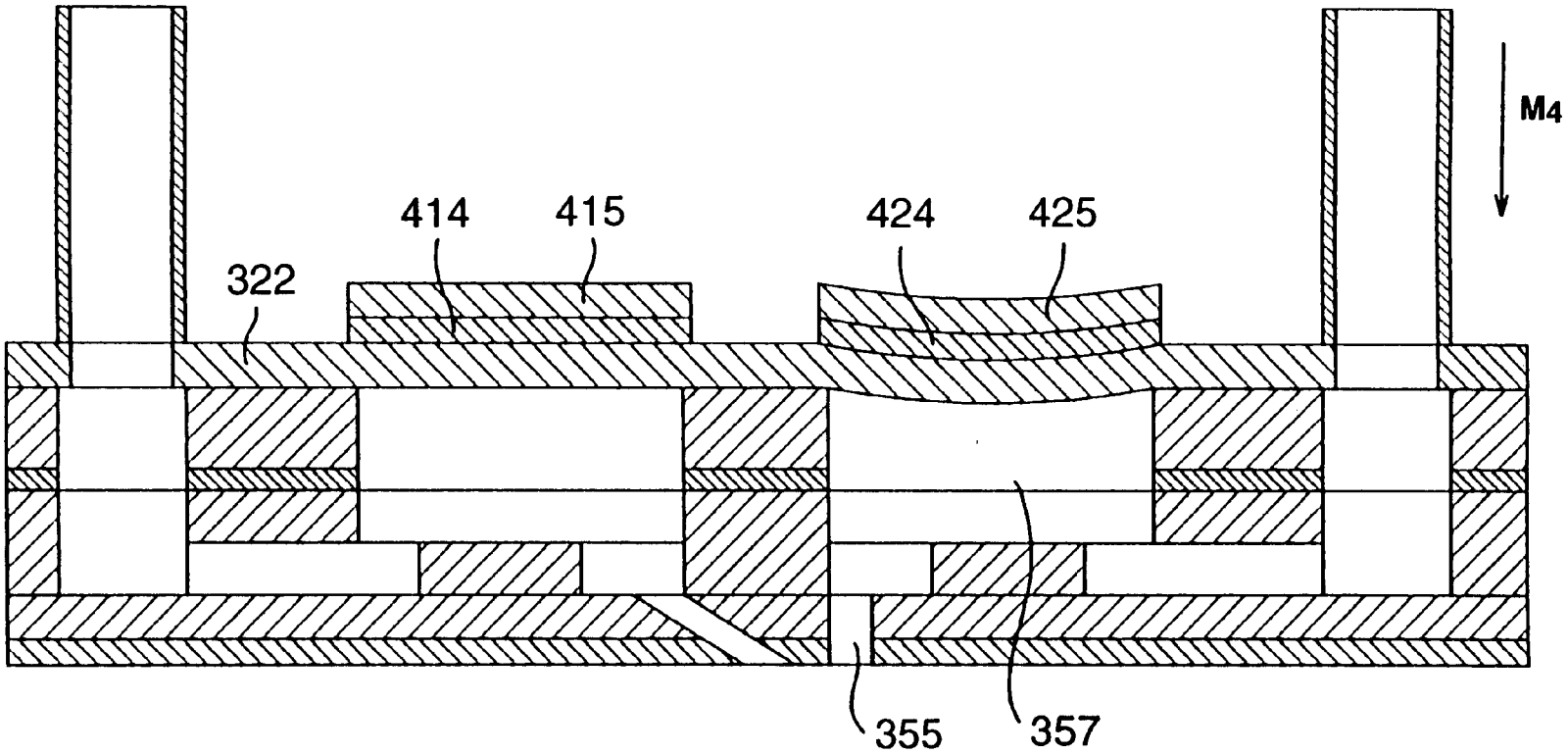
FIG. 63 is a schematic sectional view of the main part showing a state in which the volume of a first pressure chamber is decreased in further another example of the head.

Next, driving voltage is applied to the first piezoelectric element 425, the first piezoelectric element 425 is bent in the direction shown by an arrow $M_4$ in FIG. 63 and a part corresponding to the first pressure chamber 357 of the diaphragm 322 is curved in the direction shown by the arrow $M_4$ in FIG. 63. As a result, the volume of the first pressure chamber 357 is decreased, pressure in the first pressure chamber 357 is increased and mixed solution provided with ink density according to image data is emitted from the emission nozzle 355.

The change in time of driving voltage applied to the first piezoelectric element 425 is set so that mixed solution can be emitted from the emission nozzle 355.

Further, for the print head of the above two solution mixed type printer, an example in which ink is a quantity determined medium and a diluent solvent is an emitted medium is described, however, the present invention is not limited to the above example, it need scarcely be said that the present invention can be also applied to a printer provided with a print head in which ink is an emitted medium and a diluent solvent is a quantity determined medium and the same effect as in the above embodiment can be obtained.

Figure 64:
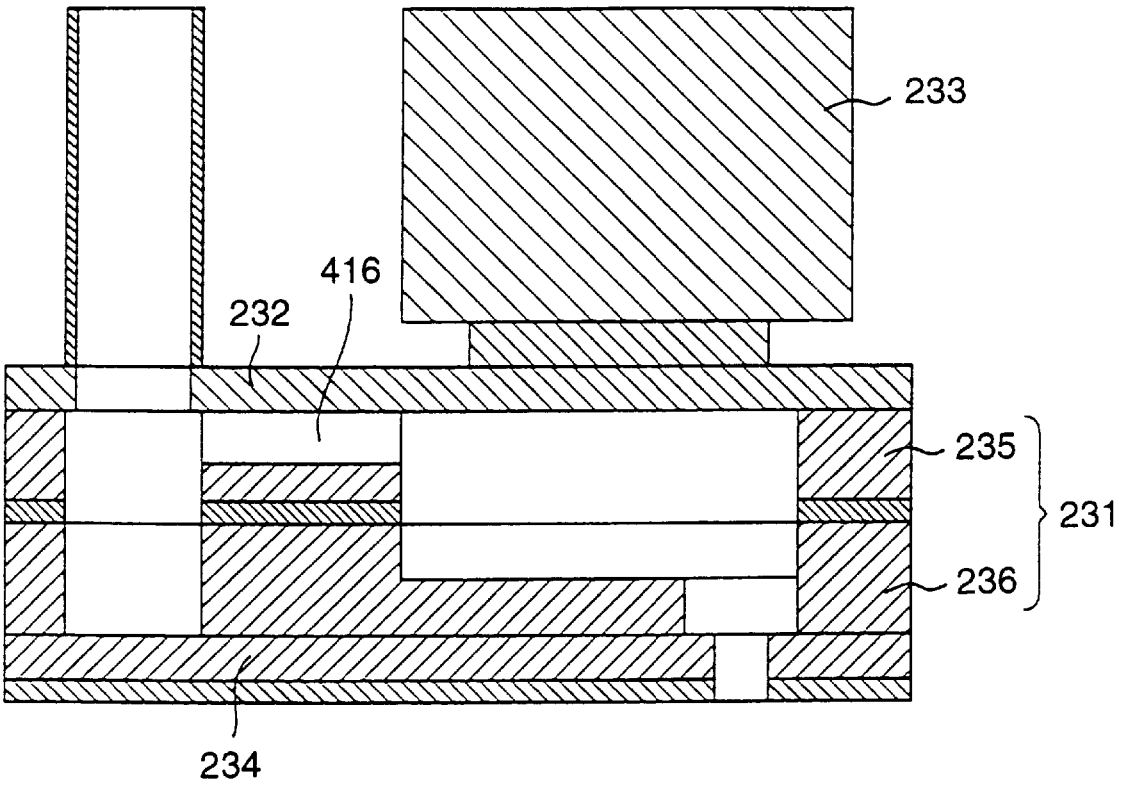
FIG. 64 is a schematic sectional view of the main part showing further another example of a print head.

Also, for the printer according to the above ink jet method, an example in which the liquid supply passage 246 of the print head is provided on the side of the orifice plate 234 is described, however, as shown in FIG. 64, the ink supply passage is formed on the side of the diaphragm 232 of a print head provided with approximately the same constitution as the print head shown in FIG. 25. That is, a liquid supply passage 416 may be also formed in the first member 235 of the pressure chamber forming part 231 and the same effect in the above example can be obtained. However, in FIG. 64, the same reference numbers are allocated to parts provided with the same constitution as in FIG. 25 and the description is omitted. That is, in the print head, as the liquid supply passage 416 is also covered by a thermoplastic adhesive, the passage is prevented from being blocked when the adhesive is hardened.

The first member 235 provided with the liquid supply passage 416 is formed as the second member 236 of the above print head.

In the print head, an orifice plate may be also formed by a plate consisting of the above two types of resin materials and the same effect as in the above case can be obtained.

Further, in the print head, even if a piezoelectric element consisting of a single plate is used in place of the piezoelectric element 233 which is a laminated piezoelectric element, the same effect can be also obtained as the above case.

Figure 65:
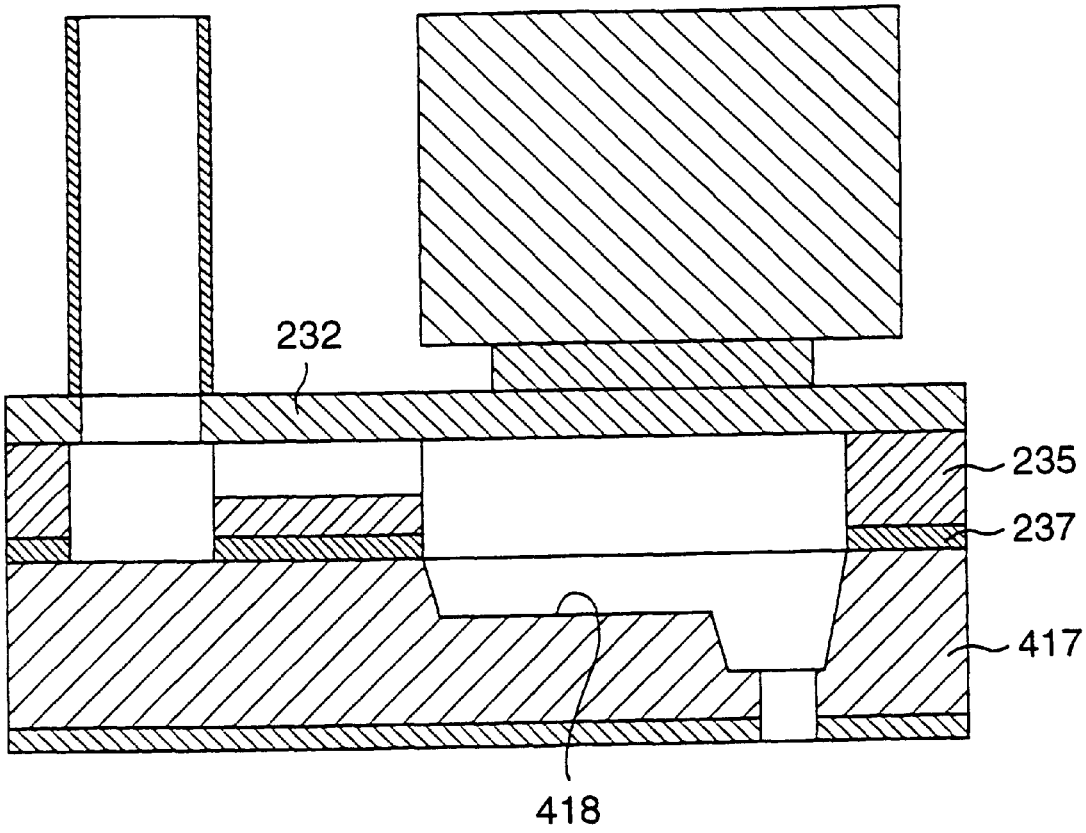
FIG. 65 is a schematic sectional view of the main part showing further another example of a print head.

Furthermore, in the printer according to the above ink jet method, both the first and second members 235 and 236 of the pressure chamber forming part 231 are formed by a stainless steel member by etching, however, the present invention can be also applied to a printer in which an orifice plate which also functions as a second member is formed by injection molding. That is, as shown in FIG. 65, a print head provided with approximately the same constitution as the print head shown in FIG. 64 may be also constituted by bonding the above orifice plate 417 which also functions as a second member and the first member 235 by the adhesive layer 237. However, in FIG. 65, the same reference numbers are allocated to parts provided with the same constitution as in FIG. 64 and the description is omitted. In this embodiment, a concave portion 418 in which a groove part forming a part of a pressure chamber, a through hole forming a nozzle leading hole and a nozzle are integrated is formed in the orifice plate 417. In such structure, the same effect can be also obtained as the above case.

For material constituting the injection molded orifice plate 417, polyetherimide, polysulfone, polyimide and polybenzimidazole can be given. In the print head, as the diaphragm 232 is also formed by thermoplastic material and is also bonded to the first member 235 by thermocompression bonding, the same effect can be obtained as the above printer. Further, as the orifice plate 417 and the first member 235 are bonded by the adhesive layer 237 consisting of thermosetting resin, no warp and nothing due to difference in a coefficient of thermal expansion are caused even if a coefficient of thermal expansion between the orifice plate 417 and the first member 235 is greatly different.

Figure 66:
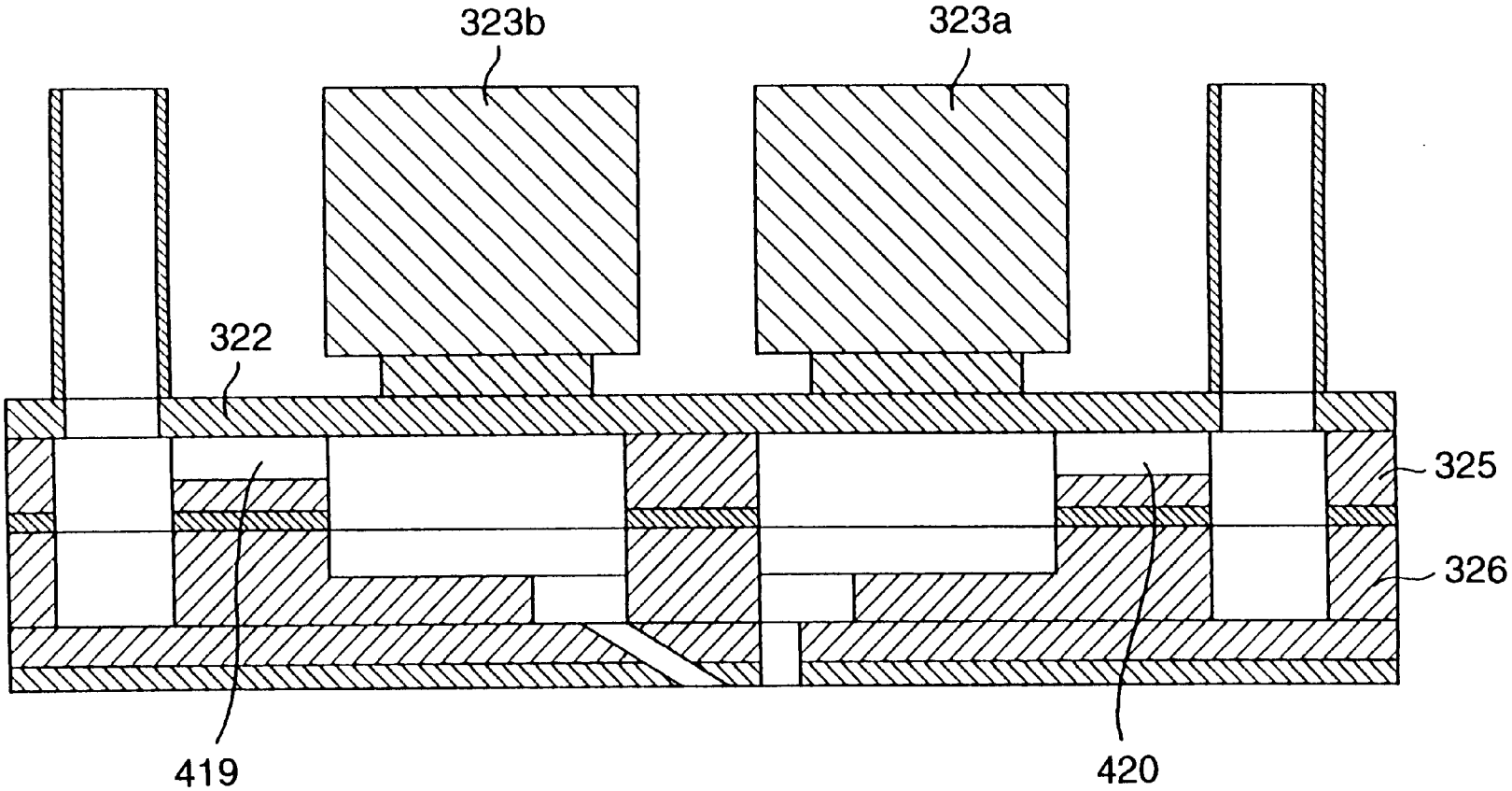
FIG. 66 is a schematic sectional view of the main part showing further another example of a print head.

Also, for the above two solution mixed type printer, an example in which the second liquid supply passage 346 and the first liquid supply passage 356 respectively of the print head are provided on the side of the orifice plate 324 is described, however, as shown in FIG. 66, these first and second liquid supply passages may be also formed on the side of the diaphragm 322 of a print head provided with approximately the same constitution as the print head shown in FIG. 41, that is, the first and second liquid supply passages 420 and 419 may be also formed in the first member 325 of the pressure chamber forming part 321 and the same effect can be obtained as the above example. In FIG. 66, the same reference numbers are allocated to parts provided with the same constitution as in FIG. 41 and the description is omitted. That is, in the print head, as first and second liquid supply passages 420 and 419 are covered by a thermoplastic adhesive, a passage is also prevented from being blocked when the adhesive is hardened.

The first member 325 provided with these first and second liquid supply passages 420 and 419 is formed in the same method as the above second member 326 of the print head.

In the print head, the orifice plate may be also formed by the above plate consisting of two types of resin material and the same effect can be obtained as the above case.

Further, in the print head, even if a piezoelectric element consisting of a single plate is used in place of the first and second piezoelectric elements 323*a* and 323*b* which is respectively a laminated piezoelectric element, the same effect can be also obtained as the above case.

Figure 67:
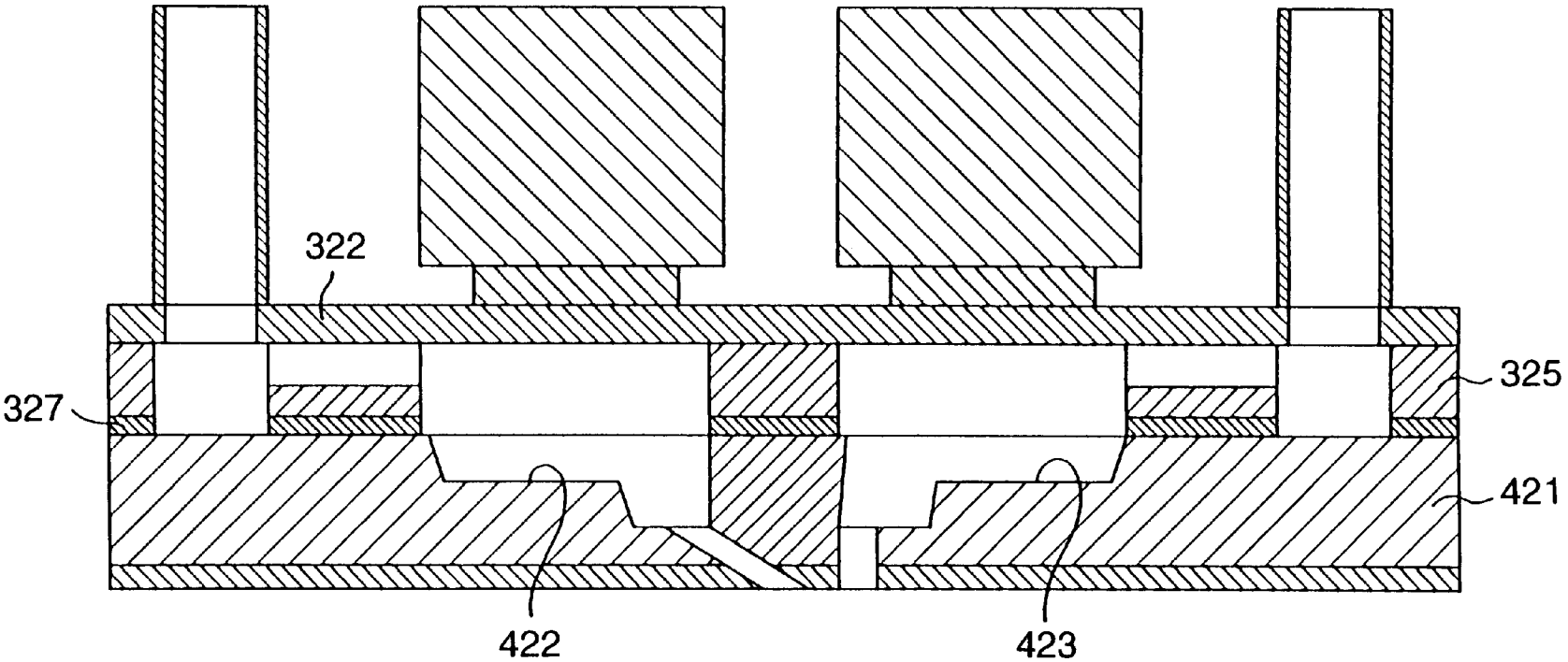
FIG. 67 is a schematic sectional view of the main part showing further another example of a print head.

Furthermore, in the above two solution mixed type printer, both the first and second members 325 and 326 of the pressure chamber forming part 321 are formed by a stainless steel member by etching, however, the present invention can be also applied to a printer in which an orifice plate which also functions as a second member is formed by injection molding. That is, as shown in FIG. 67, a print head provided with approximately the same constitution as the print head shown in FIG. 66 may be also constituted by bonding the above orifice plate 421 which also functions as the second member and the first member 325 by an adhesive layer 327. In this embodiment, a concave portion 422 in which a groove part forming a part of a second pressure camber, a through hole forming a second nozzle leading hole and a quantity determining nozzle are integrated and a concave portion 423 in which a groove part forming a first pressure chamber, a through hole forming a first nozzle leading hole and an emission nozzle are integrated are formed in the orifice plate 421. In such structure, the same effect can be also obtained as the above case.

For material constituting the injection molded orifice plate 421, polyetherimide, polysulfone, polyimide and polybenzimidazole can be given. In the print head, as the diaphragm 232 is also formed by thermoplastic material and is also bonded to the first member 235 by thermocompression bonding, the same effect can be obtained as the above printer. Further, as the orifice plate 421 and the first member 325 are bonded by the adhesive layer 327 consisting of thermosetting resin, no warp and nothing due to difference in a coefficient of thermal expansion are caused even if a coefficient of thermal expansion between the orifice plate 421 and the first member 325 is greatly different.

Figure 68:
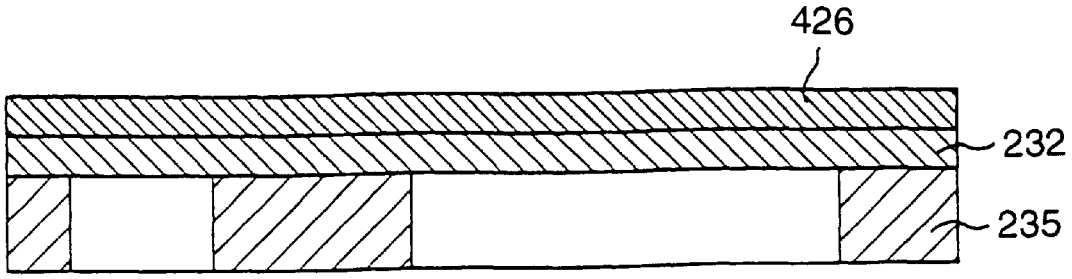
FIG. 68 shows further another embodiment of a method of manufacturing the print head in the order of processes and is a schematic sectional view of the main part showing a process for bonding a first member and a diaphragm on which a metallic foil is formed.

Further, for a method of manufacturing the above printer according to the ink jet method, the method in which the diaphragm 232 is bonded to the first member 235 of the pressure chamber forming part 231 after the protruding portion 249 is formed on the diaphragm 232 is shown, however, the present invention is not limited to the above method and as shown in FIG. 68, after the diaphragm 232 is bonded onto the first member 235 with the metallic foil 426 bonded onto the diaphragm 232 consisting of thermoplastic material, the protruding portion may be also formed. For a product in which thermoplastic material and metallic foil are bonded together as described, a metallic wrapping film (trademark) manufactured by Mitsui Toatsu Chemical Industry can be given.

To form a protruding portion as described above, first, as shown in FIG. 69, a mask 427 is formed by a dry film and others in a predetermined position in which a protruding portion is to be formed on metallic foil 426 on the diaphragm 232. After a part except a part in which the mask 427 is formed of the metallic foil 426 is etched by dipping in etchant such as aqueous solution of ferric chloride, the mask 427 is peeled and as shown in FIG. 70, the protruding portion 249 may be also formed in a predetermined position of the diaphragm 232.

To form the ink supply port 244 in a position corresponding to the through hole part 238 in the diaphragm 232, the diaphragm 232 in a predetermined part has only to be removed by punching and others.

Figure 69:
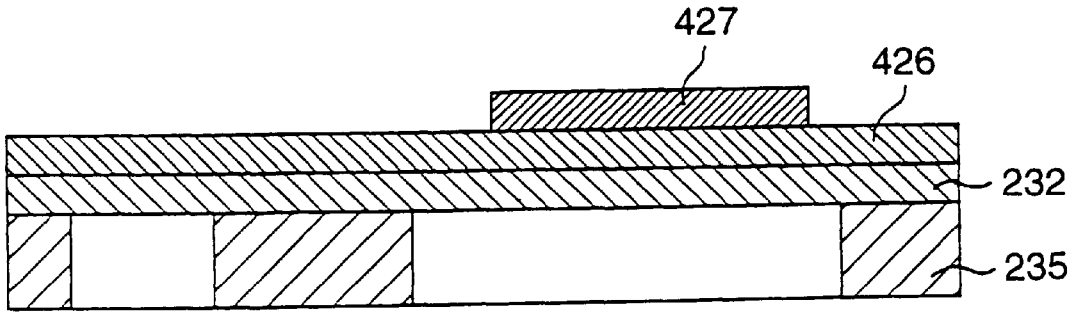
FIG. 69 shows further another example of the method of manufacturing the print head in the order of processes and is a schematic sectional view of the main part showing a process for forming a mask on the metallic foil.
Figure 70:
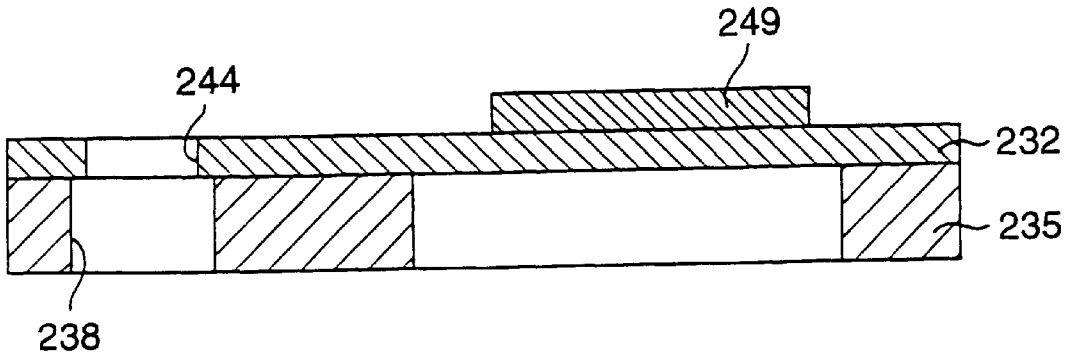
FIG. 70 shows further another example of the method of manufacturing the print head in the order of processes and is a schematic sectional view of the main part showing a process for forming a protruding portion.

As described above, as alignment between the protruding portion 249 and a pressure chamber is executed in a mask forming process shown in FIG. 69 if the protruding portion 249 is formed after the diaphragm 232 and the first member 235 are bonded, an exposer is used for alignment. That is, as described above, alignment precision can be enhanced, compared with a case that alignment between the protruding portion and the pressure chamber is executed using a bonding jig after the protruding portion is formed.

Further, after a plate forming a first member and a diaphragm onto which metallic foil is bonded are bonded, each through hole part of the first member and a protruding portion may be also formed.

Figure 71:
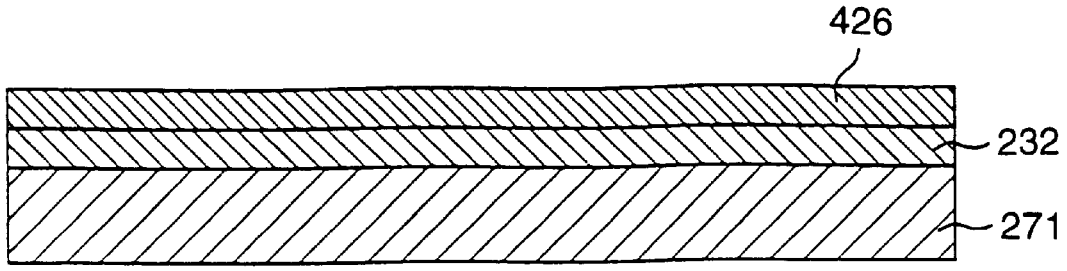
FIG. 71 shows further another example of the method of manufacturing the print head in the order of processes and is a sectional view showing a process for bonding the diaphragm on which the metallic foil is formed and a plate.

That is, as shown in FIG. 71, the diaphragm 232 is bonded onto the plate 271 forming the first member with the metallic foil 426 bonded on the diaphragm 232 consisting of thermoplastic material. For a product in which thermoplastic material and metallic foil are bonded together as described above, a metallic wrapping film (trademark) manufactured by Mitsui Toatsu Chemical Industry can be given.

Figure 72:
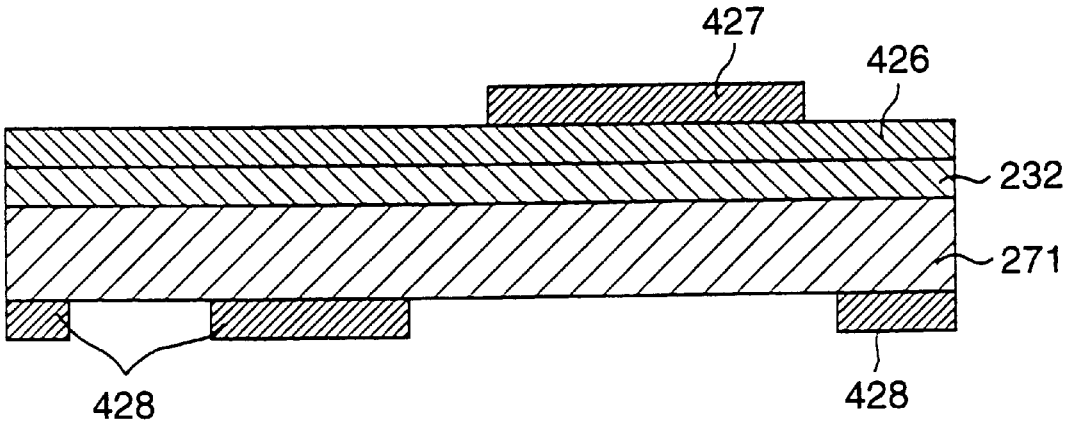
FIG. 72 shows further another example of the method of manufacturing the print head in the order of processes and is a sectional view showing a process for forming a mask on the metallic foil and a stainless steel member.
Figure 73:
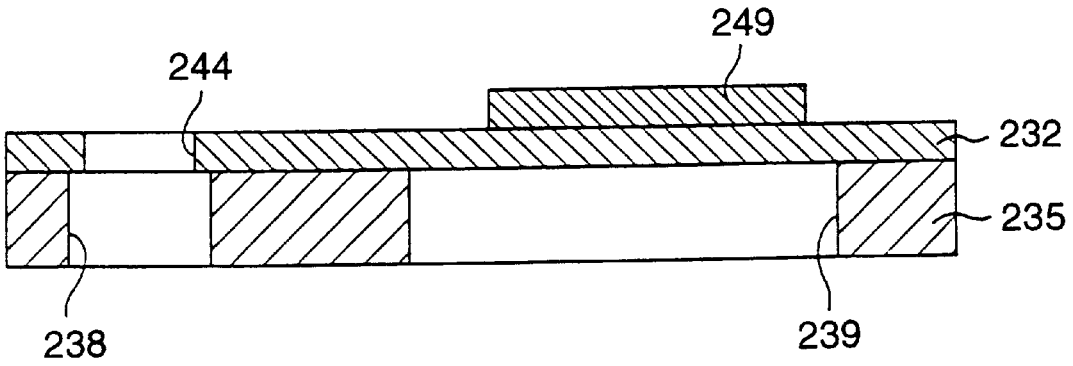
FIG. 73 shows further another example of the method of manufacturing the print head in the order of processes and is a sectional view showing a process for forming a protruding portion and a through hole.

Next, as shown in FIG. 72, the mask 427 is formed by a dry film and others in a predetermined position in which a protruding portion is to be formed on the metallic foil 426 on the diaphragm 232 and a mask 428 in which each through hole can be formed is formed by a dry film and others on the plate 271. A part except a part in which the mask 427 is formed in the metallic foil 426 is etched by dipping in etchant such as aqueous solution of ferric chloride and a part except a part in which the mask 428 is formed in the plate 271 is also etched. Next, the masks 427 and 428 are peeled, as shown in FIG. 73, a protruding portion 249 is formed in a predetermined position of the diaphragm 232 and a first member 235 in which through hole parts 238 and 239 are formed may be also formed.

To form an ink supply port 244 in a position corresponding to the through hole part 238 in the diaphragm 232, the diaphragm 232 in a predetermined part has only to be removed by punching and others.

As described above, as alignment between the protruding portion 249 and the through hole part 239 forming a pressure chamber is made in a mask forming process shown in FIG. 72 if the protruding portion 249, the through hole part 238 and 239 are formed after the diaphragm 232 and the plate 271 are bonded, the alignment is made using an exposer. That is, alignment precision can be enhanced, compared with a case that a protruding portion and a through hole are aligned using a bonding jig after the protruding portion and the through hole are formed as described above. At this time, as both surfaces can be simultaneously exposed if a double-sides exposer is used, alignment precision can be further enhanced.

Such a method of forming a protruding portion or a through hole part can be also applied to a method of manufacturing a two solution mixed type printer such as the above "carrier jet" printer and alignment precision between a first protruding portion and a first pressure chamber and between a second protruding portion and a second pressure chamber can be enhanced.

Further, in the printer in the above first embodiment, a pattern layer may be also laminated on an adhesive layer consisting of thermoplastic resin at least in a position except a part opposite to the pressure chamber and a part opposite to the liquid supply passage.

Figure 74:
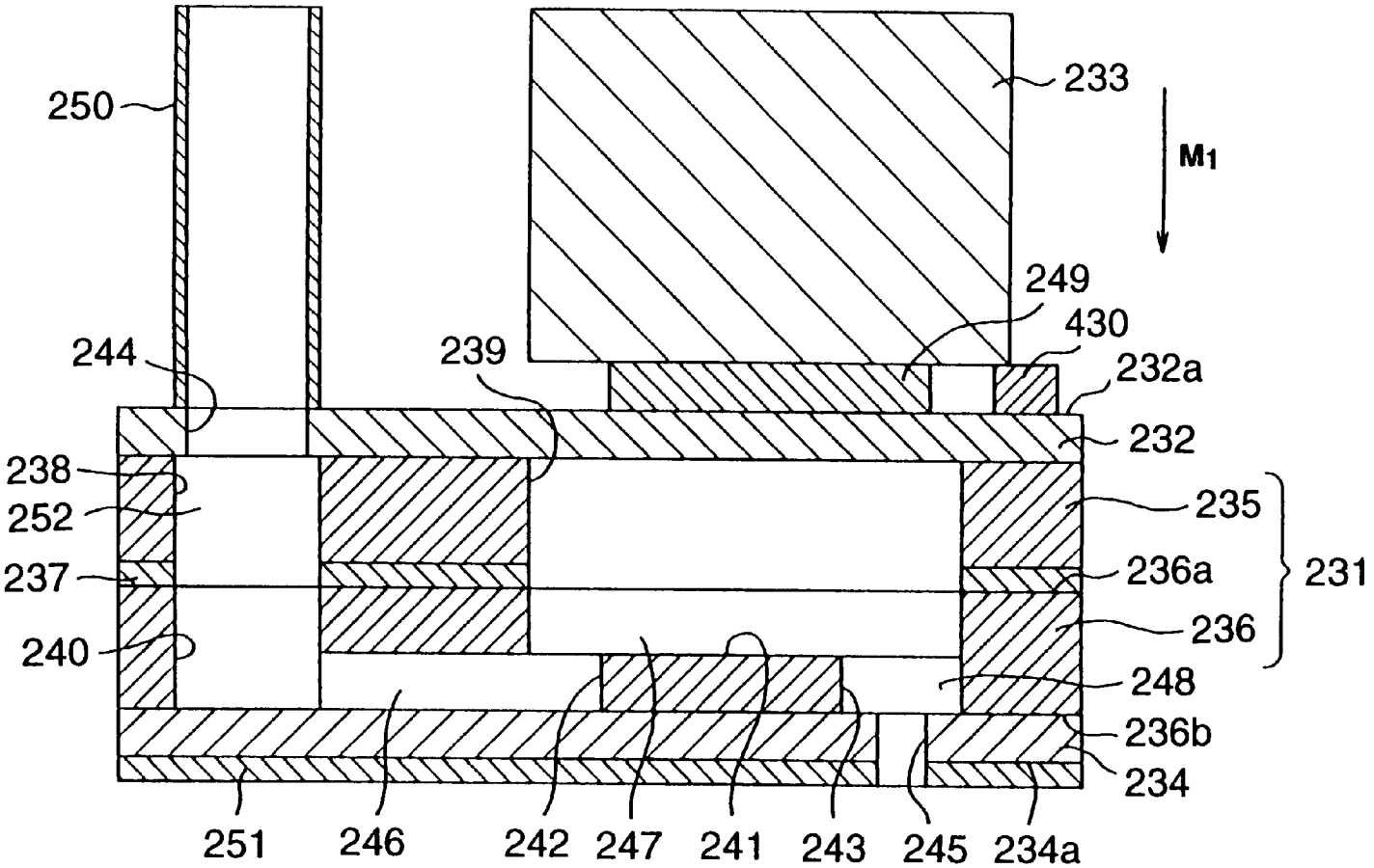
FIG. 74 is a schematic sectional view of the main part showing further another example of a print head.

That is, as shown in FIG. 74, in a print head provided with approximately the same constitution as the print head of the printer shown in FIG. 25, a pattern layer 430 may be also provided at least in a position except parts opposite to the pressure chamber 247 and the liquid supply passage 246 on one main surface 232*a* of the diaphragm 232. As a result, the above pattern layer 430 is formed on an adhesive layer consisting of thermoplastic resin not shown between the diaphragm 232 and the first member 235 constituting the pressure chamber forming part 231. In FIG. 74, the same reference numbers are allocated to parts provided with the same constitution as in FIG. 25 and the description is omitted.

In a printer provided with such a print head, in addition in that the same effect can be obtained as in the printer in the above first embodiment, the diaphragm 232 is set on the first member 235 of the pressure chamber forming part 231 when a print head is manufactured, heating and pressurizing pressure is applied only to the pattern layer 430 of the diaphragm 232 when the diaphragm 232 and the first member 235 are bonded by an adhesive layer consisting of thermoplastic resin, and operation for bonding the diaphragm 232 to the pressure chamber forming part 231 in which the pressure chamber 247 is formed is readily executed.

Further, if such a pattern layer is formed in a print head in which the liquid supply passage 416 shown in FIG. 64 is formed on the side of the diaphragm 232, no unnecessary pressure is applied to a part opposite to the liquid supply passage 416 in which the pattern layer is not formed in heating and pressurization, the liquid supply passage 416 is prevented from being blocked by an adhesive layer consisting of thermoplastic resin and it is preferable.

Furthermore, in the printer in the above second embodiment, a pattern layer may be also laminated on an adhesive layer consisting of thermoplastic resin at least in a position except part opposite to the first and second pressure chambers and parts opposite to the first and second liquid supply passages.

Figure 75:
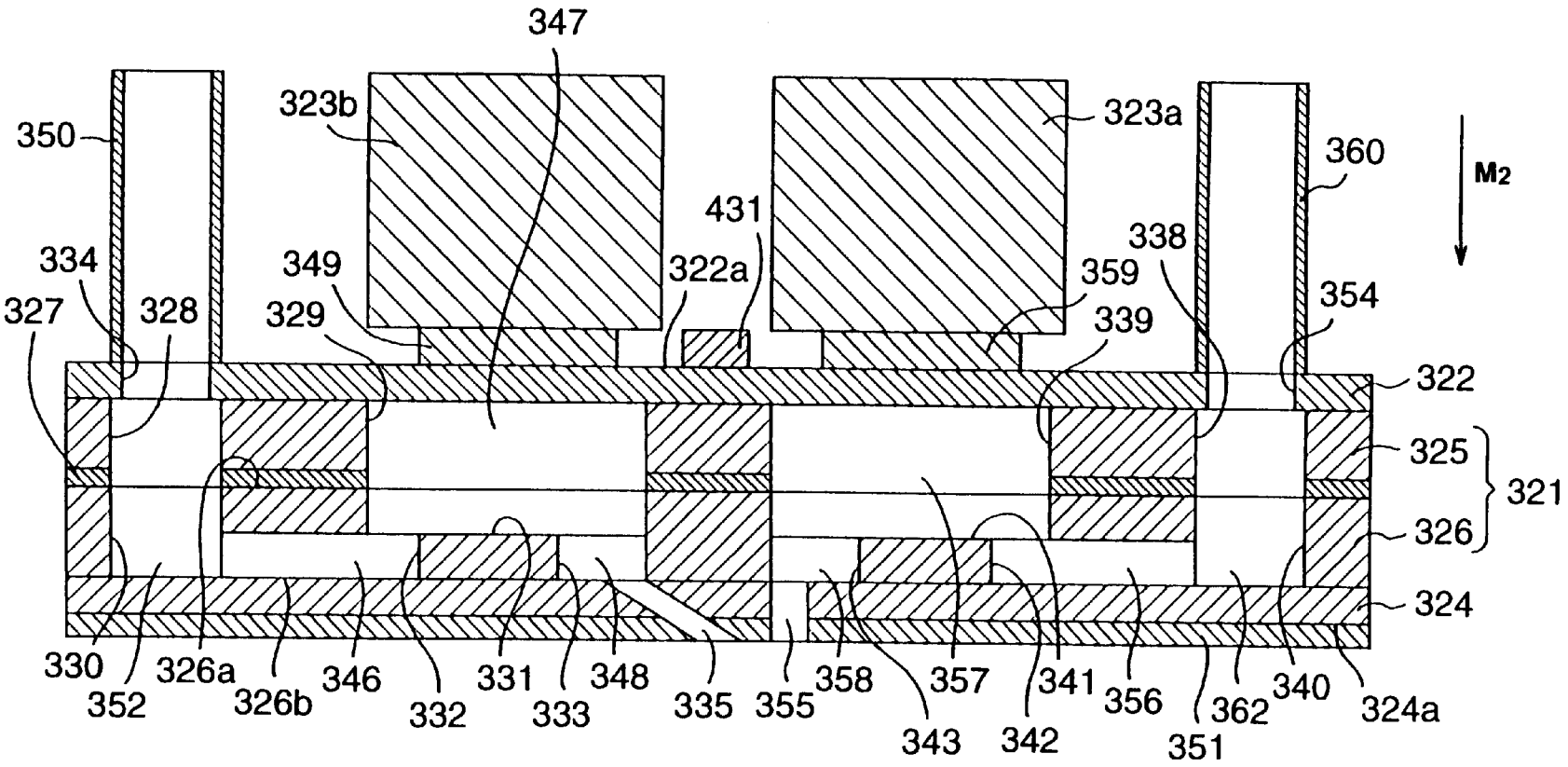
FIG. 75 is a schematic sectional view of the main part showing further another example of a print head.

That is, as shown in FIG. 75, in a print head provided with approximately the same constitution as the print head of the printer shown in FIG. 41, a pattern layer 431 may be also provided at least in a position except parts opposite to the first and second pressure chambers 357 and 347 and parts opposite to the first and second liquid supply passages 356 and 346 on one main surface 322*a* of the diaphragm 322. As a result, the above pattern layer 431 is formed on an adhesive layer consisting of thermoplastic resin not shown between the diaphragm 322 and the first member 325 constituting the pressure chamber forming part 321. In FIG. 75, the same reference numbers are allocated to parts provided with the same constitution as in FIG. 41 and the description is omitted.

In a printer provided with such a print head, in addition in that the same effect can be obtained as in the printer in the above second embodiment, the diaphragm 322 is set on the first member 325 of the pressure chamber forming part 321 when a print head is manufactured, heating and pressurizing pressure is applied only to the pattern layer 431 of the diaphragm 322 when the diaphragm 322 and the first member 325 are bonded by an adhesive layer consisting of thermoplastic resin, and operation for bonding the diaphragm 322 to the pressure chamber forming part 321 in which the first and second pressure chambers 357 and 347 are formed is readily executed.

Furthermore, in the above first and second embodiments, the example in which the present invention is applied to the serial printer is described, however, the present invention can be applied to a so-called line printer or a so-called drum printer.

Figure 76:
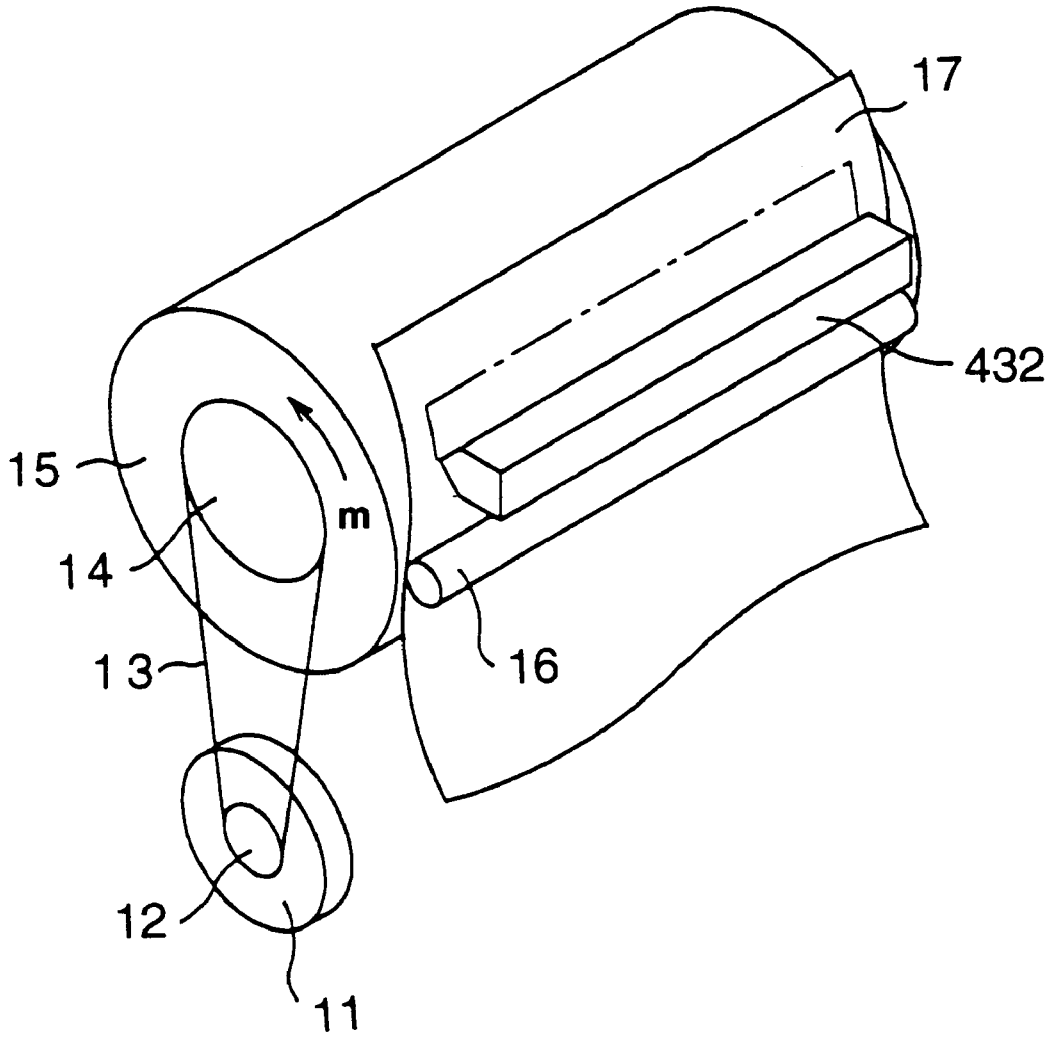
FIG. 76 is a schematic perspective view of the main part showing further another embodiment of a printer.

The above line printer is provided with constitution shown in FIG. 76. In FIG. 76, the same reference numbers are allocated to the same parts as in FIG. 1 and the description is omitted.

In the line printer liquid emitting recorder, a line head 432 in which a large number of print heads not shown are arranged in a line is fixed in the axial direction of a drum 15. In the line printer, the line head 432 simultaneously performs printing for one line and when printing for one line is completed, the drum 15 is rotated for one line in a direction shown by an arrow m in FIG. 76 and printing for the next line is executed. In this case, a method of printing all lines at a time, a method of dividing into plural blocks or a method of printing every other line alternately is conceivable.

Figure 77:
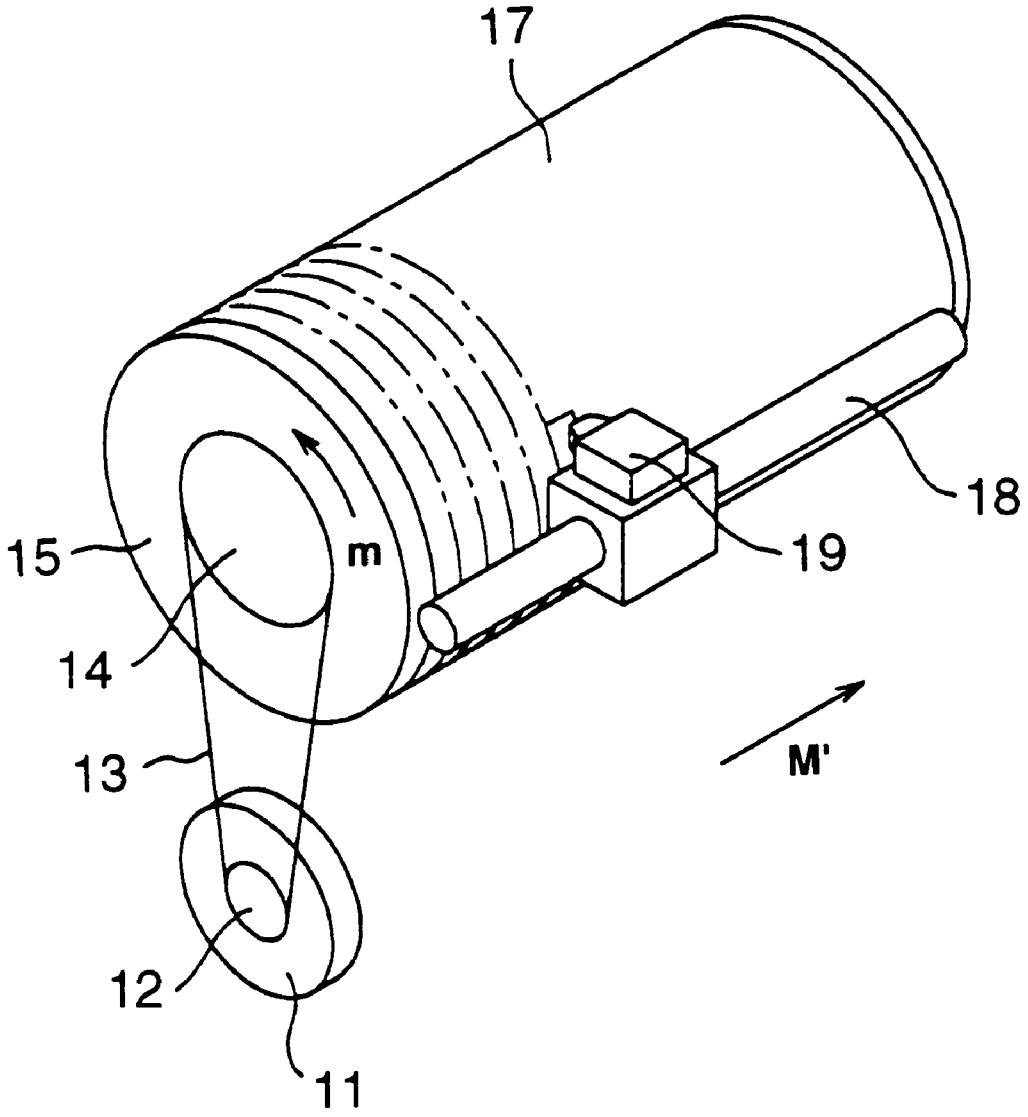
FIG. 77 is a schematic perspective view of the main part showing further another embodiment of a printer.
Figure 78:
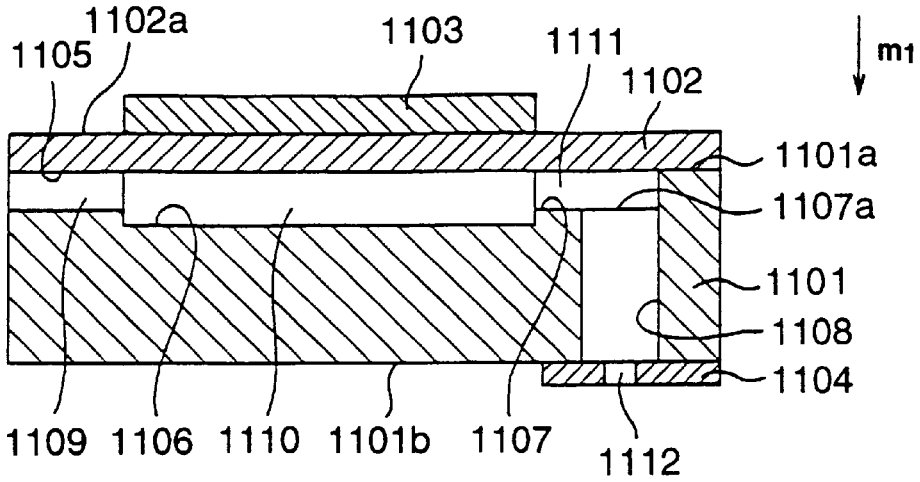
FIG.78 Prior Art
FIG. 78 is a schematic sectional view of the main part showing a conventional type print head.
Figure 79:
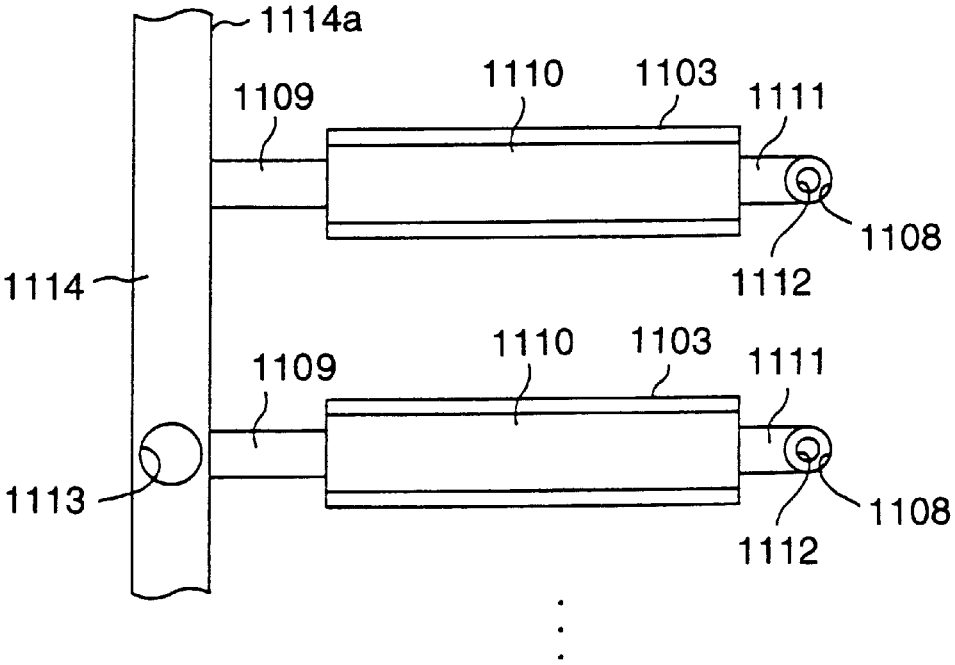
FIG.79 Prior Art
FIG. 79 is a schematic plan of the main part showing the conventional type print head.

In the meantime, the drum printer is provided with constitution shown in FIG. 77. In FIG. 77, the same reference numbers are also allocated to the same parts as in FIG. 1 and the description is omitted. In the drum printer, when a drum 15 is rotated, a droplet including ink is emitted from a print head 19 in synchronization with the rotation and an image is formed on printing paper 17. When the drum 15 is rotated once in a direction shown by an arrow m in FIG. 77 and printing for one column is completed in a circumferential direction on the printing paper 17, a feed screw 18 is rotated, a print head part 3 is moved by one pitch in a direction shown by an arrow M' in FIG. 77 and the next printing is executed. In this case, there is also a method of rotating the drum 17 and the feed screw 18 simultaneously and gradually moving the print head 19, printing. In the case of a multinozzle head and constitution in which the same place is printed many times, spiral printing is made, rotating the interlocked drum 17 and feed screw 18 simultaneously.

Further, for the printers in the first and second embodiments, the example in which the groove part forming the pressure chamber is also provided in the second member constituting the pressure chamber forming part or the groove parts forming the fist and second pressure chambers are provided is described, however, even if the depth of the groove part provided to the second member is set to an extremely small value, it has no effect upon effect produced by the present invention. Therefore, no groove part forming a pressure chamber is necessarily required to be provided in the second member and if only a nozzle leading hole formed in the second member communicates with a pressure chamber, the effect of the present invention can be obtained.

Further, in the printers in the first and second embodiments, each size of the diaphragm 232 and the diaphragm 322 is respectively adapted to the size of the upper surface of the first member 235 or the size of the upper surface of the first member 325 so that the diaphragms can be respectively bonded to each first member, however, these diaphragms may be formed in such size that they can be bonded in a position respectively corresponding to the pressure chamber 247 and the first and second pressure chambers 157 and 147. As a diaphragm can be miniaturized by the above method, a process for bonding the diaphragm and a first member is more facilitated.

Furthermore, for the printers in the first and second embodiments, the example in which mainly, the first members 235 and 325, the second members 236 and 326 are respectively formed using the plates 261, 271, 371 and 381 which are respectively 0.1 mm thick is described, however, there is no particular problem even if the thickness of the plates 261, 271, 371 and 381 is respectively set to a value different from 0.1 mm. However, in the above example, as each through hole part, each groove part and each through hole are formed by etching, it is desirable that the thickness of the plates 261, 271, 371 and 381 is respectively set to 0.07 mm or more. In this case, strength enough to increase pressure in the pressure chamber 247, the first and second pressure chambers 357 and 347 is provided to the respective plates.

Further, in the printers in the first and second embodiments, the condition of thermocompression bonding between the orifice plate 234 and the second member 236 and between the orifice plate 324 and the second member 326 is set so that pressurization temperature is approximately 230° C. and pressure is approximately 20 to 30 $kgf/cm^2$, however, the condition of thermocompression bonding is not limited to the above condition and has only to be a condition under which bonding strength can be obtained.

Also, for the printers in the first and second embodiments, the example in which the nozzle is machined by an excimer laser beam is described, however, the processing of a nozzle is not limited to this and a nozzle can be machined using a carbon dioxide gas laser beam or various laser beams.

Furthermore, for the printers in the first and second embodiments, the constitution and the form of the pressure chamber 247, the first and second pressure chambers 357 and 347, the liquid supply passage 246, the first and second liquid supply passages 356 and 346 can be varied variously. If another means can substitute for the above, another means may be used in place of them.

Further, in the printers in the first and second embodiments, each form of the emission nozzles 245 and 355 and the quantity determining nozzle 335 can be varied variously. If another means can substitute for the above nozzles, another means may be used in place of them.

Also, for the printers in the first and second embodiments, the example in which the pressure chamber forming parts 231 and 321 are respectively formed by a metallic plate which is a stainless steel plate in which a groove and a hole are processed is described, however, for such a metallic plate, another various metallic plates can be used. If another means can substitute for such metallic plates, another means may be used in place of them.

Further, in the printers in the first and second embodiments, for material forming the orifice plates 234 and 324, various materials can be used in addition to the above materials. If another means can substitute for the above materials, another means may be used in place of them.

Furthermore, in the printers in the first and second embodiments, for means for supplying ink from the ink tank or the diluent solvent tank not shown to the liquid supply passage or the second liquid supply passage or for supplying a diluent solvent to the first liquid supply passage, the ink buffer tank or the diluent solvent buffer tank is used, however, the form or the constitution of the ink buffer tank or the diluent solvent buffer tank can be varied variously. If another means can substitute for the above buffer tank, another means may be used in place of it.

INDUSTRIAL APPLICABILITY

In the printer according to the above first invention, for a diaphragm, the diaphragm provided with a thermoplastic layer covering the pressure chamber and also provided with an adhesive property and a pattern layer laminated on the above thermoplastic layer at least in a position except a part opposite to the pressure chamber and a part opposite to the liquid supply passage is used, in the printer according to the second invention, for a diaphragm, the diaphragm provided with a thermoplastic layer covering the first and second pressure chambers and also provided with an adhesive property and a pattern layer laminated on the above thermoplastic layer at least in a position except parts opposite to the first and second pressure chambers and parts opposite to the first and second liquid supply passages is used, and also in both printers, the diaphragm is set on the main surface of the pressure chamber forming part in which the liquid supply passage is formed, pressure is applied only to the pattern layer of the diaphragm when the thermoplastic layer of the diaphragm is pressurized, heated and bonded onto the pressure chamber forming part, no unnecessary pressure is applied to a part opposite to the liquid supply passage in which the pattern layer is not formed, the liquid supply passage is prevented from being blocked by the thermoplastic layer, and operation for bonding the diaphragm to the pressure chamber forming part in which the pressure chamber is formed is facilitated.

Further, the printers according to the above third and fourth inventions are provided with an adhesive layer consisting of thermoplastic resin and an adhesive layer consisting of thermosetting resin and provided with an adhesive layer consisting of thermoplastic resin between the pressure chamber forming part and the diaphragm, and bonding strength of the diaphragm to the pressure chamber forming part is sufficiently secured.

In the printers according to the above third and fourth inventions, the emission nozzle or the emission nozzle and the quantity determining nozzle are formed by a nozzle forming member, the pressure chamber forming part and the nozzle forming member are bonded under room temperature after the diaphragm and the pressure chamber forming part are bonded when an adhesive layer consisting of thermosetting resin is formed between the pressure chamber forming part and the nozzle forming member if so, the adhesive layer consisting of thermoplastic resin is not influenced at this time, no heat is also applied to a liquid repelling film if the liquid repelling film is formed in the nozzle forming member, and a range in which a liquid repelling film is selected is widened.

Further, in the printers according to the above third and fourth inventions, if the diaphragm is bonded to one member of the pressure chamber forming part by thermoplastic resin beforehand and the nozzle forming member is bonded to the other (another) member beforehand in case the pressure chamber forming part is constituted by two or more members and an adhesive layer consisting of thermosetting resin is formed between these members, each member constituting the pressure chamber forming part has only to be bonded by thermosetting resin, the adhesive layer consisting of thermoplastic resin is not influenced at this time, and no heat is applied to a liquid repelling film even if the liquid repelling film is formed in the nozzle forming member.

What is claimed is:

1. A printer comprising:

a pressure chamber forming part comprising a pressure chamber and a liquid supply passage for supplying liquid to the pressure chamber, the pressure chamber forming part comprising a first member bonded to a diaphragm and a second member bonded to a nozzle forming member with the first and second members connected together with a first adhesive layer so that the pressure forming part is sandwiched between a diaphragm and a nozzle forming member, the nozzle forming member comprising an emission nozzle in communication with the pressure chamber, the diaphragm comprising a thermoplastic layer with one side of the thermoplastic layer being adhered to the pressure chamber forming part over the pressure chamber and liquid supply passage and a second side facing a piezoelectric element, the second side further accommodating a pattern layer laminated on the second side of the thermoplastic layer between the piezoelectric element and the thermoplastic layer, the pattern layer only partly covering the second side of the thermoplastic layer and not extending laterally outward beyond the piezoelectric element, the piezoelectric element being connected to the diaphragm at the pattern layer, the pattern layer being in alignment with both the pressure chamber and the liquid supply passage.

2. The printer of claim 1 wherein the pattern layer comprises metal.

3. The printer of claim 1 wherein the pattern layer has a thickness of at least 15 $\mu$m.

4. The printer of claim 1 wherein the thermoplastic layer comprises polyimide material.

5. The printer of claim 1 wherein the thermoplastic layer comprises a material having a glass transition point ranging from about 180° C. to about 250° C.

6. The printer of claim 5 further comprising a thin film disposed between the thermoplastic layer and the pattern layer.

7. A printer comprising:

a pressure chamber forming part provided with a first pressure chamber into which an emitted medium is fed, a first liquid supply passage for supplying liquid to the first pressure chamber, a second pressure chamber into which a quantity determined medium is fed and a second liquid supply passage for supplying liquid to the second pressure chamber, the pressure chamber forming part comprising a first member bonded to a diaphragm and a second member bonded to a nozzle forming member with the first and second members connected together with a first adhesive layer so that the pressure forming part is sandwiched between a diaphragm and a nozzle forming member, the nozzle forming member comprising an emission nozzle in communication with the first pressure chamber and a quantity determining nozzle communicating with the second pressure chamber, the quantity determining nozzle being directed at an angle towards the emission nozzle, the diaphragm being disposed between the pressure chamber forming part and a piezoelectric element, the diaphragm comprising a thermoplastic layer having a first side that covers the first pressure chamber, the first liquid supply passage, the second pressure chamber and the second liquid supply passage, the thermoplastic layer further comprising a second opposite side with a pattern layer laminated thereon, the pattern layer only partly covering the second side of the thermoplastic layer and not extending laterally outward beyond the piezoelectric element, at least one portion of the pattern layer being in alignment with each of the first pressure chamber and the second pressure chamber, wherein after the quantity determined medium is made to percolate from the quantity determining nozzle towards the emission nozzle, the emitted medium is emitted from the emission nozzle and the quantity determined medium and the emitted medium are mixed and emitted.

8. The printer of claim 7 wherein the pattern layer comprises metal.

9. The printer of claim 7 wherein the pattern layer has a thickness of at least 15 $\mu$m.

10. The printer of claim 7 wherein the thermoplastic layer comprises a polyimide material.

11. The printer of claim 7 wherein the thermoplastic layer comprises a material having a glass transition point from about 180° C. to about 250° C.

12. The printer of claim 11 further comprising a thin film disposed between the thermoplastic layer and the pattern layer.

13. A printer comprising:

a pressure chamber forming part comprising with a pressure chamber and a liquid supply passage for supplying liquid to the pressure chamber, the pressure chamber forming part comprising a first member bonded to a diaphragm and a second member bonded to a nozzle forming member with the first and second members connected together with a first adhesive layer so that the pressure forming part is sandwiched between a thermoplastic diaphragm and a nozzle forming member, the nozzle forming member comprising an emission nozzle in communication with the pressure chamber, the diaphragm comprising a thermoplastic layer comprising a first side that covers the pressure chamber and the liquid supply passage, the thermoplastic layer further comprising a second side that faces a piezoelectric element, the second side accommodating a pattern layer laminated thereon which connects the piezoelectric element to the diaphragm, the diaphragm being disposed between the pressure chamber forming part and a piezoelectric element, the pattern layer only partly covering the second side of the thermoplastic layer and not extending laterally outward beyond the piezoelectric element, the printer further comprising a second adhesive layer comprising thermoplastic resin, the second adhesive layer attaching the diaphragm to the first member of the pressure chamber forming part.

14. The printer of claim 13 wherein a third adhesive layer is disposed between and attaches the nozzle forming member to the pressure chamber forming part.

15. The printer of claim 13 wherein the nozzle forming member further comprises an emission nozzle having an outer periphery, the outer periphery of the emission nozzle being coated with a liquid repelling film.

16. The printer of claim 13 wherein the thermoplastic resin has a glass transition temperature ranging from about 180° C. to about 250° C.

17. The printer of claim 13 wherein the thermoplastic resin is polyimide resin.

18. The printer of claim 13 wherein the adhesive layer further comprises a first side facing the pressure chamber forming part and a second side facing the diaphragm, the second side accommodating a pattern layer laminated onto the second side, the pattern layer being in alignment with the pressure chamber and the liquid supply passage.

19. A printer comprising:

a pressure chamber forming part comprising a first pressure chamber into which an emitted medium is fed, a first liquid supply passage for supplying emitted medium to the first pressure chamber, a second pressure chamber into which a quantity determined medium is fed and a second liquid supply passage for supplying quantity determined medium to the second pressure chamber, the pressure chamber forming part comprising a first member bonded to a diaphragm and a second member bonded to a nozzle forming member with the first and second members connected together with a first adhesive layer so that the pressure forming part is sandwiched between a nozzle forming member and a diaphragm, the nozzle forming member comprising an emission nozzle communicating with the first pressure chamber and a quantity determining nozzle communicating with the second pressure chamber, the diaphragm comprising a thermoplastic layer comprising a first side that covers the first pressure chamber, the first liquid supply passage, the second pressure chamber and the second liquid supply passage, the thermoplastic layer further comprising a second side that faces a piezoelectric element, the second side accommodating a pattern layer laminated thereon which connects the piezoelectric element to the diaphragm, the pattern layer only partly covering the second side of the thermoplastic layer and not extending laterally outward beyond the piezoelectric element, the diaphragm being disposed between the pressure chamber forming part and a piezoelectric element, the piezoelectric element being aligned with the first pressure chamber and the second pressure chamber although on an opposite side of the diaphragm therefrom, the printer further comprising a second adhesive layer comprising thermoplastic resin, the second adhesive layer connecting the diaphragm to the pressure chamber forming part, wherein after the quantity determined medium is made to percolate from the quantity determining nozzle towards the emission nozzle, the emitted medium is emitted from the emission nozzle and the quantity determined medium and the emitted medium are mixed and emitted.

20. The printer of claim 19 wherein the pressure chamber forming part is attached to the nozzle forming member by a third adhesive layer comprising a thermosetting resin.

21. The printer of claim 19 wherein the pressure chamber forming part comprises two or more members, and a third adhesive layer comprising a thermosetting resin is disposed between said two or more members.

22. The printer of claim 19 wherein the emission nozzle and the quantity determining nozzle are coated with a liquid repelling film.

23. The printer of claim 19 wherein the thermoplastic resin has a glass transition temperature ranging from about 180° C. to about 250° C.

24. The printer of claim 19 wherein the thermoplastic resin is polyimide resin.

25. A method of manufacturing a printer comprising the following steps:

providing a pressure chamber forming part with a pressure chamber and a liquid supply passage for supplying liquid to the pressure chamber, the pressure forming part comprising a first member and a second member, connecting the first and second members together with a first layer of adhesive, providing a nozzle forming member having an emission nozzle, attaching the nozzle forming member to the second member of the pressure chamber forming part so that the emission nozzle is in communication with the pressure chamber, attaching a diaphragm to the first member of the pressure chamber forming part with a thermoplastic resin so that the diaphragm covers the pressure chamber and so that the pressure chamber forming part is disposed between the nozzle forming member and the diaphragm, the diaphragm comprising a thermoplastic layer having a first side that faces the pressure chamber and a second side, the second side being laminated with a pattern layer, attaching a piezoelectric element to the pattern layer opposite the pressure chamber forming part so that the piezoelectric element is in alignment with the pressure chamber, the pattern layer only partly covering the second side of the thermoplastic layer and not extending laterally outward beyond the piezoelectric element.

26. The method of claim 25 wherein the step of attaching the nozzle forming member to the pressure chamber forming part further comprises attaching the nozzle forming member to the pressure chamber forming part with thermosetting resin.

27. The method of claim 25 further comprising the step of applying liquid repelling processing to the emission nozzle.

28. A method of manufacturing a printer comprising the following steps:

providing a pressure chamber forming part with a first pressure chamber into which an emitted medium is fed, a first liquid supply passage for supplying emitted medium to the first pressure chamber, a second pressure chamber into which a quantity determined medium is fed and a second liquid supply passage for supplying quantity determining medium to the second pressure chamber, the pressure forming part comprising a first member and a second member, connecting the first and second members together with a first layer of adhesive, forming a nozzle forming member with an emission nozzle and a quantity determining nozzle, attaching the nozzle forming member to the second member of the pressure chamber forming part so that the emission nozzle is in communication with the first pressure chamber and so that the quantity determining nozzle is in communication with the second pressure chamber, attaching a diaphragm to the first member of the pressure chamber forming part with a thermoplastic resin so that the diaphragm covers the first pressure chamber and the second pressure chamber and so that the pressure chamber forming part is sandwiched between the diaphragm and the nozzle forming member, the diaphragm comprising a thermoplastic layer having a first side that faces the pressure chamber and a second side, the second side being laminated with a pattern layer, attaching a piezoelectric element to the pattern layer of the thermoplastic layer of the diaphragm so that the piezoelectric element is disposed opposite the diaphragm from the first pressure chamber and the second pressure chamber.

29. The method of claim 28 wherein the step of attaching the nozzle forming member to the pressure chamber forming part further comprises attaching the nozzle forming member to the pressure chamber forming part with thermosetting resin.

30. The method of claim 28 wherein the pressure chamber forming part comprises two or more members; and the two or members are bonded by thermosetting resin.

31. The method of claim 30 wherein the step of attaching the nozzle forming member to the pressure chamber forming part further comprises attaching the nozzle forming member to one of the two or more members with thermosetting resin.

32. The method of claim 28 further comprising the step of applying liquid repelling processing to the emission nozzle and the quantity determining nozzle.

* * * * *